US005428434A

United States Patent [19]

Hirao

[11] Patent Number: 5,428,434

[45] Date of Patent: Jun. 27, 1995

[54] FLASH-RADIATION TYPE TONER IMAGE FIXING DEVICE

[75] Inventor: Naoto Hirao, Kawasaki, Japan

[73] Assignee: Fujitsu Limited, Kawasaki, Japan

[21] Appl. No.: 258,436

[22] Filed: Jun. 10, 1994

[30] Foreign Application Priority Data

Jun. 10, 1993 [JP] Japan ..... 5-138093

[51] Int. Cl.[6] ..... G03G 15/20

[52] U.S. Cl. ..... 355/288; 355/208; 219/216

[58] Field of Search ..... 355/288, 285, 289, 290, 355/282, 319, 208; 219/216, 388

[56] References Cited

U.S. PATENT DOCUMENTS

| | | | |
|---|---|---|---|
| 4,386,840 | 6/1983 | Garthwaite et al. | 355/288 |
| 4,434,353 | 2/1984 | Marsh et al. . | |
| 4,444,487 | 4/1984 | Miller et al. | 355/288 |
| 4,928,147 | 5/1990 | Baumann et al. | 355/288 |
| 5,218,411 | 6/1993 | Kosugiyama et al. | 355/285 |

FOREIGN PATENT DOCUMENTS

| | | |
|---|---|---|
| 58-54364 | 3/1983 | Japan . |
| 58-68773 | 4/1983 | Japan . |
| 60-60676 | 4/1985 | Japan . |
| 60-128477 | 7/1985 | Japan . |
| 60-237481 | 11/1985 | Japan . |

OTHER PUBLICATIONS

Patent Abstracts of Japan, vol. 10, No. 305 (P507), for Japanese Pat. Doc. 61-118781, Pub Jun. 1986.

Patent Abstracts of Japan, vol. 10, No. 106(P449), for Japanese Pat. Doc. 60-237481, Pub. Nov. 1985.

Patent Abstracts of Japan, vol. 5, No. 17(P047), for Japanese Pat. Doc. 55-146465, Pub. Nov. 1980.

*Primary Examiner*—R. L. Moses

[57] ABSTRACT

A toner image fixing device is disposed above a passageway along which a sheet of paper carrying toner images recorded thereon is moved, and has a lamp for emitting heat-radiation toward the sheet of paper to thermally fuse and fix the toner images thereon. Emission of the heat-radiation from the lamp is controlled such that the energy of the heat-radiation, to which a high-density toner image zone of the sheet of paper is subjected, is smaller than that of the heat-radiation to which a low-density toner image zone of the sheet of paper is subjected, to thereby prevent undulation of the sheet of paper. Where two-sided recording is applied to the sheet of paper, the prevention of undulation of the sheet of paper is especially significant because then the two-sided recording can be properly carried out.

25 Claims, 33 Drawing Sheets

*1
MAKE CHARGING SIGNAL CS LOW
908
HAS TIME $T_w$ ELAPSED ?
909
YES
NO
OUTPUT TRIGGER SIGNAL TS
910
C = 0 ?
911
YES
NO
D ← $D_2$
912
C = 1 ?
915
YES
NO
D ← $D_3$
C ← C + 1
913
HAS TIME $T_w$ ELAPSED ?
914
YES
NO
C = 2 ?
917
YES
NO
D ← $D_4$
918
C ← 0
919
HAS TIME $T_o$ ELAPSED ?
920
YES
NO
*2

FLASH-RADIATION TYPE TONER IMAGE FIXING DEVICE

BACKGROUND OF THE INVENTION

1) Field of the Invention

The present invention generally relates to a toner image formation apparatus such as an electrophotographic recording apparatus including a toner image carrying body such as a photosensitive drum, a dielectric drum or the like to which a toner image obtained from toner development of an electrostatic latent image is electrostatically adhered and held, and from which the toner image is electrostatically transferred to a recording medium such as a sheet of paper, and in particular, relates to a heat-radiation type toner image fixing device incorporated therein for thermally fusing and fixing the toner image on the recording medium.

2) Description of the Related Art

As a representative of the image formation apparatus as mentioned above, an electrophotographic recording apparatus is well known. In such an apparatus, the following processes are typically carried out:

a) a uniform distribution of electrical charges is produced on a surface of an electrostatic latent image carrying body;

b) an electrostatic latent image is formed on a charged area of the surface of the image carrying body by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a sheet of paper; and e) the transferred toner image is fixed and recorded on the paper.

Typically, the electrostatic latent image carrying body may be an electrophotographic photoreceptor, usually formed as a drum, called a photosensitive drum, having a cylindrical conductive substrate formed of a metal such as aluminum, and a photoconductive insulating film bonded to a cylindrical surface thereof and formed of an organic photoconductor (OPC), a selenium photoconductor or the like.

In the toner image fixing process, a heat roller type toner image fixing device is widely used. This device comprises a heat roller and a backup roller, engaged with the heat roller to form a nip therebetween, and a sheet of paper carrying with a toner image is passed through the nip in such a manner that the toner image is in direct contact with the heat roller, whereby the toner image is thermally fused and firmly adhered to the paper by the pressure exerted thereon by the rollers. In this fixing device, the toner image may be subjected to distortion due to the direct contact with the heat roller, especially during a high speed printing.

Another type of fixing device, a heat-radiation type toner image fixing device, is also known. This device is represented by a flash-type toner image fixing device comprising xenon lamps transversely arranged above a path for an sheet of paper carrying with a toner image. The xenon lamps are electrically energized to produce a flash or radiation, when the paper is passed below the xenon lamps. The toner image is thermally fused due to the flash-radiation, and a part of the fused toner penetrates into the fibers of the paper so that the toner image is firmly fixed on the paper. In this type fixing device, since the toner image cannot be directly contacted with any heat element, the quality of the fixed toner image may be superior to that of the toner image fixed by the heat roller type fixing device.

Nevertheless, the flash type toner image fixing device possesses an inherent defect in that a sheet of paper carrying with a toner image may be become undulated upon being subjected to the flash-radiation. When the toner image is unevenly distributed over the surface of the paper, e.g., when the paper includes a forward half zone in which the toner image is evenly recorded, and a rear ward half zone in which no toner image is recorded, an undulation is caused in the paper. In particular, a temperature of the forward half zone or black zone becomes higher than that of the rearward half zone or white blank zone, because a large portion of the flash-radiation is absorbed in the black zone, whereas a large portion of the flash-radiation is reflected from the white blank zone. Accordingly, the amount of moisture in the paper lost at the black zone is larger than that of the paper lost at the white blank zone, so that the black zone of the paper becomes more shrunken than the white blank zone thereof, to thereby cause an undulation in the paper.

Also, for example, when the toner image of the paper includes a table, in which the images of the characters are sparsely recorded, or an illustration, in which white blank zones are included, the paper may be undulated for the same reasons as mentioned above. Note, when the toner image is evenly recorded on the paper, e.g., when the images of characters are recorded on the paper in the full lines thereof, the paper will not be substantially undulated.

Although the undulation of the paper can be removed by leaving it stand in the atmosphere, it is preferable to prevent the paper from being undulated during the fixing process, so that a following process, such as a stacking process can be properly carried out.

In the image formation apparatus as mentioned above, when two-sided recording is performed on the sheet of paper, the undulation of the paper is a problem which must be solved. Where two-sided recording is applied to the paper, after the recording is applied to the first side of the paper, the paper must be reversed and returned to the toner image transferring process for applying the recording to the second side of the paper. In this case, if the paper is undulated, a second toner image cannot be properly transferred from the photosensitive drum to the second side of the undulated paper, because the paper cannot be tightly contacted with the surface of the drum due to the undulation of the paper. Namely, small clearance zones are locally formed between the undulated paper and the surface of the drum, and thus the second toner image cannot be sufficiently transferred to the second side of the undulated paper at the clearance zones.

SUMMARY OF THE INVENTION

Therefore, an object of the present invention is to provide a heat-radiation toner image fixing device, which is constituted such that a toner image fixing process can be carried out without undulating the sheet of paper carrying a toner image on one side thereof.

Another object of the present invention is to provide a heat-radiation toner image fixing device incorporated in a toner image formation apparatus in which two-sided recording can be selectively applied to a sheet paper, which device is constituted such that a toner image fixing process can be carried out without undulating a sheet of paper carrying a first toner image on one side thereof, whereby proper transferring of a second toner image to the second side of the paper can be ensured.

Yet another object of the present invention is to provide a heat-radiation toner image fixing device incorporated in a toner image formation apparatus in which two-sided recording can be selectively applied to a sheet of paper, which device is constituted such that, although a sheet of paper carrying a first toner image is undulated after fixing the first toner image on the first side of the paper, a proper transferring of a second toner image to the second side of the paper can be ensured.

In accordance with an aspect of the present invention, there is provided a toner image fixing device disposed above a passageway along which a sheet of paper carrying toner images recorded thereon is moved, which device comprises: emission means for emitting heat-radiation toward the passageway for thermally fusing and fixing the toner image onto the sheet of paper; and control means for controlling the emission of heat-radiation from the emission means such that the energy of the heat-radiation, to which a high density toner image zone of the sheet of paper is subjected, is smaller than that of the heat-radiation, to which a low density toner image zone of the sheet of paper is subjected, to thereby prevent undulation of the sheet of paper. The toner image fixing device may further comprise calculation means for calculating total density data representing densities of toner images recorded on at least two zones of the sheet of paper; and determination means for determining the high density toner image zone and the low density toner image zone of the sheet of paper on the basis of the total density data calculated by the calculation means. The calculation means may calculate the total density data on the basis of the density information obtained from real toner images to be recorded on the sheet of paper or on the basis of the image information for forming real toner images to be recorded on the sheet of paper. The emission means may include lamp means for emitting heat-radiation, source means for supplying electric energy to the lamp means, and control means, which controls the supply of the electric energy from the source means to the lamp means, for controlling the emission of heat-radiation.

In accordance with another aspect of the present invention, there is provided a toner image fixing device used for two-sided recording and disposed above a passageway along which a sheet of paper carrying toner images recorded thereon is moved, which device comprises: emission means for emitting heat-radiation toward the passageway for thermally fusing and fixing the toner image on the sheet of paper; and control means for controlling the emission of heat-radiation from the emission means such that the energy of the heat-radiation to which a high density toner image zone of the sheet of paper is subjected is smaller than that of the heat-radiation to which a low density toner image zone of the sheet of paper is subjected during an initial fixing process for the two-sided recording, to thereby prevent undulation of the sheet of paper. The toner image fixing device may further comprise: calculation means for calculating total density data, representing the densities of the toner images recorded on at least two zones of the sheet of paper, during the initial fixing process for the two-sided recording; and determination means for determining the high density toner image zone and the low density toner image zone of the sheet of paper on the basis of the total density data calculated by the calculation means. The calculation means may calculate the total density data on the basis of density information obtained from real toner images to be recorded on the sheet of paper or on the basis of image information for forming real toner images to be recorded on the sheet of paper. The emission means may include lamp means for emitting the heat-radiation, source means for supplying electric energy to the lamp means, and the control means, which controls supply of the electric energy from the source means to the lamp means, for controlling the emission of heat-radiation.

In accordance with yet another aspect of the present invention, there is provided a toner image fixing device used for two-sided recording and disposed above a passageway along which a sheet of paper carrying toner images recorded thereon is moved, which device comprises: emission means for emitting heat-radiation toward the passageway for thermally fusing and fixing the toner image on the sheet of paper; and control means for controlling the emission of heat-radiation from the emission means such that a high density toner zone and a low density toner image zone of the sheet of paper are subjected to low-level energy heat-radiation and middle-level energy heat-radiation, respectively, during an initial fixing process for the two-sided recording, to thereby prevent an undulation of the sheet of paper, and such that the sheet of paper is subjected to high-level energy heat-radiation during a second fixing process for the two-sided recording. The toner image fixing device may further comprise: calculation means for calculating total density data representing densities of toner images recorded on at least two zones of the sheet of paper, during the initial fixing process for the two-sided recording; and determination means for determining the high density toner image zone and the low density toner image zone of the sheet of paper on the basis of the total density data calculated by the calculation means. The calculation means may calculate the total density data on the basis of density information obtained from real toner images to be recorded on the sheet of paper or on the basis of image information for forming real toner images to be recorded on the sheet of paper. The emission means includes lamp means for emitting the heat-radiation, source means for supplying electric energy to the lamp means, and control means for controlling the supply of the electric energy from the source means to the lamp means for controlling the emission of heat-radiation.

In accordance with yet another aspect of the present invention, there is provided a toner image fixing device used for two-sided recording and disposed above a passageway along which a sheet of paper carrying toner images recorded thereon is moved, which device comprises: emission means for emitting heat-radiation toward the passageway for thermally fusing and fixing the toner image on the sheet of paper; and control means for controlling an emission of heat-radiation from the emission means such that a trailing zone of the sheet of paper is subjected to low-level energy heat-radiation, during an initial fixing process for the two-sided recording, to thereby prevent an undulation in the trailing zone of the sheet of paper, but to thereby cause an incomplete fixing of toner images held thereon, and such that the trailing zone of the sheet of paper, which is defined as a leading zone thereof during a second fixing process for the two-sided recording, is subjected to high-level energy heat-radiation to thereby resolve the incomplete fixing.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
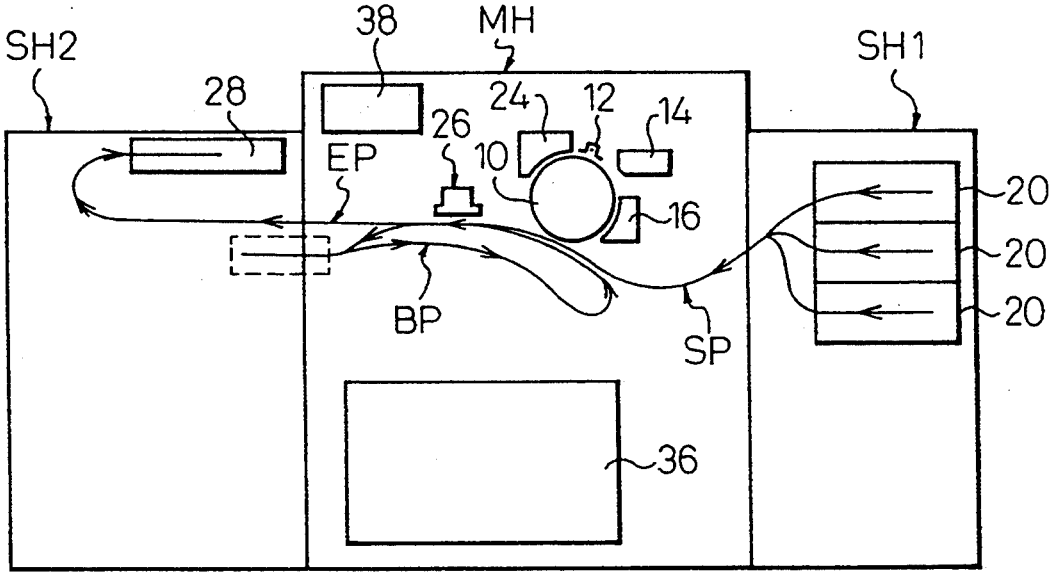
FIG. 1 is a schematic view of an electrophotographic recording apparatus using a flash-radiation type toner image fixing device constituted according to the present invention.
Figure 2:
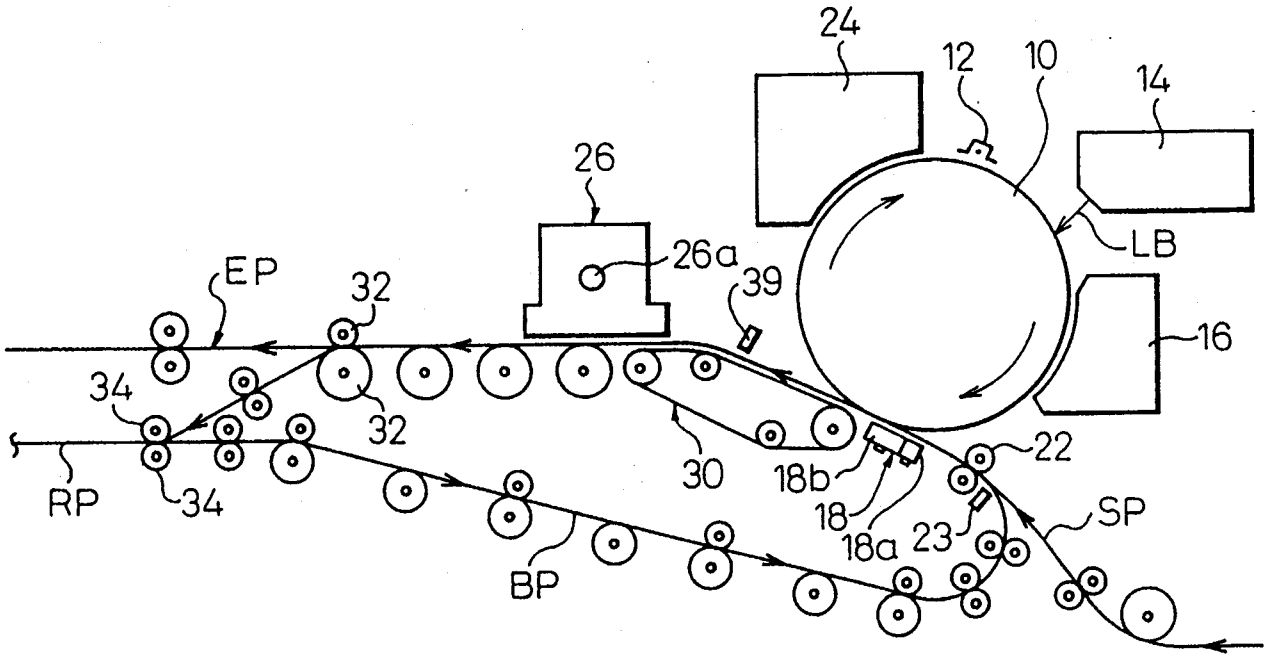
FIG. 2 is an enlarged schematic view showing a part of the recording apparatus of FIG. 1.

FIG. 1 schematically shows an electrophotographic recording apparatus, in which a flash type toner image fixing device according to the present invention is incorporated, and FIG. 2 is an enlarged view showing a part of the electrophotographic recording apparatus of FIG. 1. In the illustrated embodiment, the recording apparatus comprises a main housing MH, and two subhousing SH1 and SH2 associated therewith. A rotary photosensitive drum 10 formed as a latent image carrying body is provided in the main housing MH, and is rotated in a direction indicated by an arrow in FIG. 2 during an operation of the recording apparatus. The drum 10 may be made of an aluminum cylindrical hollow member and a photoconductive insulating film bonded to a cylindrical surface thereof. The photoconductive insulating film may be made of a selenium photoconductor, an organic photoconductor (OPC), or an amorphous silicone photoconductor (a-Si).

An electrically charged area is produced on the photosensitive drum 10 by, for example, an electric discharger 12 such as a corona discharger, and an electrostatic latent image is written on the charged area of the drum 10 by a laser beam LB emitted from a laser beam scanner 14. The latent image is electrostatically developed with an electrically charged toner or developer by a developing device 16, and the developed toner image is moved to a toner image transferring device 18 disposed beneath the drum 10, due to the rotation thereof.

On the other hand, a recording medium such a sheet of paper is fed from one of the paper cassettes 20, which are provided in the first subhousing SH1, to the transferring device 18 along a paper supply passageway SP represented by a solid line with arrows, as shown in FIGS. 1 and 2. When the leading edge of the fed paper reaches a pair of register rollers 22 and 22 provided in the paper supply passageway SP, it is stopped. This standby-condition is detected by a suitable photosensor 23 (FIG. 2) disposed in the vicinity of the register rollers 22 and 22. Namely, the photosensor 23 generates a standby signal upon detecting the leading edge of the paper, and thus the paper is stopped. Then, the paper is introduced, at a given timing, into a clearance between the drum 10 and the transferring device 18, so that the developed toner image can be electrostatically transferred to the paper in place.

The transferring device 18 includes a transfer charger 12*a*, and an AC charge eliminator 18*b* associated with and disposed adjacent to the transfer charger 18*a*. The transfer charger 18*a*, which may be a corona discharger, is subjected to an application of a DC electric energy to give the paper an electric charge having a polarity opposite to that of the electric charge of the developed toner image, whereby the electrostatic transfer of the toner image from the photosensitive drum 10 to the paper can be performed. The AC charge eliminator 18*b*, which also may be a corona discharger, is subjected to an application of an AC electric energy to partially eliminate the electric charge of the paper to which the toner image is transferred, whereby an electrostatic attraction acting between the paper and the drum 10 can be weakened for an effective separation of the paper from the drum 10. Note, in the toner image transferring process, a small amount of toner is left on the surface of the photosensitive drum 10 as a residual toner not transferred to the paper, but this residual toner is removed from the surface of the drum 10 by a toner cleaner 24, which may comprises a fur brush element and/or a scraper element (not shown).

The paper discharged from the clearance between the drum 10 and the transferring device 18, i.e., the paper carrying the transferred toner image, is then moved toward a flash type toner image fixing device 26 including a xenon lamp 26*a* (FIG. 2) transversely arranged with respect to the paper supply passageway SP, and the xenon lamp 26*a* emits a flash-radiation for thermally fusing and fixing the toner image on the paper. Note, the emission of the flash-radiation from the xenon lamp 26*a* is controlled according to the present invention, as explained hereinafter in detail. The paper carrying with the fixed toner image is further moved toward a paper receiver 28 provided in the second subhousing SH2, along a paper eject passageway EP represented by a solid line with arrows, as shown in FIGS. 1 and 2, and is then held in the paper receiver 28.

The paper supply passageway SP is extended from the paper cassettes 20 to the fixing device 26. A portion of the paper supply passageway SP extended between the transferring device 18 and the fixing device 26 is defined by an endless belt conveyer 30 including an perforated endless belt, and an interior space enclosed the perforated endless belt is in communication with a vacuum pump (not shown), so that the paper carrying with the transferred toner image can be securely moved from the transferring device 18 to the fixing device 26 without damaging the transferred toner image which is held on the paper by only the electrostatic force. The remaining portion of the paper supply passageway SP is defined by paper feed rollers provided at suitable intervals, as shown illustrated in FIG. 2, and by paper guide plates (not shown) associated therewith.

The paper eject passageway EP is extended from the fixing device 26 to the paper receiver 28, and is defined by paper feed rollers provided at suitable intervals, as illustrated in FIG. 2, and by paper guide plates (not shown) associated therewith.

The recording apparatus is constituted such that two-sided recording can be selectively applied to the paper. To this end, a paper bypass passageway BP is provided between the paper supply passageway SP and the paper eject passageway EP. Similar to the passageways SP and EP, the paper bypass passageway BP is represented by a solid line with arrows, as shown in FIGS. 1 and 2, and is defined by paper feed rollers provided at suitable intervals, as illustrated in FIG. 2, and by paper guide plates (not shown) associated therewith. A pair of paper switching rollers 32 is provided at a branched location of the paper eject passageway EP and the paper bypass passageway BP. During one-sided recording, the paper is fed to the paper receiver 28 through the paper eject passageway, but during two-sided recording, the paper is sent to the paper bypass passageway BP by the paper switching rollers 32. The paper bypass passageway BP is provided with a paper reversal portion RP projected therefrom, and a pair of rollers 34 and 34 installed at a location from which the paper reversal portion RP is projected from the paper bypass passageway BP, and the rollers 34 and 34 can be reversely driven. The paper sent from the paper eject passageway EP to the paper bypass passageway BP for the two-sided recording is once introduced into the paper reversal portion RP by the rollers 34 and 34. Then, the rollers 34 and 34 are reversely driven so that the paper is further moved toward the register rollers 22 and 22 along the paper bypass passageway PB. Accordingly, the paper is reversed and introduced the clearance between the photosensitive drum 10 and the transferring device 18, whereby the paper can be subjected to the two-sided recording.

In FIG. 1, reference numeral 36 indicates an electric source unit for various elements of the recording apparatus, and reference numeral 38 indicates a controller for controlling the overall operation of the recording apparatus. Of course, the fixing device 18 is electrically energized by the electric source unit 36 under the controller 38. In FIG. 2, reference numeral 39 indicates an optical density sensor disposed between the transferring device 18 and the fixing device 26 for detecting a density of the toner image recorded on the paper. In this embodiment, to prevent the paper from being undulated during the fixing process, the electric energization of the fixing device 26 is controlled on the basis of toner image density data obtained by the optical density sensor 39, as stated hereinafter in detail.

Figure 3A:
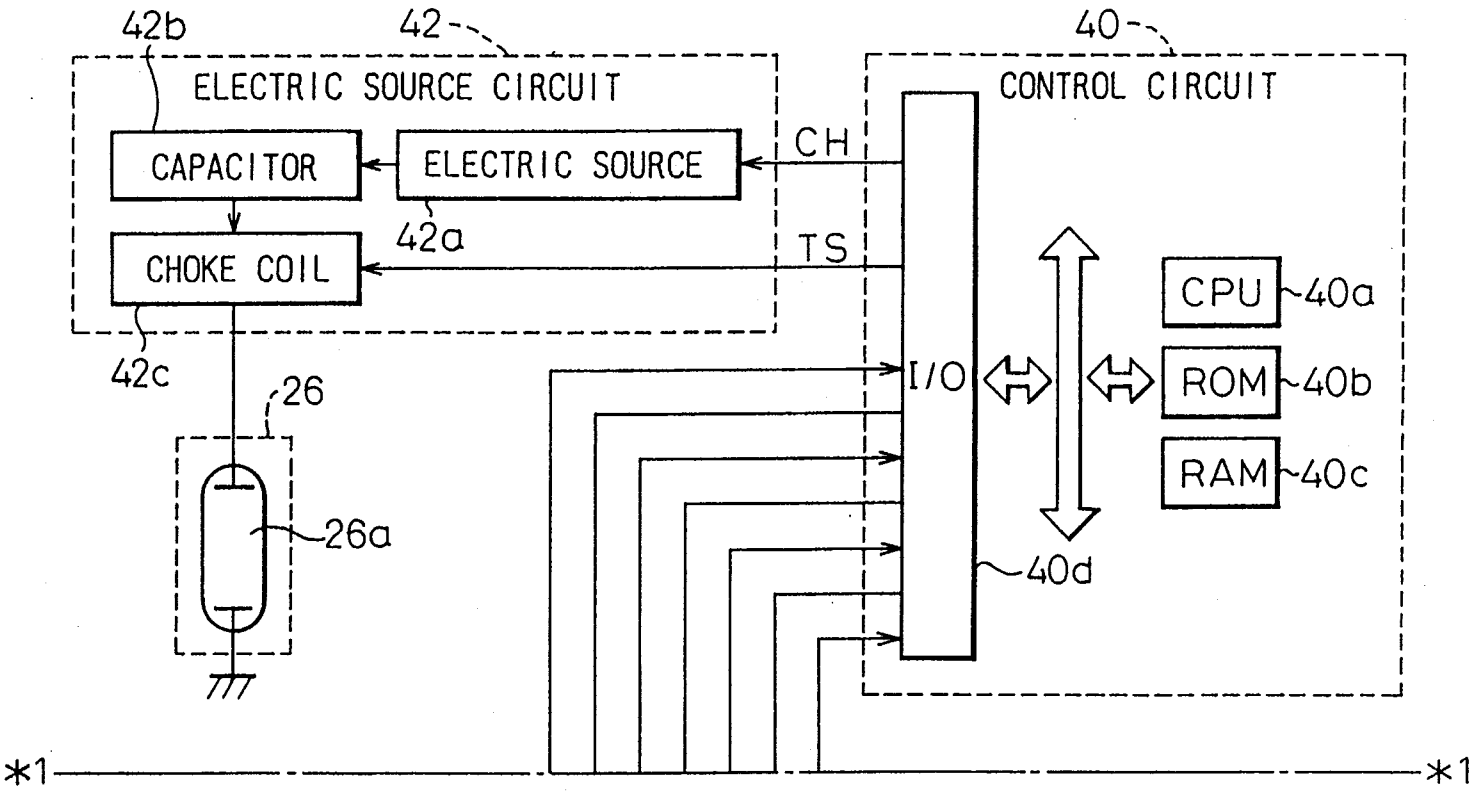
FIGS. 3(A) and 3(B) show a block diagram of the recording apparatus shown in FIG. 2.
Figure 3B:
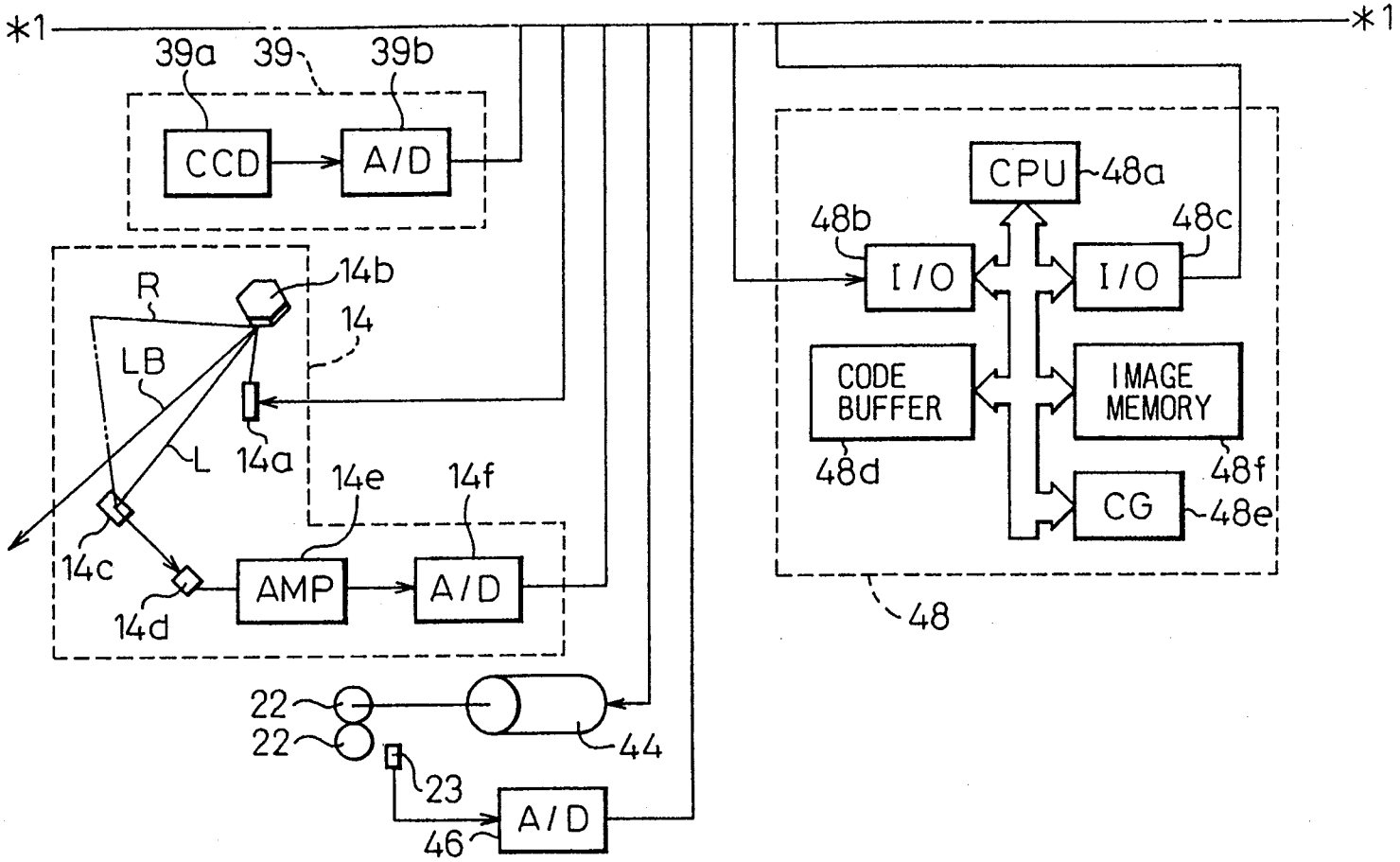

FIGS. 3(A) and 3(B) show a block diagram showing a part of the recording apparatus of FIGS. 1 and 2. The controller 36 includes a control circuit 40, which may be constructed by a microcomputer, as shown in FIGS. 3(A) and 3(B), comprising a central processing unit (CPU) 40*a*, a read only memory (ROM) 40*b* for storing routines, constants, etc., a random access memory (RAM) 40*c* for storing temporary data, and an input/output interface (I/O) 40*d*. The electric source unit 38 includes an electric source circuit 42 for electrically energizing the xenon lamp 26*a* of the fixing device 26, and the circuit 42 comprises a high voltage electric source 42*a*, a capacitor 42*b*, and a choke coil 42*c*. The control circuit 40 outputs a charging signal to the electric source 42*a*, and the capacitor 42*a* is electrically charged by the electric source 42*a* while the charging signal is switched from a low level to a high level. When the control circuit 40 outputs a trigger signal to the choke coil 42*c*, a high voltage pulse is output from the choke coil 42*c* to the xenon lamp 26*a*, to thereby initiate an emission of flash-radiation from the xenon lamp 26*a*. An energy of the flash-radiation depends upon an amount of the electric energy stored in the capacitor 42*b*. The optical density sensor 39 may be constructed a line sensor comprising a CCD (charge coupled device) element 39*a* for detecting the amount of light reflected from the paper. The CCD element 39*a* is connected to I/O 40*d* through an analog-to-digital (A/D) converter 39*b*, and thus toner image density data obtained by the optical density sensor 39 is received as digital data by the control circuit 40.

As shown in FIGS. 3(A) and 3(B), the laser beam scanner 14 includes a laser source 14*a* such as a semiconductor laser device for emitting the laser beam LB, and a polygon mirror 14*b* for deflecting the laser beam LB, for example, from a left position indicated by L to a right position indicated by R, to scan the surface of the photosensitive drum 10 with the deflected laser beam LB along a longitudinal axis of the drum 10. During the scan operation, the laser beam LB is turned on and off on the basis of binary image data obtained from a host apparatus such as a word processor, a computer or the like. The laser beam scanner 14 also includes a reflector element 14*c* for receiving and reflecting the laser beam deflected to the left position L, and a beam sensor 14*d* for detecting the laser beam reflected by the reflector element 14*c*. Namely, the beam sensor 14*d* generates a beam detecting signal when the laser beam LB is deflected to the left position L by the polygon mirror 14b. The beam sensor 14d is connected to I/O 40d through an amplifier 14e and an analog-to-digital (A/D) converter 14f, and thus the beam detecting signal generated by the beam sensor 14d is received as digital data by the control circuit 40.

In FIGS. 3(A) and 3(B), reference numeral 44 indicates an electric motor such as a stepping motor, a servo-motor or the like for driving the register rollers 22. The photosensor 23 is connected to I/O 40d through an analog-to-digital (A/D) converter 46, and thus the standby signal generated by the photosensor 23 is fetched as digital data by the control circuit 40.

When the recording apparatus is operated, the control circuit 40 is connected to a host control circuit 48, in the host apparatus, which comprises a central processing unit (CPU) 48a, first and second input/output interfaces (I/O) 48b and 48c connected to I/O 40d of the control circuit 40, a code buffer 48d for temporarily storing character code data successively read from a memory means such as a floppy disk, a character generator 48e for converting the character code data into character image data, and an image memory 48f for temporarily storing the image data.

When the control circuit 40 receives the standby-signal generated by the photosensor 23, or when the paper is waiting for the transfer of the toner image thereto, a signal demanding image data to be recorded on the paper (one page) is output from the control circuit 40 to the host control circuit 48. When the host control circuit 48 receives the image data demand signal, the character code data stored in the buffer 48d is converted into the image data by the character generator 48e, and is then stored in the image memory 48f. When the image data to be recorded on the paper (one page) is stored in the image memory 48f, a signal allowing a writing of the image data on the photosensitive drum 10 is output from the host control circuit 48 to the control circuit 40. Whenever the beam detecting signal is generated by the beam sensor 14d after the control circuit 40 receives the writing-allowing signal from the host control circuit 48, a horizontal synchronizing signal is output from the control circuit 40 to the host control circuit 48, and accordingly, the image data corresponding to one dot-line worth of the dot image is output from the image memory 48f to the control circuit 40, whereby the dot image can be properly formed as an electrostatic latent image on the drum 10 in such a way that the dot-lines are aligned with each other in the direction perpendicular to the scanning direction. On the other hand, when the beam detecting signal is first generated by the beam sensor 14d after the writing-allowing signal is received by the control circuit 40, a timing signal is output by the control circuit 40 to drive the electric motor 44 to release the paper from the standby-condition, whereby the toner image is transferred from the drum 10 to the paper at a proper position thereon.

Figure 4A:
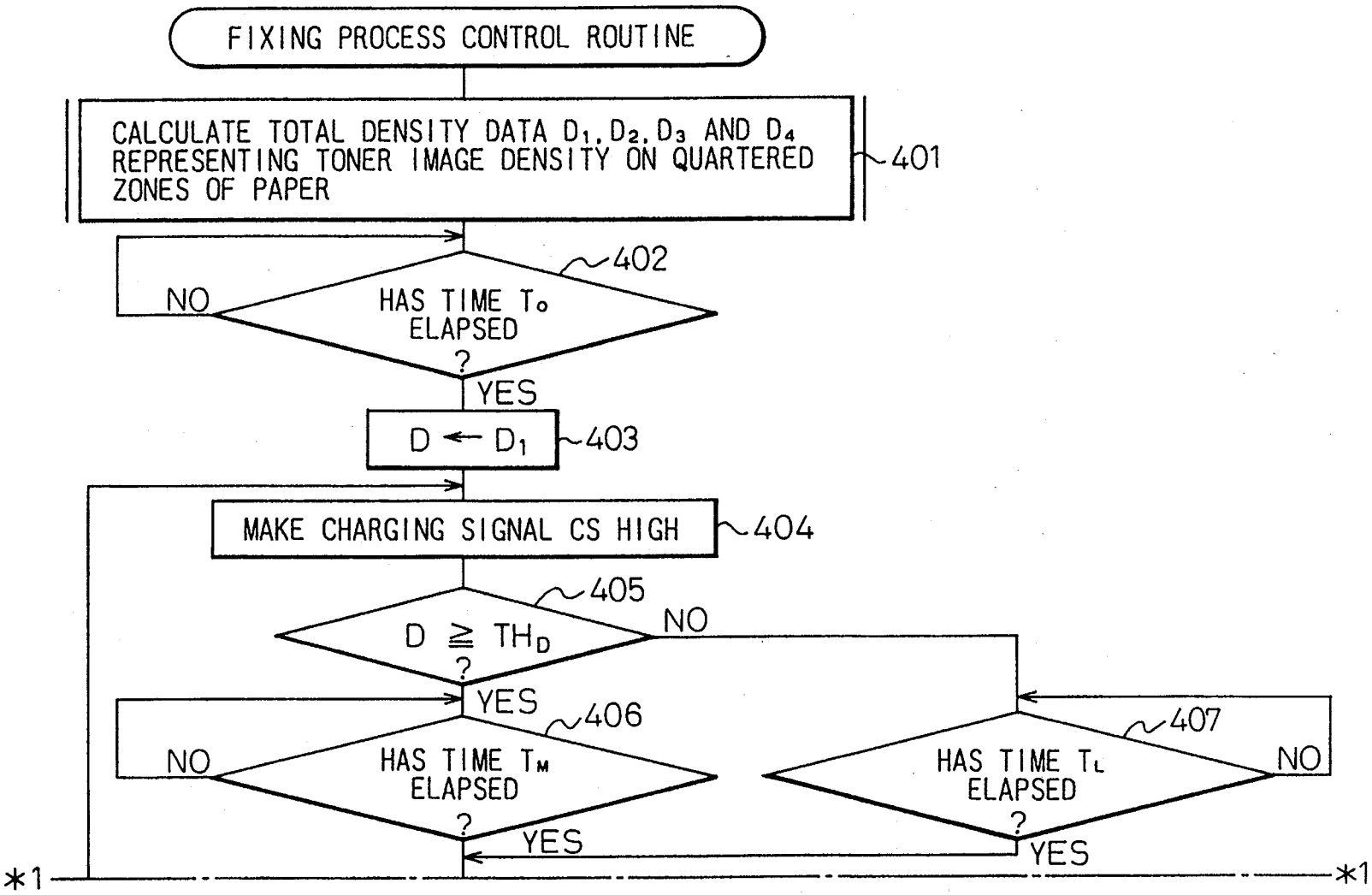
FIGS. 4(A) and 4(B) show a flow chart for explaining an operational mode of the toner image fixing device shown in FIGS. 3(A) and 3(B)
Figure 4B:
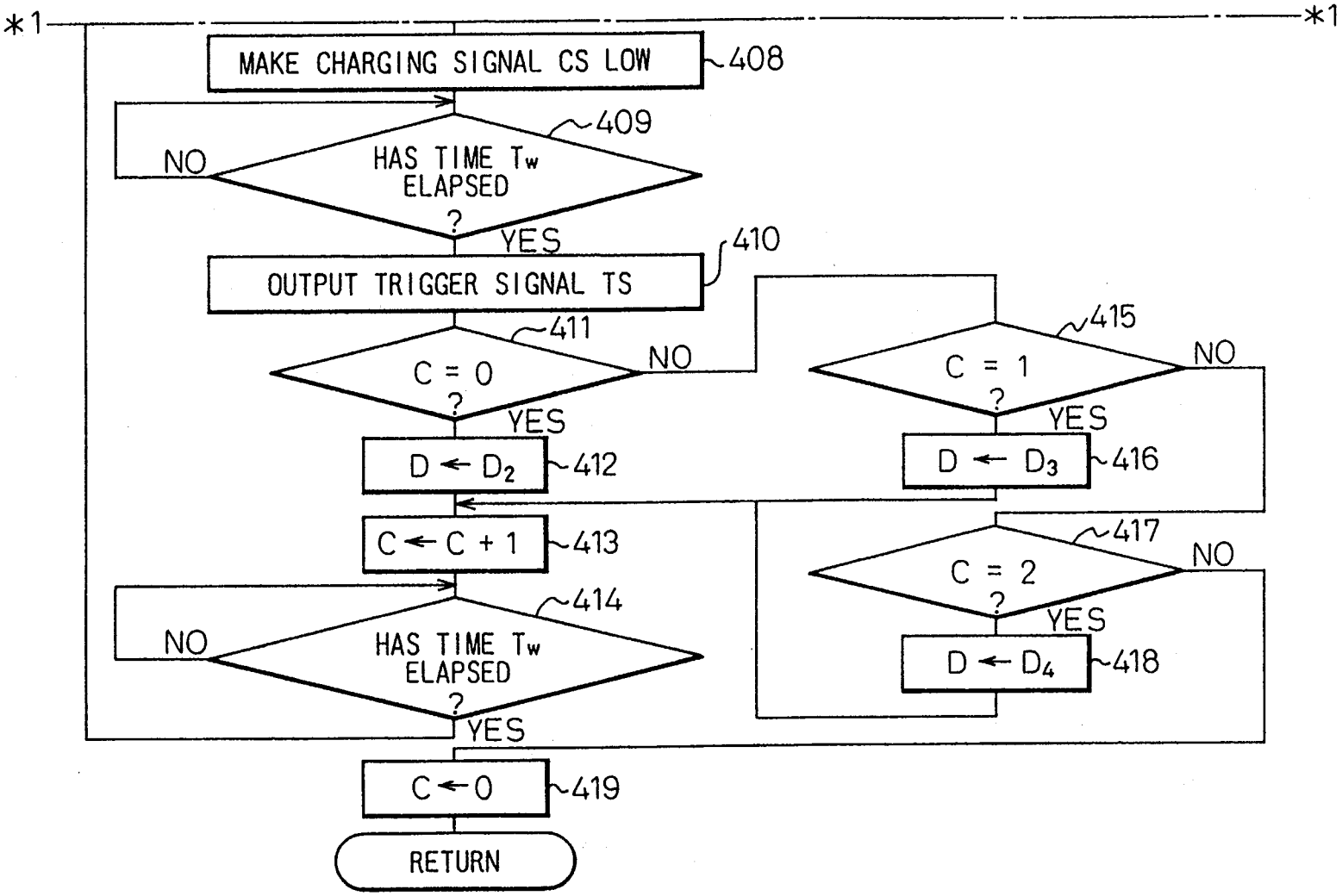

An operational mode of the toner image transferring device as shown in FIGS. 1, 2, and 3 will be now explained with reference to a fixing process control routine shown in FIGS. 4(A) and 4(B) and a time chart shown in FIG. 5. In this operational mode, one-sided recording is applied to the paper. Note, the fixing process control routine of FIGS. 4(A) and 4(B) forms a part of an operation routine of the recording apparatus.

Figure 6:
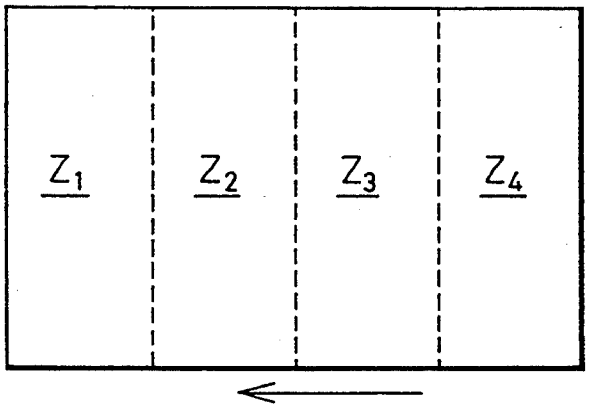
FIG. 6 is a plan view showing a sheet of paper subjected to a toner image fixing process according to the present invention.

At step 401, four total density data $D_1$, $D_2$, $D_3$, and $D_4$, which represent densities of toner images recorded on laterally-quartered zones of a sheet of paper, are calculated on the basis of toner image density data detected by the optical density sensor 39, and are stored in RAM 40c. In FIG. 6, references $Z_1$, $Z_2$, $Z_3$ and $Z_4$ indicate the laterally-quartered zones of the paper, and the respective total density data $D_1$, $D_2$, $D_3$ and $D_4$ represent the densities of the toner images recorded on the zones $Z_1$, $Z_2$, $Z_3$ and $Z_4$. Note, the paper is moved toward the fixing device 26 in a direction indicated by an arrow shown in FIG. 6. The calculation of data $D_1$, $D_2$, $D_3$ and $D_4$ will be explained, hereinafter, in detail with reference to FIGS. 7(A) and 7(B).

At step 402, it is determined whether or not the time $T_O$ (FIG. 5) has elapsed. The time $T_O$ is defined as a time required from when the timing signal is output by the control circuit 40 to drive the electric motor 44 to release the paper from the standby-condition to when the leading edge of the paper reaches a location just below the xenon lamp 26a of the fixing device 26. When the time $T_O$ is elapsed, the routine proceeds to step 403, at which a variable D is caused to be $D_1$. Then, at step 404, the charging signal CS is made high, as shown in FIG. 5, and thus the electric charging of the capacitor 42a by the electric source 42a is initiated.

At step 405, it is determined whether or not the variable D ($D_1$) is larger than a given threshold value $TH_D$. If $D_1 \geqq TH_D$, the routine proceeds to step 406, at which it is determined whether or not the time $T_M$ (FIG. 5) is elapsed. The time $T_M$ is defined as a time measured from when the charging signal CS is made high and required to charge the capacitor 42b to 1,500 volts (FIG. 5). On the other hand, at step 405, if $D_1 < TH_D$, the routine proceeds to step 407, at which it is determined whether or not the time $T_L$ (FIG. 5) is elapsed. The time $T_L$ is defined as a time measured from when the charging signal CS is made high and required to charge the capacitor 42b to 1,700 volts (FIG. 5).

Figure 5:
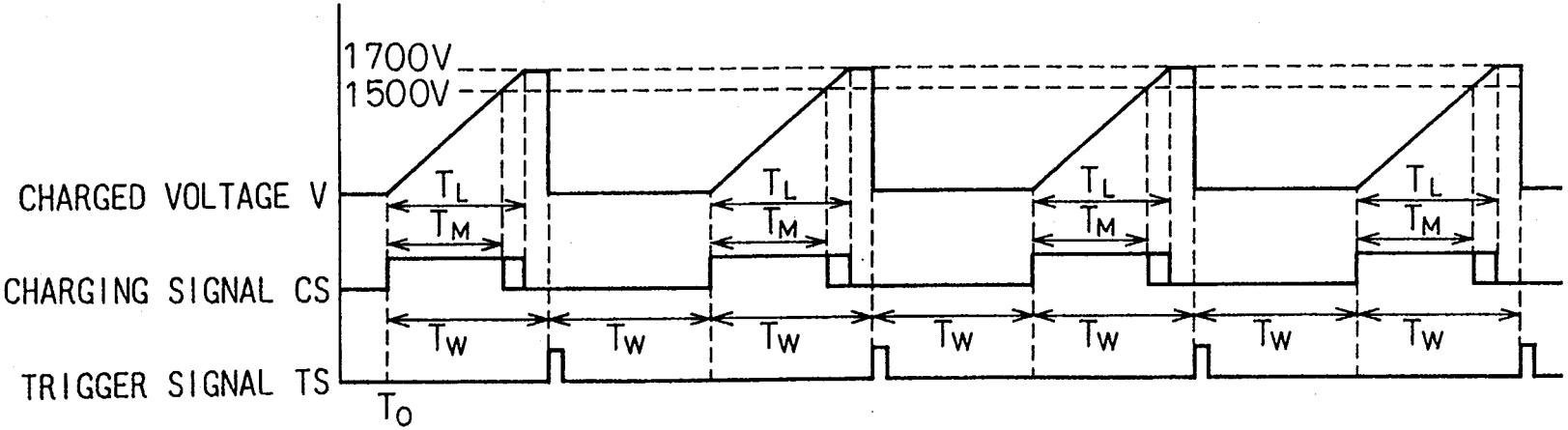
FIG. 5 is a time chart in relation to the flow chart shown in FIGS. 4(A) and 4(B)

When the time $T_M$ has elapsed at step 406 (i.e., the charged voltage of the capacitor 42b is raised to 1,500 volts) or when the time $T_L$ is elapsed at step 407 (i.e., the charged voltage of the capacitor 42b is raised to 1,700 volts), the routine proceeds to step 408, at which the charging signal CS is made low, as shown in FIG. 5, to thereby stop the electric charging of the capacitor 42a.

At step 409, it is determined whether or not the time $T_W$ (FIG. 5) has elapsed. The time $T_W$ is defined as a time measured from when the leading edge of the paper reaches the location just below the xenon lamp 26a until a lateral center line of the zone $Z_1$ reaches that location. When the time $T_W$ has elapsed, the routine proceeds to step 410, at which the trigger signal TS is output from the control circuit 40 to the choke coil 42c, so that a high voltage pulse is output from the choke coil 42c to the xenon lamp 26a, to thereby emit a flash-radiation from the xenon lamp 26a. Namely, the zone $Z_1$ of the paper is exposed to the flash-radiation.

At step 411, it is determined whether or not the contents of a counter C is "0". At this stage, since C="0", the routine proceeds to step 412, at which the variable D is caused to be $D_2$. Then, at step 413, the counter C is incremented by "1", and the routine proceeds to step 414, at which it is determined whether or not the time $T_W$ has elapsed. When the time $T_W$ has elapsed, i.e., when a boundary line between the zones $Z_1$ and $Z_2$ reaches the location just below the xenon lamp 26a, the routine returns to step 404, at which the charging signal CS is made high, as shown in FIG. 5, and thus the electric charging of the capacitor 42a is again initiated by the electric source 42a.

At step 405, it is determined whether or not the variable D ($D_2$) is larger than the threshold value $TH_D$. If $D_2 \geqq TH_D$, the routine proceeds to step 406, at which it is determined whether or not the time $T_M$ (FIG. 5) has elapsed. On the other hand, if $D_2 < TH_D$, the routine proceeds to step 407, at which it is determined whether or not the time $T_L$ (FIG. 5) has elapsed. As is apparent from the foregoing, the capacitor 42b is charged to 1,500 volts when the time $T_M$ has elapsed, and the capacitor 42b is charged to 1,700 volts when the time $T_L$ has elapsed.

When the charged voltage of the capacitor 42b is raised to 1,500 volts or when the charged voltage of the capacitor 42b is raised to 1,700 volts, the routine proceeds to step 408, at which the charging signal CS is made low, as shown in FIG. 5, to thereby stop the electric charging of the capacitor 42a.

At step 409, it is determined whether or not the time $T_W$ (FIG. 5) has elapsed. When the time $T_W$ has elapsed, i.e., when a lateral center line of the zone $Z_2$ of the paper reaches the location just below the xenon lamp 26b, the routine proceeds to step 410, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_2$ of the paper is exposed to flash-radiation.

At step 411, it is determined whether or not the counter C is "0". At this stage, since the counter C is equal to "1", the routine proceeds to step 415, at which it is determined whether or not the counter C is "1". Accordingly, the routine proceeds from step 415 to step 416, at which the variable D is caused to be $D_3$. Then, the routine returns to step 413, at which the counter C is incremented by "1", and the routine proceeds to step 414, at which it is determined whether or not the time $T_W$ has elapsed. When the time $T_W$ has elapsed, i.e., when a boundary line between the zones $Z_2$ and $Z_3$ reaches the location just below the xenon lamp 26a, the routine returns to step 404, at which the charging signal CS is made high, as shown in FIG. 5, and thus the electric charging of the capacitor 42a is again initiated by the electric source 42a.

At step 405, it is determined whether or not the variable D ($D_3$) is larger than the threshold value $TH_D$. If $D_3 \geqq TH_D$, the routine proceeds to step 406, at which it is determined whether or not the time $T_M$ (FIG. 5) has elapsed. On the other hand, if $D_3 < TH_D$, the routine proceeds to step 407, at which it is determined whether or not the time $T_L$ (FIG. 5) has elapsed. As is apparent from the foregoing, the capacitor 42b is charged to 1,500 volts when the time $T_M$ has elapsed, and the capacitor 42b is charged to 1,700 volts when the time $T_L$ has elapsed.

When the charged voltage of the capacitor 42b is raised to 1,500 volts or when the charged voltage of the capacitor 42b is raised to 1,700 volts, the routine proceeds to step 408, at which the charging signal CS is made low, as shown in FIG. 5, to thereby stop the electric charging of the capacitor 42a.

At step 409, it is determined whether or not the time $T_W$ (FIG. 5) has elapsed. When the time $T_W$ has elapsed, i.e., when a lateral center line of the zone $Z_3$ of the paper reaches the location just below the xenon lamp 26b, the routine proceeds to step 410, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_3$ of the paper is exposed to flash-radiation.

At step 411, it is determined whether or not the counter C is "0". At this stage, since the counter C is equal to "2", the routine proceeds from step 411 to step 417 via step 415. At step 417, it is determined whether or not the counter C is "2". Accordingly, the routine proceeds to step 418, at which the variable D is caused to be $D_4$. Then, the routine returns to step 413, at which the counter C is incremented by "1", and the routine proceeds to step 414, at which it is determined whether or not the time $T_W$ has elapsed. When the time $T_W$ has elapsed, i.e., when a boundary line between the zones $Z_3$ and $Z_4$ reaches the location just below the xenon lamp 26a, the routine returns to step 404, at which the charging signal CS is made high, as shown in FIG. 5, and thus the electric charging of the capacitor 42a is again initiated by the electric source 42a.

At step 405, it is determined whether or not the variable D ($D_4$) is larger than the threshold value $TH_D$. If $D_4 \geqq TH_D$, the routine proceeds to step 406, at which it is determined whether or not the time $T_M$ (FIG. 5) has elapsed. On the other hand, if $D_4 < TH_D$, the routine proceeds to step 407, at which it is determined whether or not the time $T_L$ (FIG. 5) has elapsed. As is apparent from the foregoing, the capacitor 42b is charged to 1,500 volts when the time $T_M$ has elapsed, and the capacitor 42b is charged to 1,700 volts when the time $T_L$ has elapsed.

When the charged voltage of the capacitor 42b is raised to 1,500 volts or when the charged voltage of the capacitor 42b is raised to 1,700 volts, the routine proceeds to step 408, at which the charging signal CS is made low, as shown in FIG. 5, to thereby stop the electric charging of the capacitor 42a.

At step 409, it is determined whether or not the time $T_W$ (FIG. 5) has elapsed. When the time $T_W$ has elapsed, i.e., when a lateral center line of the zone $Z_4$ of the paper reaches the location just below the xenon lamp 26b, the routine proceeds to step 410, at which the trigger signal TS is output from the control circuit 40 to the choke coil 42c, so that a high voltage pulse is output from the choke coil 42c to the xenon lamp 26a, to thereby emit a flash-radiation from the xenon lamp 26a. Namely, the zone $Z_4$ of the paper is exposed to the flash-radiation.

At step 411, it is determined whether or not the counter C is "0". At this stage, since the counter C is equal to "3", the routine proceeds from step 411 to step 417 through step 415. At step 417, it is determined whether or not the counter C is "2". Accordingly, the routine proceeds to step 419, at which the counter C is reset, and then the routine returns to the operation routine of the recording apparatus.

When the total image density data ($D_1$, $D_2$, $D_3$, $D_4$) is larger than the threshold value $TH_D$, it may be presumed that the corresponding zone ($Z_1$, $Z_2$, $Z_3$, $Z_4$) of the paper includes, for example, a plurality of character images evenly recorded thereon. Namely, that zone of the paper can be deemed a black zone. According to the operational mode as mentioned above, the black zone of the paper is subjected to the flash-radiation derived from the voltage of 1,500 volts, and the toner images are thermally fused and firmly fixed on the zone of the paper. Namely, the voltage of 1,500 volts is selected so that a part of the fused toner can penetrate into the fibers of the paper.

On the other hand, when the total image density data ($D_1$, $D_2$, $D_3$, $D_4$) is smaller than the threshold value $TH_D$, it may be presumed that the corresponding zone ($Z_1$, $Z_2$, $Z_3$, $Z_4$) of the paper includes a small number of toner images sparsely recorded thereon or no toner image. Namely, that zone of the paper can be deemed a white or blank zone. Nevertheless, according to the above-mentioned operational mode, the white or blank zone of the paper is subjected to the flash-radiation derived from the charged voltage of 1,700 volts. In this case, if there are a small number of toner image on the zone of the paper concerned, of course, these toner images can be firmly fixed thereon, but the flash-radiation derived from the charged voltage of 1,700 volts is actually utilized to raise a temperature of the zone concerned (a white or blank zone), to prevent the paper from being undulated.

As discussed hereinbefore, the temperature of the black zone of the paper becomes higher than that of the white or blank zone thereof, because a large portion of the flash-radiation is absorbed in the black zone, whereas a large portion of the flash-radiation is reflected by the white or blank zone. Accordingly, the moisture in the paper lost from the black zone is larger than that lost from the white or blank zone, so that the black zone of the paper is shrunk more than the white or blank zone thereof, to thereby cause an undulation of the paper.

Nevertheless, according to the above-mentioned operational mode, the white or blank zone is subjected to the flash-radiation having a higher energy than that of the flash-radiation to which the black zone is subjected, and thus the undulation of the paper can be prevented.

Figure 7A:
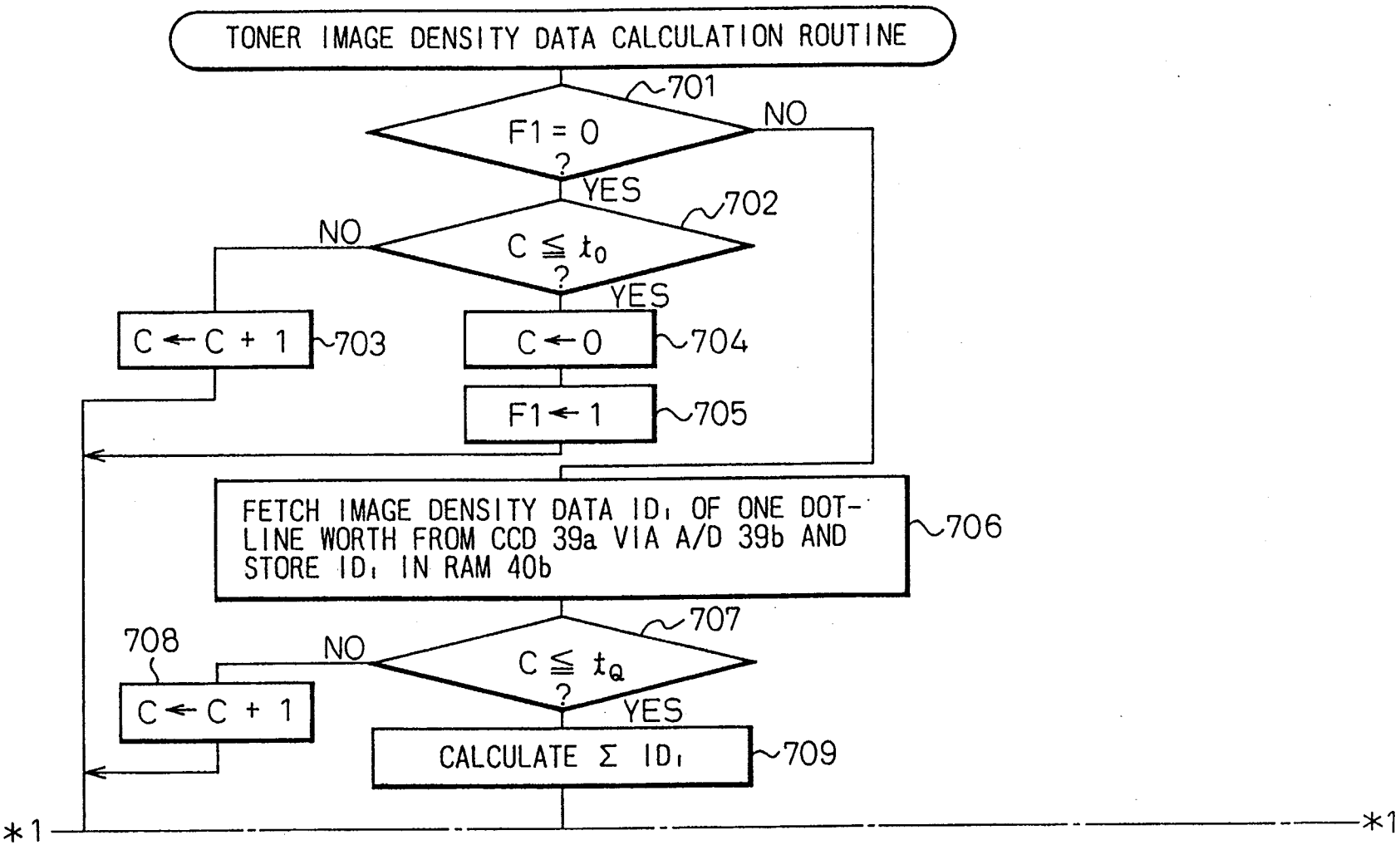
FIGS. 7(A) and 7(B) show a flow chart for calculating toner image density data processed in the flow chart shown in FIGS. 4(A) and 4(B)
Figure 7B:
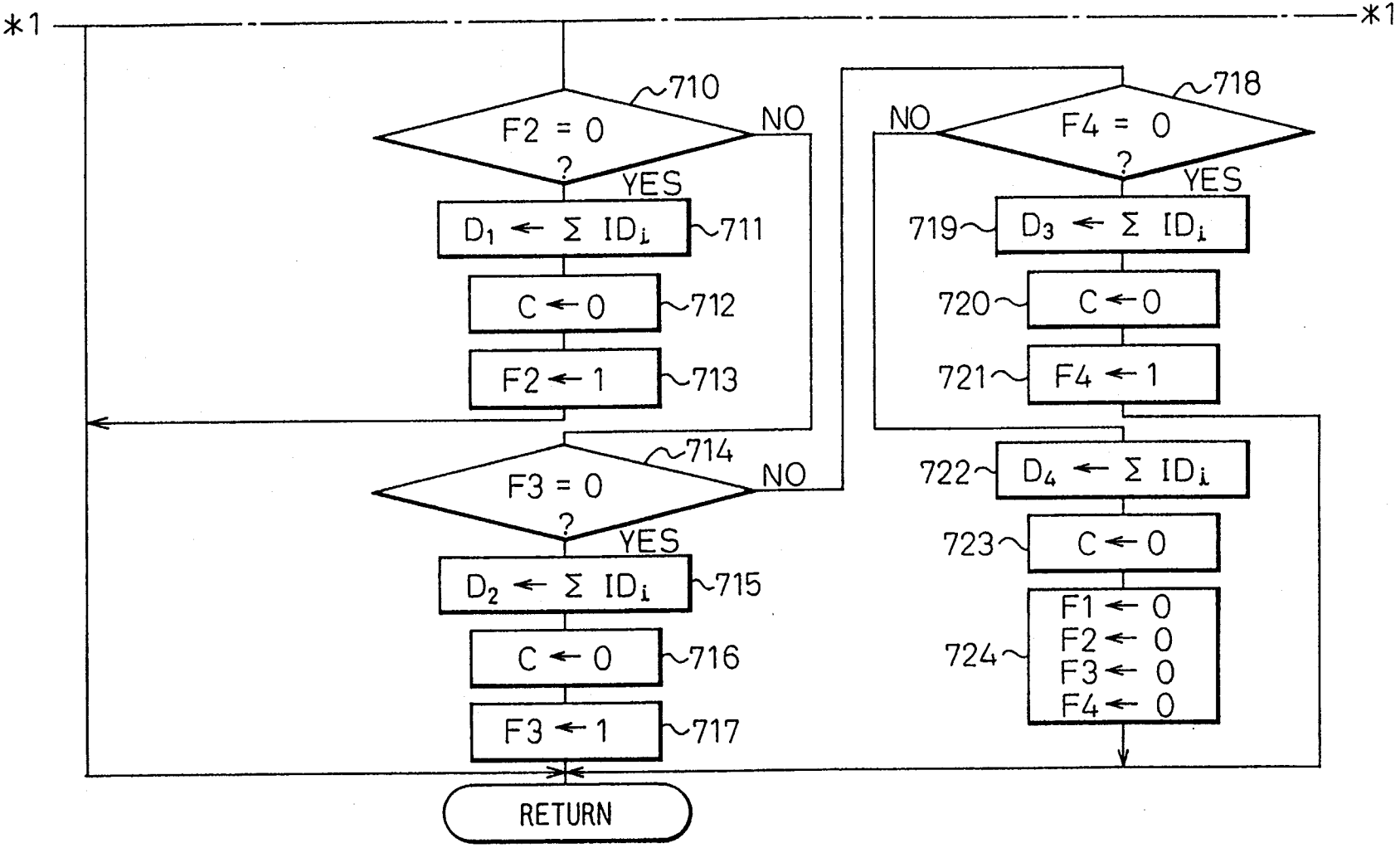

FIGS. 7(A) and 7(B) show a routine for calculating the total toner image density data $D_1$, $D_2$, $D_3$, and $D_4$, and this routine is executed by interruptions output at intervals of, for example, 2 ms.

At step 701, it is determined whether a flag F1 is "0" or "1". At this stage, since F1=0, the routine proceeds to step 702, at which it is determined whether or not a counter C reaches a number $t_0$ which corresponds to a time required from when the timing signal is output by the control circuit 40 to drive the electric motor 44 to release the paper from the standby-condition to when the leading edge of the paper reaches a location at which the optical density sensor 39 is disposed. At this stage, since C=0, the routine proceeds to step 703, at which the counter C is incremented by 1, and then the routine is once completed. The routine is repeatedly executed at intervals of 2 ms, but the counter C is only incremented by 1 until the counter C reaches the number $t_0$.

At step 702, when the counter C reaches the number $t_0$, i.e., when the leading edge of the paper reaches the location of the optical density sensor 39, the routine proceeds to step 704, at which the counter C is reset. At step 705, the flag F1 is made "1", and then the routine is once completed.

When the routine is executed after 2 ms, it proceeds from step 701 to step 706 (F1=1), at which one dot-line worth of image density data $ID_i$ is fetched from the CCD element 39*a* through A/D 39*b*, and the data ID, is stored in RAM 40*b*.

At step 707, it is determined whether or not the counter C reaches a number $t_Q$ which corresponds to a time required to move the boundary line between the zones $Z_1$ and $Z_2$ of the paper to the location of the optical density sensor 39. At this stage, since C=0, the routine proceeds to step 708, at which the counter C is incremented by 1, and then the routine is once completed. The routine is repeatedly executed at intervals of 2 ms, but the counter C is only incremented by 1 until the counter C reaches the number $t_Q$.

At step 707, when the counter C reaches the number $t_Q$, i.e., when the boundary line between the zones $Z_1$ and $Z_2$ of the paper reaches the location of the optical density sensor 39, the routine proceeds to step 709, at which a calculation of $\Sigma ID_i$ is carried out. Then, at step 710, it is determined whether a flag F2 is "0" or "1". At this stage, since F2=0, the routine proceeds to step 711, at which $\Sigma ID_i$ is made $D_1$. Then, at step 712, the counter C is reset, and at step 713, the flag F2 is made "1". Thus, the routine is completed.

When the routine is executed after 2 ms, it again proceeds from step 701 to step 706 (F1=1), at which one dot-line worth of image density data ID, is fetched from the CCD element 39*a* through A/D 39*b*, and the data ID, is stored in RAM 40*b*.

At step 707, it is determined whether or not the counter C reaches the number $t_Q$. At this stage, since C=0, the routine proceeds to step 708, at which the counter C is incremented by 1, and then the routine is completed. The routine is repeatedly executed at intervals of 2 ms, but the counter C is only incremented by 1 until the counter C reaches the number $t_Q$.

At step 707, when the counter C reaches the number $t_Q$, i.e., when the boundary line between the zones $Z_2$ and $Z_3$ of the paper reaches the location of the optical density sensor 39, the routine proceeds to step 709, at which a calculation of $\Sigma ID_i$ is carried out. Then, at step 710, it is determined whether the flag F2 is "0" or "1". At this stage, since F2=1, the routine proceeds from step 710 to step 714, at which it is determined whether a flag F3 is "0" or "1". Since F3 is initially equal to "0", the routine proceeds to step 715, at which $\Sigma ID_i$ is made $D_2$. Then, at step 716, the counter C is reset, and at step 717, the flag F3 is made "1". Thereafter, the routine is once completed.

When the routine is executed after 2 ms, it again proceeds from step 701 to step 706 (F1=1), at which image density data $ID_i$ of one dot-line worth is fetched from the CCD element 39*a* through A/D 39*b*, and the data $ID_i$ is stored in RAM 40*b*.

At step 707, it is determined whether or not the counter C has reached the number $t_Q$. At this stage, since C=0, the routine proceeds to step 708, at which the counter C is incremented by 1, and then the routine is once completed. The routine is repeatedly executed at intervals of 2 ms, but the counter C is only incremented by 1 until the counter C reaches the number $t_Q$.

At step 707, when the counter C reaches the number $t_Q$, i.e., when the boundary line between the zones $Z_3$ tad $Z_4$ of the paper reaches the location of the optical density sensor 39, the routine proceeds to step 709, at which a calculation of $\Sigma ID_i$ is carried out. Then, at step 710, it is determined whether the flag F2 is "0" or "1". At this stage, since F2=1, the routine proceeds from step 710 to step 714, at which it is determined whether a flag F3 is "0" or "1". Also, since F3=1, the routine proceeds from step 714 to step 718, at which it is determined whether the flag F4 is "0" or "1". Since the flag F4 is initially equal to "0", the routine proceeds to step 719, at which $\Sigma ID_i$ is made $D_3$. Then, at step 720, the counter C is reset, and at step 721, the flag F4 is made "1". Thereafter, the routine is once completed.

When the routine is executed after 2 ms, it again proceeds from step 701 to step 706 (F1=1), at which one dot-line worth of image density data $ID_i$ is fetched from the CCD element 39*a* through A/D 39*b*, and the data $ID_i$ is stored in RAM 40*b*.

At step 707, it is determined whether or not the counter C reaches the number $t_Q$. At this stage, since C=0, the routine proceeds to step 708, at which the counter C is incremented by 1, and then the routine is once completed. The routine is repeatedly executed at intervals of 2 ms, but the counter C is only incremented by 1 until the counter C reaches the number $t_Q$.

At step 707, when the counter C reaches the number $t_Q$, i.e., when the trailing line of the paper reaches the location of the optical density sensor 39, the routine proceeds to step 709, at which a calculation of $\Sigma ID_i$ is carried out. Then, at step 710, it is determined whether the flag F2 is "0" or "1". At this stage, since F2=1, the routine proceeds from step 710 to step 714, at which it is determined whether the flag F3 is "0" or "1". Also, since F3=1, the routine proceeds from step 714 to step 718, at which it is determined whether the flag F4 is "0" or "1". Furthermore, since F4=0, the routine proceeds to step 722, at which $\Sigma ID_i$ is made $D_4$. Then, at step 723, the counter C is reset, and at step 724, the flags F1, F2, F3, and F4 are made "0".

Thus, the respective total toner image density data $D_1$, $D_2$, $D_3$, and $D_4$ obtained represent the densities of the toner images recorded on the zones $Z_1$, $Z_2$, $Z_3$, and $Z_4$ of the paper. Note, alternatively, the optical density sensor 39 may be arranged so as to detect a density of a developed toner image held on the photosensitive drum 10.

Figure 8A:
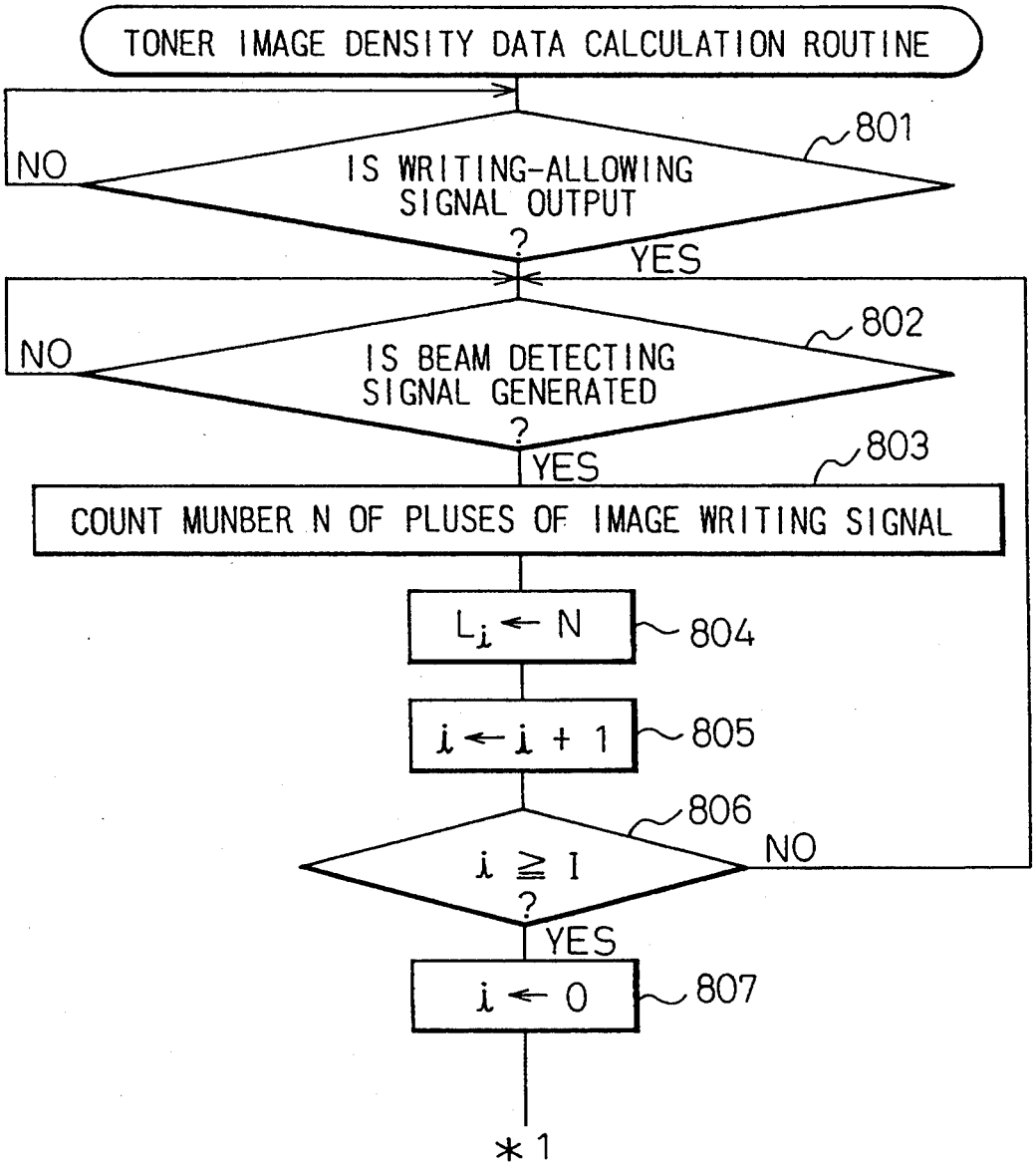
FIGS. 8(A) and 8(B) show another flow chart for calculating the toner image density data processed in the flow chart shown in FIGS. 4(A) and 4(B)
Figure 8B:
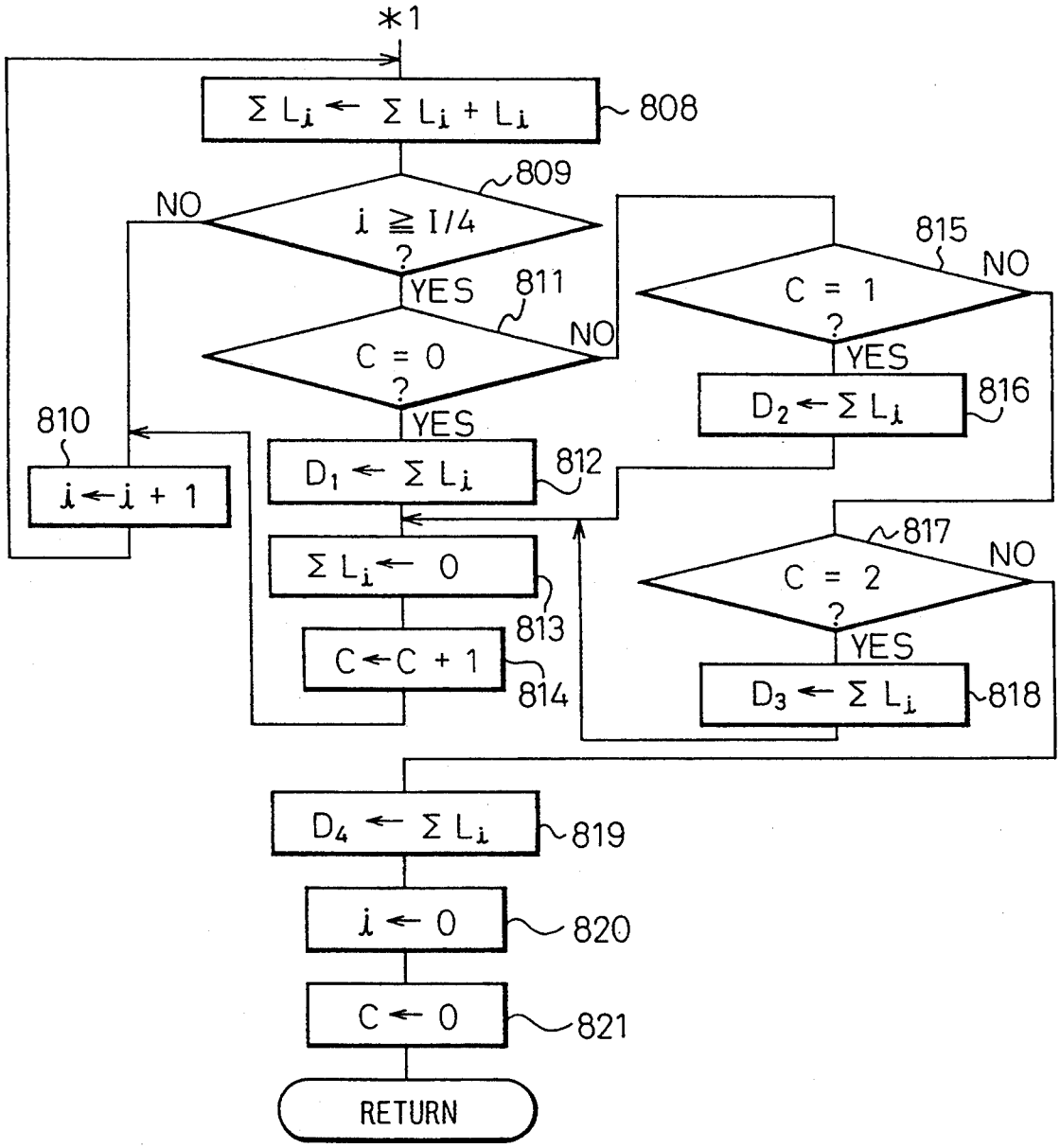

FIGS. 8(A) and 8(B) show another toner image density data calculation routine for calculating the total toner image density data $D_1$, $D_2$, $D_3$, and $D_4$ by counting pulses of image writing signal output to the semiconductor laser device 14*a* of the laser beam scanner 14.

At step 801, it is determined whether or not the writing-allowing signal is output form the host control circuit 48 to the control circuit 40. When the control circuit 40 receives the writing-allowing signal, i.e., when an electrostatic latent image is written on the charged surface of the photosensitive drum 10 on the basis of binary image data obtained from the host apparatus, the routine proceeds to step 2, at which the beam detection signal is generated by the beam sensor 14*b* of the laser beam scanner 14. The writing of one dot-line worth of image is synchronized by the beam detecting signal generated by the beam sensor 14*b*, and a number of dot-images of one dot-line worth is equal to that of pulses of the image writing signal output from the control circuit 40 to the semiconductor laser device 14*a* through I/O 40*d*.

At step 803, a number N of the pulses of the image writing signal is counted, and, then at step 804, a variable $L_i$ is made to be N. The $L_i$ represents a density of dot-images of one dot-line worth. At step 805, a counter i is incremented by "1", and, at step 806, it is determined whether or not the counter i reaches a constant I which corresponds to a total number of dot-lines to be overall recorded on the paper (one page). If $i<I$, the routine returns to step 802. Namely, the routine consisting of steps 802, 803, 804, 805, and 806 is repeated until the counter i reaches the constant I.

At step 806, when $i \geqq I$, i.e., when all of the dot-images are completely written on the drum surface, the routine proceeds to step 807, at which the counter i is reset. At step 808, the following calculation is carried out:

$$\Sigma L_i \rightarrow \Sigma L_i + 1$$

Then, at step 809, it is determined whether or not the counter i reaches the constant I/4 which corresponds to the number of dot-lines to be recorded on each of the quartered zones ($Z_1$, $Z_2$, $Z_3$, $Z_4$) of the paper. If $i<I/4$, the routine proceeds to step 810. Namely, the routine consisting of steps 808, 809, and 810 is repeated until the counter i reaches the constant I/4.

At step 809, when $i \geqq I/4$, the routine proceeds to step 811, at which it is determined whether or not a counter C is "0". At this stage, since C=0, the routine proceeds to step 812, at which the variable $D_1$ is made to $\Sigma L_i$ which represents the density of toner image to be recorded on the zone $Z_1$ of the paper.

At step 813, the variable $\Sigma L_i$ is reset, and, at step 814, the counter C is incremented by "1". Then, the routine returns to step 810, at which the counter i is incremented by "1". Thereafter, the routine consisting of step 808, 809, and 810 is repeated until the counter i reaches the constant I/4.

At step 809, when $i \geqq I/4$, the routine proceeds to step 811, at which it is determined whether or not the counter C is "0". At this stage, since C=1, the routine proceeds to step 815, at which it is determined whether or not the counter C is "1". Accordingly, the routine proceeds to step 816, at which the variable $D_2$ is made to $\Sigma L_i$ which represents the density of toner image to be recorded on the zone $Z_2$ of the paper.

Then, the routine returns to step 813, at which the variable $\Sigma L_i$ is reset, and, at step 814, the counter C is incremented by "1". The routine further returns to step 810, at which the counter i is incremented by "1". Thereafter, the routine consisting of step 808, 809, and 810 is repeated until the counter i reaches the constant I/4.

At step 809, when $i \geqq I/4$, the routine proceeds to step 811, at which it is determined whether or not the counter C is "0". At this stage, since C=2, the routine proceeds from step 811 to step 817 through step 815. At step 817, it is determined whether or not the counter C is "2". Accordingly, the routine proceeds to step 818, at which the variable $D_3$ is made to $\Sigma L_i$ which represents the density of toner image to be recorded on the zone $Z_3$ of the paper.

Then, the routine returns to step 813, at which the variable $\Sigma L_i$ is reset, and, at step 814, the counter C is incremented by "1". The routine further returns to step 810, at which the counter i is incremented by "1". Thereafter, the routine consisting of step 808, 809, and 810 is repeated until the counter i reaches the constant I/4.

At step 809, when $i \geqq I/4$, the routine proceeds to step 811, at which it is determined whether or not the counter C is "0". At this stage, since C=3, the routine proceeds from step 811 to step 819 through steps 815 and 817. At step 819, the variable $D_4$ is made to $\Sigma L_i$ which represents the density of toner image to be recorded on the zone $Z_4$ of the paper. Then, at step 820, the counter i is reset, and, at step 812, the counter C is reset.

Note, when the toner image density data calculation routine of FIGS. 8(A) and 8(B) is used, the optical density sensor 39 is, of course, unnecessary.

Figure 9A:
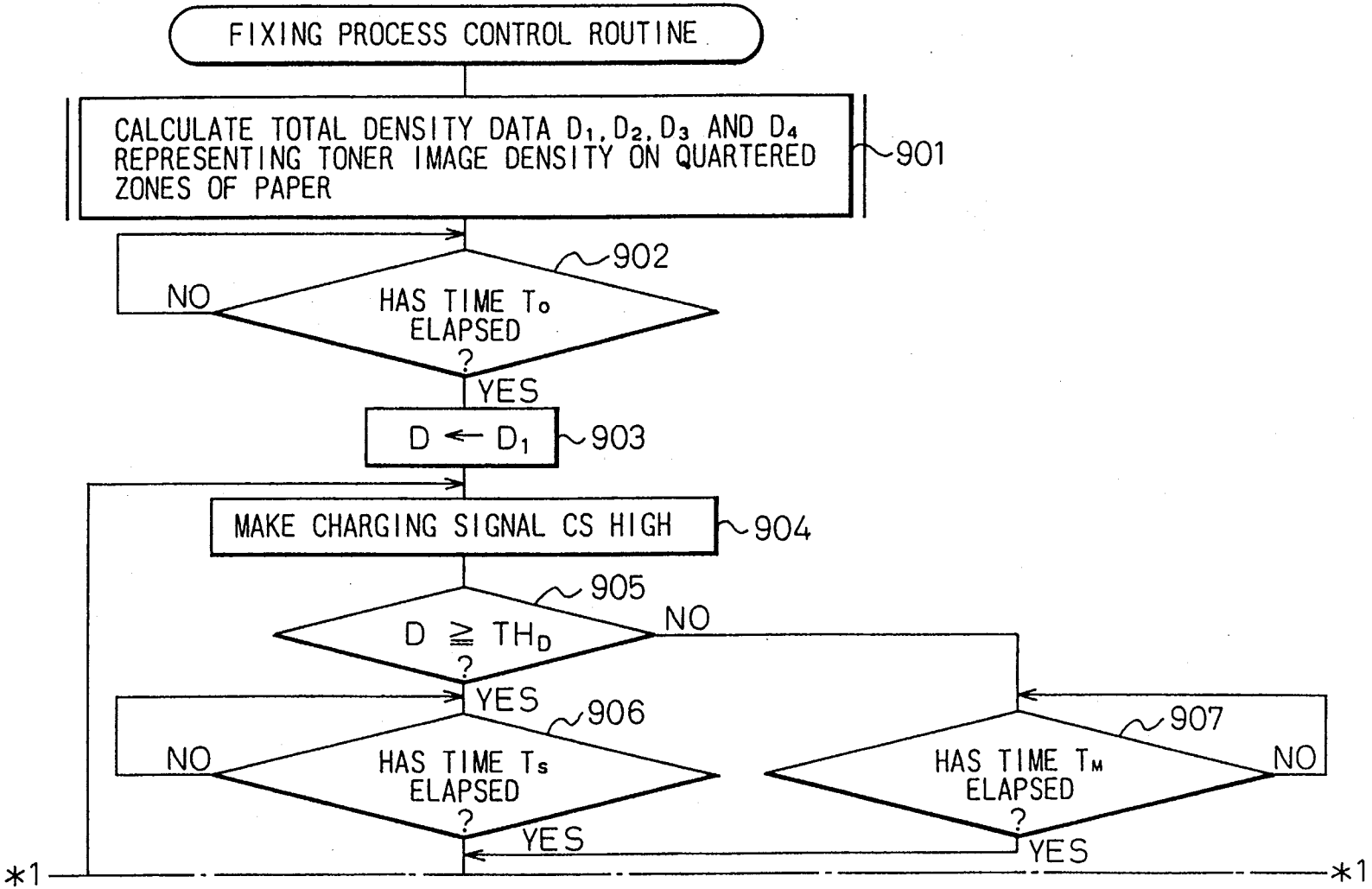
FIGS. 9(A), 9(B), and 9(C) show a flow chart for explaining another operational mode of the toner image fixing device shown in FIGS. 3(A) and 3(B)
Figure 9B:
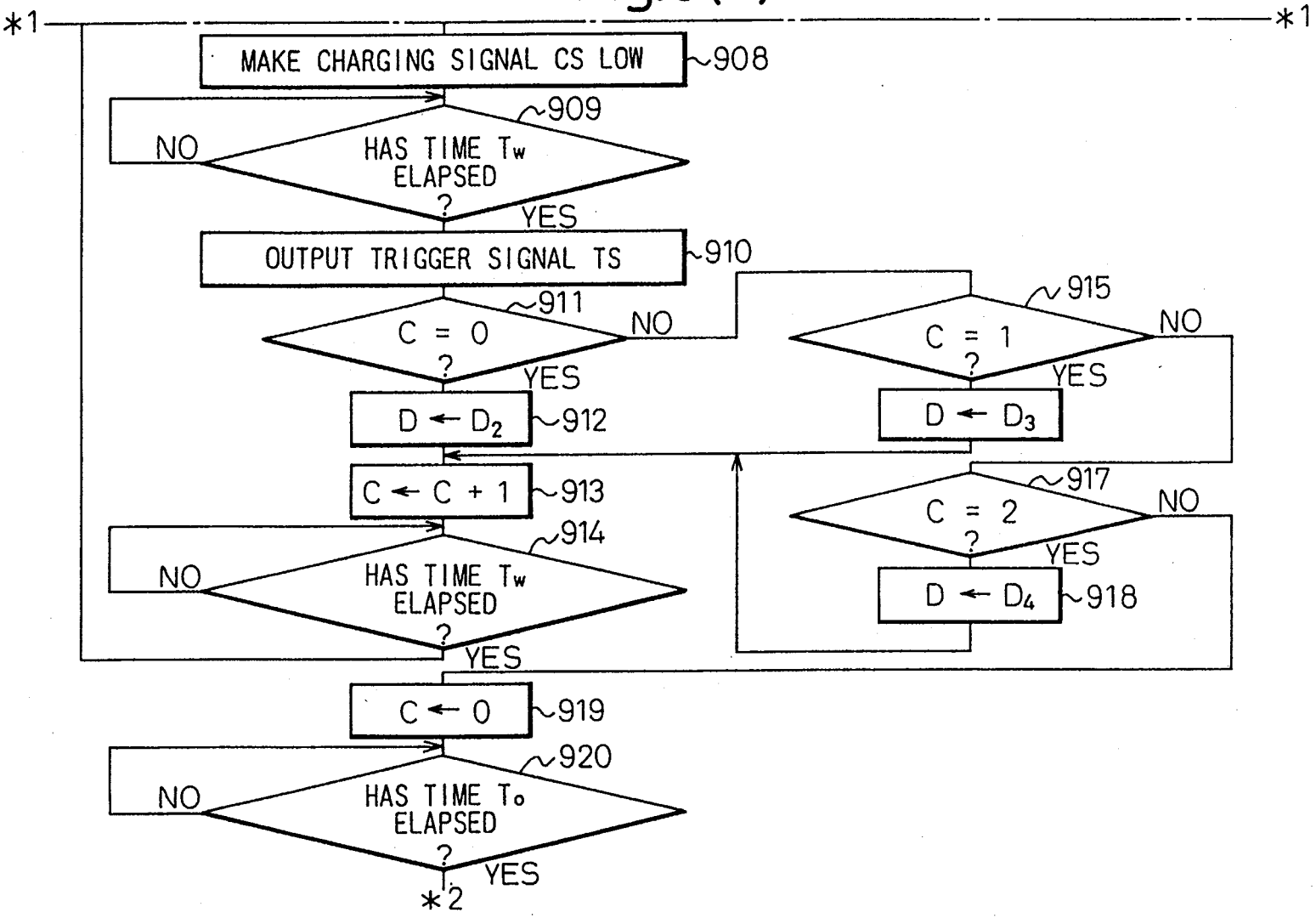
Figure 9C:
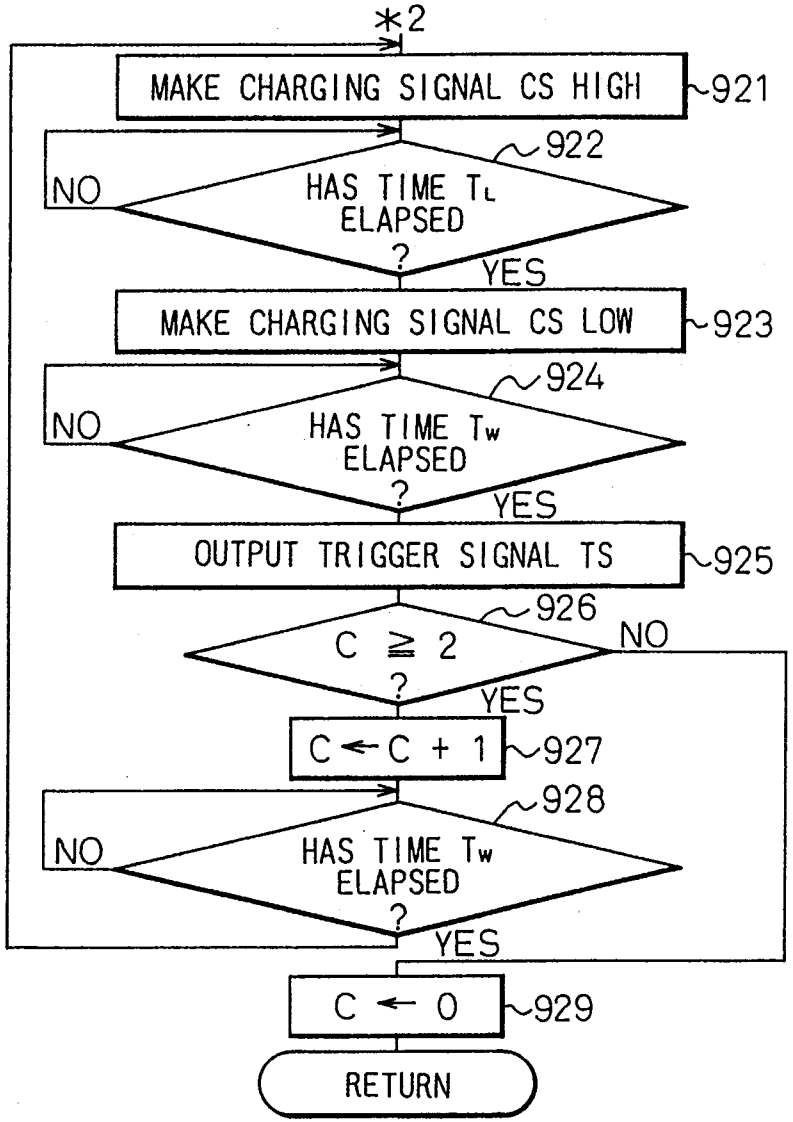

Another operational mode of the toner image transferring device as shown in FIGS. 1, 2, and 3 will be now explained with reference to a fixing process control routine shown in FIGS. 9(A), 9(B) and 9(C) and a time chart shown in FIG. 10. In this operational mode, a two-sided recording is applied to a paper.

At step 901, four total density data $D_1$, $D_2$, $D_3$ and $D_4$, which represent densities of toner images recorded on the laterally-quartered zones $Z_1$, $Z_2$, $Z_3$ and $Z_4$ of a sheet of paper, are calculated in the manner explained with reference to either the routine of FIGS. 7(A) and 7(B) or the routine of FIGS. 8(A) and 8(B).

At step 902, it is determined whether or not the time $T_O$ (FIG. 10) has elapsed. The time $T_O$ is defined as the time required from when the timing signal is output by the control circuit 40 to drive the electric motor 44 to release the paper from the standby-condition to when the leading edge of the paper reaches a location just below the xenon lamp 26*a* of the fixing device 26. When the time $T_O$ has elapsed, the routine proceeds to step 903, at which a variable D is caused to be $D_1$. Then, at step 904, the charging signal CS is made high, as shown in FIG. 10, and thus the electric charging of the capacitor 42*a* is initiated by the electric source 42*a*.

At step 905, it is determined whether or not the variable D ($D_1$) is larger than a given threshold value $TH_D$. If $D_1 \geqq TH_D$, the routine proceeds to step 906, at which it is determined whether or not the time $T_S$ (FIG. 10) has elapsed. The time $T_S$ is defined as the time measured from when the charging signal CS is made high until the capacitor 42*b* is charged to 1,000 volts (FIG. 10). On the other hand, at step 905, if $D_1 < TH_D$, the routine proceeds to step 907, at which it is determined whether or not the time $T_M$ (FIG. 10) has elapsed. The time $T_M$ is defined as the time from when the charging signal CS is made high until the capacitor 42*b* is charged to 1,500 volts (FIG. 10).

Figure 10:
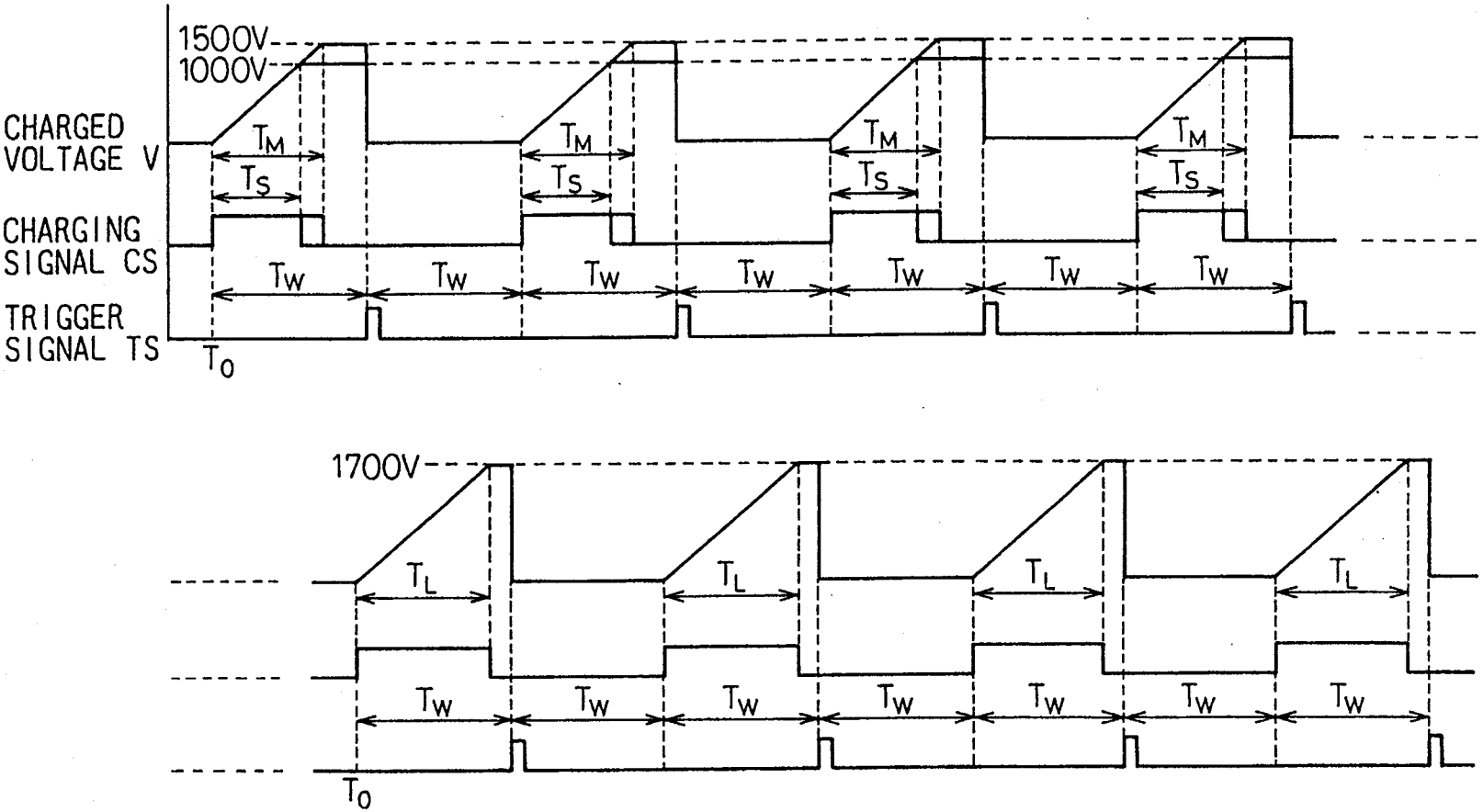
FIG. 10 is a time chart in relation to the flow chart shown in FIGS. 9(A), 9(B), and 9(C)

When the time $T_S$ has elapsed at step 906 (i.e., the charged voltage of the capacitor 42*b* is raised to 1,000 volts) or when the time $T_M$ has elapsed at step 907 (i.e., the charged voltage of the capacitor 42*b* is raised to 1,500 volts), the routine proceeds to step 908, at which the charging signal CS is made low, as shown in FIG. 10, to thereby stop the electric charging of the capacitor 42*a*.

At step 909, it is determined whether or not the time $T_W$ (FIG. 10) has elapsed. The time $T_W$ is defined as the time from when the leading edge of the paper reaches the location just below the xenon lamp 26*a* until the lateral center line of the zone $Z_1$ reaches that location. When the time $T_W$ has elapsed, the routine proceeds to step 910, at which the trigger signal TS is output from the control circuit 40 to the choke coil 42*c*, so that a high voltage pulse is output from the choke coil 42*c* to the xenon lamp 26*a*, to thereby emit a flash-radiation from the xenon lamp 26*a*. Namely, the zone $Z_1$ of the paper is exposed to flash-radiation.

At step 911, it is determined whether or not a counter C is "0". At this stage, since C="0" the routine proceeds to step 912, at which the variable D is caused to be $D_2$. Then, at step 913, the counter C is incremented by "1", and the routine proceeds to step 914, at which it is determined whether or not the time $T_W$ has elapsed. When the time $T_W$ has elapsed, i.e., when a boundary line between the zones $Z_1$ and $Z_2$ reaches the location just below the xenon lamp 26*a*, the routine returns to step 904, at which the charging signal CS is made high, as shown in FIG. 10, and thus the electric charging of the capacitor 42*a* is again initiated by the electric source 42*a*.

At step 905, it is determined whether or not the variable D ($D_2$) is larger than the threshold value $TH_D$. If $D_2 \geqq TH_D$, the routine proceeds to step 906, at which it is determined whether or not the time $T_S$ (FIG. 10) has elapsed. On the other hand, if $D_2 < TH_D$, the routine proceeds to step 907, at which it is determined whether or not the time $T_M$ (FIG. 10) has elapsed. As is apparent from the foregoing, the capacitor 42*b* is charged to 1,000 volts when the time $T_S$ has elapsed, and the capacitor 42*b* is charged to 1,500 volts when the time $T_M$ has elapsed.

When the charged voltage of the capacitor 42*b* is raised to 1,000 volts or when the charged voltage of the capacitor 42*b* is raised to 1,500 volts, the routine proceeds to step 908, at which the charging signal CS is made low, as shown in FIG. 10, to thereby stop the electric charging of the capacitor 42*a*.

At step 909, it is determined whether or not the time $T_W$ (FIG. 10) has elapsed. When the time $T_W$ has elapsed, i.e., when a lateral center line of the zone $Z_2$ of the paper reaches the location just below the xenon lamp 26*b*, the routine proceeds to step 910, at which the trigger signal TS is output from the control circuit 40 to the choke coil 42*c*, so that a high voltage pulse is output from the choke coil 42*c* to the xenon lamp 26*a*, to thereby emit a flash-radiation from the xenon lamp 26*a*. Namely, the zone $Z_2$ of the paper is exposed to flash-radiation.

At step 911, it is determined whether or not the counter C is "0". At this stage, since the counter C is equal to "1", the routine proceeds to step 915, at which it is determined whether or not the counter C is "1". Accordingly, the routine proceeds from step 915 to step 916, at which the variable D is caused to be $D_3$. Then, the routine returns to step 913, at which the counter C is incremented by "1", and the routine proceeds to step 914, at which it is determined whether or not the time $T_W$ has elapsed. When the time $T_W$ has elapsed, i.e., when a boundary line between the zones $Z_2$ and $Z_3$ reaches the location just below the xenon lamp 26*a*, the routine returns to step 904, at which the charging signal CS is made high, as shown in FIG. 10, and thus the electric charging of the capacitor 42*a* is again initiated by the electric source 42*a*.

At step 905, it is determined whether or not the variable D ($D_3$) is larger than the threshold value $TH_D$. If $D_3 \geqq TH_D$, the routine proceeds to step 906, at which it is determined whether or not the time $T_S$ (FIG. 10) has elapsed. On the other hand, if $D_3 < TH_D$, the routine proceeds to step 907, at which it is determined whether or not the time $T_S$ (FIG. 10) has elapsed. Namely, the capacitor 42*b* is charged to 1,000 volts when the time $T_S$ has elapsed, and the capacitor 42*b* is charged to 1,500 volts when the time $T_M$ has elapsed.

When the charged voltage of the capacitor 42*b* is raised to 1,000 volts or when the charged voltage of the capacitor 42*b* is raised to 1,500 volts, the routine proceeds to step 908, at which the charging signal CS is made low, as shown in FIG. 10, to thereby stop the electric charging of the capacitor 42*a*.

At step 909, it is determined whether or not the time $T_W$ (FIG. 10) has elapsed. When the time. $T_W$ has elapsed, i.e., when a lateral center line of the zone $Z_3$ of the paper reaches the location just below the xenon lamp 26b, the routine proceeds to step 910, at which the trigger signal TS is output from the control circuit 40 to the choke coil 42c, so that a high voltage pulse is output from the choke coil 42c to the xenon lamp 26a, to thereby emit a flash-radiation from the xenon lamp 26a. Namely, the zone $Z_3$ of the paper is exposed to flash-radiation.

At step 911, it is determined whether or not the counter C is "0". At this stage, since the counter C is equal to "2", the routine proceeds from step 911 to step 917 through step 915. At step 917, it is determined whether or not the counter C is "2". Accordingly, the routine proceeds to step 918, at which the variable D is caused to be $D_4$. Then, the routine returns to step 913, at which the counter C is incremented by "1", and the routine proceeds to step 914, at which it is determined whether or not the time $T_W$ has elapsed. When the time $T_W$ has elapsed, i.e., when a boundary line between the zones $Z_3$ and $Z_4$ reaches the location just below the xenon lamp 26a, the routine returns to step 904, at which the charging signal CS is made high, as shown in FIG. 10, and thus the electric charging of the capacitor 42a is again initiated by the electric source 42a.

At step 905, it is determined whether or not the variable D ($D_4$) is larger than the threshold value $TH_D$. If $D_4 \geqq TH_D$, the routine proceeds to step 906, at which it is determined whether or not the time $T_S$ (FIG. 10) has elapsed. On the other hand, if $D_4 < TH_D$, the routine proceeds to step 907, at which it is determined whether or not the time $T_M$ (FIG. 10) has elapsed. The capacitor 42b is charged to 1,000 volts when the time $T_S$ has elapsed, and the capacitor 42b is charged to 1,500 volts when the time $T_M$ has elapsed.

When the charged voltage of the capacitor 42b is raised to 1,000 volts or when the charged voltage of the capacitor 42b is raised to 1,500 volts, the routine proceeds to step 908, at which the charging signal CS is made low, as shown in FIG. 10, to thereby stop the electric charging of the capacitor 42a.

At step 909, it is determined whether or not the time $T_W$ (FIG. 10) has elapsed. When the time $T_W$ has elapsed, i.e., when the lateral center line of the zone $Z_4$ of the paper reaches the location just below the xenon lamp 26b, the routine proceeds to step 910, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_4$ of the paper is exposed to flash-radiation.

At step 911, it is determined whether or not the counter C is "0". At this stage, since the counter C is equal to "3", the routine proceeds from step 911 to step 917 through step 915. At step 917, it is determined whether or not the counter C is "2". Accordingly, the routine proceeds to step 919, at which the counter C is reset. Thus, the one-sided recording of the paper is completed, and this paper is introduced from the paper eject passageway EP into the paper bypass passageway BP by the paper switching rollers 32 for two-sided recording.

As is already stated, when the total image density data ($D_1$, $D_2$, $D_3$, $D_4$) is larger than the threshold value $TH_D$, that zone of the paper can be deemed a black zone. On the other hand, when the total image density data ($D_1$, $D_2$, $D_3$, $D_4$) is smaller than the threshold value $TH_D$, that zone of the paper can be deemed a white or blank zone. According to the operational mode of FIGS. 9(A), 9(B) and 9(C), the black zone of the paper is subjected to the flash-radiation derived from the voltage of 1,000 volts, whereas the white or blank zone of the paper is subjected to the flash-radiation derived from the charged voltage of 1,500 volts. Thus, the paper can be prevented from being undulated.

At step 920, it is determined whether or not the time $T_O$ (FIG. 10) has elapsed. When the time $T_O$ has elapsed, i.e., when the leading edge of the reversed paper subjected to the two-sided recording reaches the location just below the xenon lamp 26a of the fixing device 26, the routine proceeds to step 921, at which the charging signal CS is made high, as shown in FIG. 10, and thus the electric charging of the capacitor 42a is initiated by the electric source 42a.

At step 922, it is determined whether or not the time $T_L$ (FIG. 10) has elapsed. The time $T_L$ is defined as a time from when the charging signal CS is made high until the capacitor 42b is charged to 1,700 volts (FIG. 10). When the time $T_L$ has elapsed at step 922, i.e., when the capacitor 42b is charged to 1,700 volts, the routine proceeds to step 923, at which the charging signal CS is made low, as shown in FIG. 10, to thereby stop the electric charging of the capacitor 42a.

At step 924, it is determined whether or not the time $T_W$ (FIG. 10) has elapsed. When the time $T_W$ has elapsed, i.e., when the lateral center line of the first zone (corresponding to the zone $Z_1$) of the reversed paper reaches the location just below the xenon lamp 26a, the routine proceeds to step 925, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the first zone ($Z_1$) of the reversed paper is exposed to flash-radiation.

At step 926, it is determined whether or not a counter C is "2". At this stage, since C="0", the routine proceeds to step 927, at which the counter C is incremented by "1", and the routine proceeds to step 928, at which it is determined whether or not the time $T_W$ has elapsed. When the time $T_W$ has elapsed, i.e., when a boundary line between the first zone ($Z_1$) and the second zone ($Z_2$) of the reversed paper reaches the location just below the xenon lamp 26a, the routine returns to step 921, at which the charging signal CS is made high, as shown in FIG. 10, and thus the electric charging of the capacitor 42a is again initiated by the electric source 42a.

At step 922, it is determined whether or not the time $T_L$ (FIG. 10) has elapsed. When the time $T_L$ has elapsed at step 922, i.e., when the capacitor 42b is charged to 1,700 volts, the routine proceeds to step 923, at which the charging signal CS is made low, as shown in FIG. 10, to thereby stop the electric charging of the capacitor 42a.

At step 924, it is determined whether or not the time $T_W$ (FIG. 10) has elapsed. When the time $T_W$ has elapsed, i.e., when a lateral center line of the second zone ($Z_2$) of the reversed paper reaches the location just below the xenon lamp 26a, the routine proceeds to step 925, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the second zone ($Z_2$) of the reversed paper is exposed to flash-radiation.

At step 926, it is determined whether or not a counter C is "2". At this stage, since C="1", the routine proceeds to step 927, at which the counter C is incremented by "1", and the routine proceeds to step 928, at which it is determined whether or not the time $T_W$ has elapsed. When the time $T_W$ has elapsed, i.e., when a boundary line between the second zone ($Z_2$) and the third zone ($Z_3$) of the reversed paper reaches the location just below the xenon lamp 26a, the routine returns to step 921, at which the charging signal CS is made high, as shown in FIG. 10, and thus the electric charging of the capacitor 42a is again initiated by the electric source 42a.

At step 922, it is determined whether or not the time $T_L$ (FIG. 10) has elapsed. When the time $T_L$ has elapsed at step 922, i.e., when the capacitor 42b is charged to 1,700 volts, the routine proceeds to step 923, at which the charging signal CS is made low, as shown in FIG. 10, to thereby stop the electric charging of the capacitor 42a.

At step 924, it is determined whether or not the time $T_W$ (FIG. 10) has elapsed. When the time $T_W$ has elapsed, i.e., when a lateral center line of the third zone ($Z_3$) of the reversed paper reaches the location just below the xenon lamp 26a, the routine proceeds to step 925, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the third zone ($Z_3$) of the reversed paper is exposed to flash-radiation.

At step 926, it is determined whether or not a counter C is "2". At this stage, since C="2", the routine proceeds to step 927, at which the counter C is incremented by "1", and the routine proceeds to step 928, at which it is determined whether or not the time $T_W$ has elapsed. When the time $T_W$ has elapsed, i.e., when a boundary line between the third zone ($Z_3$) and the fourth zone ($Z_4$) of the reversed paper reaches the location just below the xenon lamp 26a, the routine returns to step 921, at which the charging signal CS is made high, as shown in FIG. 10, and thus the electric charging of the capacitor 42a is again initiated by the electric source 42a.

At step 922, it is determined whether or not the time $T_L$ (FIG. 10) has elapsed. When the time $T_L$ has elapsed at step 922, i.e., when the capacitor 42b is charged to 1,700 volts, the routine proceeds to step 923, at which the charging signal CS is made low, as shown in FIG. 10, to thereby stop the electric charging of the capacitor 42a.

At step 924, it is determined whether or not the time $T_W$ (FIG. 10) has elapsed. When the time $T_W$ has elapsed, i.e., when a lateral center line of the fourth zone ($Z_4$) of the reversed paper reaches the location just below the xenon lamp 26a, the routine proceeds to step 925, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the fourth zone ($Z_4$) of the reversed paper is exposed to flash-radiation.

At step 926, it is determined whether or not a counter C is "2". At this stage, since C="3", the routine proceeds to step 929, at which the counter C is reset.

As mentioned above, in the operational mode shown in FIGS. 9(A), 9(B) and 9(C), when one-sided recording is applied to the paper, a black zone of the paper is subjected to the flash-radiation derived from the voltage of 1,000 volts, whereas the white or blank zone of the paper is subjected to the flash-radiation derived from the charged voltage of 1,500 volts, whereby undulation of the paper can be prevented. Nevertheless, the toner image of the black zone of the paper cannot be sufficiently fixed thereon, because it is subjected to the flash-radiation derived from the low level voltage (1,000 volts). In particular, the toner image is thermally fused, but a part of the fused toner cannot penetrate into the fibers of the paper. Accordingly, when the fixed toner image is strongly rubbed with, for example, a finger's nail, it may be removed from the paper. However, this incomplete fixing of the toner image is resolved when the second toner image fixing process is carried out for the two-sided recording. Namely, in the second toner image fixing process, since all of the zones of the reversed paper are subjected to the flash-radiation derived from the high level voltage (1,700 volts), that incomplete fixing of the toner image is resolved.

Yet another operational mode of the toner image transferring device as shown in FIGS. 1, 2, and 3 will be now explained with reference to a fixing process control routine shown in FIGS. 11(A) and 11(B) and a time chart shown in FIG. 12. In this operational mode, two-sided recording is applied to a paper.

At step 1101, it is determined whether or not the time $T_O$ (FIG. 12) has elapsed. The time $T_O$ is defined as the time from when the timing signal is output by the control circuit 40 to drive the electric motor 44 to release the paper from the standby-condition to when the leading edge of the paper reaches a location just below the xenon lamp 26a of the fixing device 26. When the time $T_O$ has elapsed, the routine proceeds to step 1102, at which the charging signal CS is made high, as shown in FIG. 12, and thus the electric charging of the capacitor 42a is initiated by the electric source 42a.

At step 1103, it is determined whether or not a counter C exceeds "2". At this stage, since C="0", the routine proceeds to step 1104, at which it is determined whether or not the time $T_M$ (FIG. 12) has elapsed. The time $T_M$ is defined as the time from when the charging signal CS is made high until the capacitor 42b is charged to 1,500 volts (FIG. 12).

Figure 12:
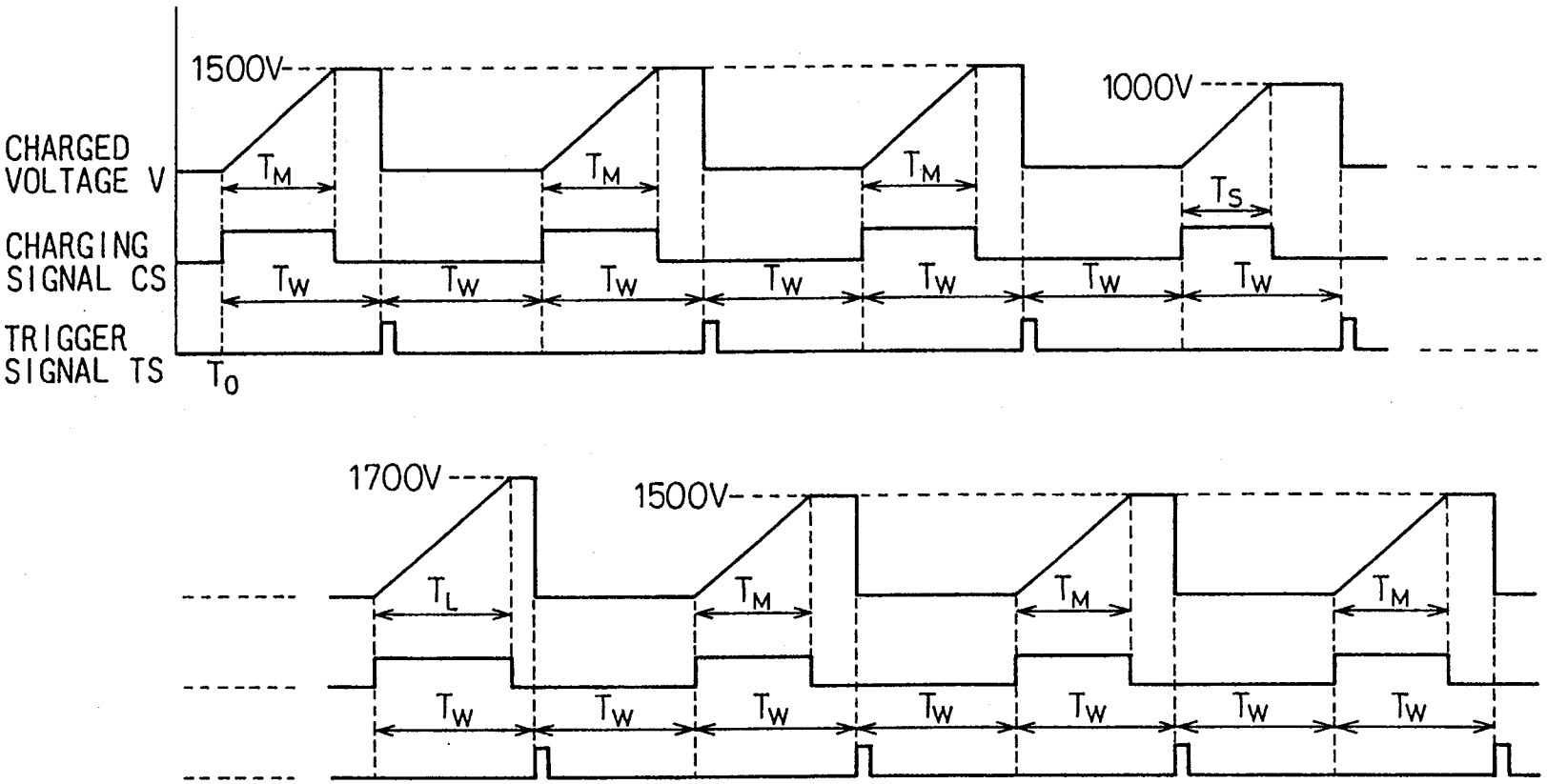
FIG. 12 is a time chart in relation to the flow chart shown in FIGS. 11(A) and 11(B)

When the time $T_M$ has elapsed at step 1104, i.e., the capacitor 42b is charged to 1,500 volts, the routine proceeds to step 1105, at which the charging signal CS is made low, as shown in FIG. 12, to thereby stop the electric charging of the capacitor 42a.

At step 1106, it is determined whether or not the time $T_W$ (FIG. 12) has elapsed. The time $T_W$ is defined as the time from when the leading edge of the paper reaches the location just below the xenon lamp 26a until the lateral center line of the zone $Z_1$ is moved to that location. When the time $T_W$ has elapsed, the routine proceeds to step 1107, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_1$ of the paper is exposed to flash-radiation derived from the voltage of 1,500 volts.

At step 1108, it is determined whether or not the time $T_W$ has elapsed. When the time $T_W$ has elapsed, i.e., when a boundary line between the zones $Z_1$ and $Z_2$ has reached the location just below the xenon lamp 26a, the routine proceeds to step 1109, at which the counter C is incremented by "1", and then the routine returns to step 1102, at which the charging signal CS is made high, as shown in FIG. 12, and thus the electric charging of the capacitor 42a is initiated by the electric source 42a.

At step 1103, it is determined whether or not the counter C exceeds "2". At this stage, since C="1", the routine proceeds to step 1104, at which it is determined whether or not the time $T_M$ (FIG. 12) has elapsed. When the time $T_M$ has elapsed at step 1104, i.e., when the capacitor 42b is charged to 1,500 volts, the routine proceeds to step 1105, at which the charging signal CS is made low, as shown in FIG. 12, to thereby stop the electric charging of the capacitor 42a.

At step 1106, it is determined whether or not the time $T_W$ (FIG. 12) has elapsed. When the time $T_W$ has elapsed, i.e., when a lateral center line of the zone $Z_2$ of the paper reaches the location just below the xenon lamp 26a, the routine proceeds to step 1107, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_2$ of the paper is exposed to flash-radiation derived from the voltage of 1,500 volts.

At step 1108, it is determined whether or not the time $T_W$ has elapsed. When the time $T_W$ has elapsed, i.e., when a boundary line between the zones $Z_2$ and $Z_3$ reaches the location just below the xenon lamp 26a, the routine proceeds to step 1109, at which the counter C is incremented by "1", and then the routine returns to step 1102, at which the charging signal CS is made high, as shown in FIG. 12, and thus the electric charging of the capacitor 42a is initiated by the electric source 42a.

At step 1103, it is determined whether or not the counter C exceeds "2". At this stage, since C="2", the routine proceeds to step 1104, at which it is determined whether or not the time $T_M$ (FIG. 12) has elapsed. When the time $T_M$ has elapsed at step 1104, i.e., when the capacitor 42b is charged to 1,500 volts, the routine proceeds to step 1105, at which the charging signal CS is made low, as shown in FIG. 12, to thereby stop the electric charging of the capacitor 42a.

At step 1106, it is determined whether or not the time $T_W$ (FIG. 12) has elapsed. When the time $T_W$ has elapsed, i.e., when a lateral center line of the zone $Z_3$ of the paper reaches the location just below the xenon lamp 26a, the routine proceeds to step 1107, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_3$ of the paper is exposed to flash-radiation derived from the voltage of 1,500 volts.

At step 1108, it is determined whether or not the time $T_W$ has elapsed. When the time $T_W$ has elapsed, i.e., when a boundary line between the zones $Z_3$ and $Z_4$ reaches the location just below the xenon lamp 26a, the routine proceeds to step 1109, at which the counter C is incremented by "1", and then the routine returns to step 1102, at which the charging signal CS is made high, as shown in FIG. 12, and thus the electric charging of the capacitor 42a is initiated by the electric source 42a.

At step 1103, it is determined whether or not the counter C exceeds "2". At this stage, since C="3", the routine proceeds from step 1103 to step 1110, at which it is determined whether or not the time $T_S$ (FIG. 12) has elapsed. The time $T_S$ is defined as the time from when the charging signal CS is made high until the capacitor 42b is charged to 1,000 volts (FIG. 12). When the time $T_S$ has elapsed at step 1110, i.e., when the capacitor 42b is charged to 1,000 volts, the routine proceeds to step 1111, at which the charging signal CS is made low, as shown in FIG. 12, to thereby stop the electric charging of the capacitor 42a.

At step 1112, it is determined whether or not the time $T_W$ (FIG. 12) has elapsed. When the time $T_W$ has elapsed, i.e., when a lateral center line of the zone $Z_4$ of the paper reaches the location just below the xenon lamp 26a, the routine proceeds to step 1113, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the zone $Z_4$ of the paper is exposed to flash-radiation derived from the voltage of 1,000 volts.

Thus, the one-sided recording of the paper is completed, and this paper is introduced, from the paper eject passageway EP into the paper bypass passageway BP by the paper switching rollers 32 for two-sided recording. In this operational mode, the zones $Z_1$, $Z_2$, and $Z_3$ of the paper are subjected to the flash-radiation derived from the voltage of 1,500 volts, regardless the density of the toner image recorded thereon. Accordingly, undulation may be produced at the zones $Z_1$, $Z_2$, and $Z_3$ of the paper. Nevertheless, the zone $Z_4$ of the paper can be prevented from being undulated, because the zone $Z_4$ is subjected to the flash-radiation derived from the low level voltage (1,000 volts). When the paper is reversed and moved to the register rollers 22 and 22 through the paper bypass passageway BP, and when the reversed paper is fed to the toner image transferring device 18 for the two-sided recording, the zone ($Z_4$) of the paper not subjected to the undulation is first introduced into the clearance between the photosensitive drum 10 and the transferring device 18. Accordingly, that zone of the paper is tightly contacted to the surface of the drum 10, and thus the remaining zones ($Z_3$, $Z_2$, $Z_1$) of the paper can be tightly contacted to the surface of the drum 10, even if these zones are undulated. This is because the tight contact between the drum surface and the zone of the paper not subjected to the undulation successively prevails over the remaining zones thereof.

At step 1114, the counter C is reset, and then, at step 1115, it is determined whether or not the time $T_O$ (FIG. 12) has elapsed. When the time $T_O$ has elapsed, i.e., when the leading edge of the reversed paper reaches the location just below the xenon lamp 26a of the fixing device 26, the routine proceeds to step 1116, at which the charging signal CS is made high, as shown in FIG. 12, and thus the electric charging of the capacitor 42a is initiated by the electric source 42a.

At step 1117, it is determined whether or not the counter C exceeds "0". At this stage, since C="0", the routine proceeds to step 1118, at which it is determined whether or not the time $T_L$ (FIG. 12) has elapsed. The time $T_L$ is defined as the time from when the charging signal CS is made high until the capacitor 42b is charged to 1,700 volts (FIG. 12).

When the time $T_L$ has elapsed at step 1118, i.e., the capacitor 42b is charged to 1,700 volts, the routine proceeds to step 1119, at which the charging signal CS is made low, as shown in FIG. 12, to thereby stop the electric charging of the capacitor 42a.

At step 1120, it is determined whether or not the time $T_W$ (FIG. 12) has elapsed. When the time $T_W$ has elapsed, i.e., when a lateral center line the first zone ($Z_4$)

of the reversed paper reaches the location just below the xenon lamp 26a, the routine proceeds to step 1121, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the first zone ($Z_4$) of the reversed paper is exposed to flash-radiation derived from the voltage of 1,700 volts.

As mentioned above, when the one-sided recording has been carried out, the zone $Z_4$ of the paper is subjected to the flash-radiation derived from the low level voltage of 1,000 volts, to prevent the undulation thereof. Accordingly, although the toner image recorded on the zone $Z_4$ of the paper cannot be incompletely fixed, this incomplete fixing of toner image can be resolved due to the fact that the first zone (corresponding to the zone $Z_4$) of the reversed paper is subjected to the flash-radiation derived from the high level voltage of 1,700 volts.

At step 1122, it is determined whether or not the time $T_W$ has elapsed. When the time $T_W$ has elapsed, i.e., when a boundary line between the first zone ($Z_4$) and the second zone ($Z_3$) reaches the location just below the xenon lamp 26a, the routine proceeds to step 1123, at which the counter C is incremented by "1". Then, the routine returns to step 1116, at which the charging signal CS is made high, as shown in FIG. 12, and thus the electric charging of the capacitor 42a is initiated by the electric source 42a.

At step 1117, it is determined whether or not the counter C exceeds "0". At this stage, since C="1", the routine proceeds to step 1124, at which it is determined whether or not the time $T_M$ (FIG. 12) has elapsed. When the time $T_M$ has elapsed at step 1124, i.e., when the capacitor 42b is charged to 1,500 volts, the routine proceeds to step 1125, at which the charging signal CS is made low, as shown in FIG. 12, to thereby stop the electric charging of the capacitor 42a.

At step 1126, it is determined whether or not the time $T_W$ (FIG. 12) has elapsed. When the time $T_W$ has elapsed, i.e., when a lateral center line of the second zone ($Z_3$) of the paper reaches the location just below the xenon lamp 26a, the routine proceeds to step 1127, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the second zone ($Z_3$) of the paper is exposed to flash-radiation derived from the voltage of 1,500 volts.

At step 1128, it is determined whether or not the counter C exceeds "2". At this stage, since C="1", the routine proceeds to step 1122, at which it is determined whether or not the time $T_W$ has elapsed. When the time $T_W$ has elapsed, i.e., when a boundary line between the second zone ($Z_3$) and the third zone ($Z_2$) reaches the location just below the xenon lamp 26a, the routine proceeds to step 1123, at which the counter C is incremented by "1". Then, the routine returns to step 1116, at which the charging signal CS is made high, as shown in FIG. 12, and thus the electric charging of the capacitor 42a is initiated by the electric source 42a.

At step 1117, it is determined whether or not the counter C exceeds "0". At this stage, since C="2", the routine proceeds to step 1124, at which it is determined whether or not the time $T_M$ (FIG. 12) has elapsed. When the time $T_M$ has elapsed at step 1124, i.e., when the capacitor 42b is charged to 1,500 volts, the routine proceeds to step 1125, at which the charging signal CS is made low, as shown in FIG. 12, to thereby stop the electric charging of the capacitor 42a.

At step 1126, it is determined whether or not the time $T_W$ (FIG. 12) has elapsed. When the time $T_W$ has elapsed, i.e., when a lateral center line of the third zone ($Z_2$) of the paper reaches the location just below the xenon lamp 26a, the routine proceeds to step 1127, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the third zone ($Z_2$) of the paper is exposed to flash-radiation derived from the voltage of 1,500 volts.

At step 1128, it is determined whether or not the counter C exceeds "2". At this stage, since C="2", the routine proceeds to step 1122, at which it is determined whether or not the time $T_W$ has elapsed. When the time $T_W$ has elapsed, i.e., when a boundary line between the third zone ($Z_2$) and the fourth zone ($Z_1$) reaches the location just below the xenon lamp 26a, the routine proceeds to step 1123, at which the counter C is incremented by "1". Then, the routine returns to step 1116, at which the charging signal CS is made high, as shown in FIG. 12, and thus the electric charging of the capacitor 42a is initiated by the electric source 42a.

At step 1117, it is determined whether or not the counter C exceeds "0". At this stage, since C="3", the routine proceeds to step 1124, at which it is determined whether or not the time $T_M$ (FIG. 12) has elapsed. When the time $T_M$ has elapsed at step 1124, i.e., when the capacitor 42b is charged to 1,500 volts, the routine proceeds to step 1125, at which the charging signal CS is made low, as shown in FIG. 12, to thereby stop the electric charging of the capacitor 42a.

At step 1126, it is determined whether or not the time $T_W$ (FIG. 12) has elapsed. When the time $T_W$ has elapsed, i.e., when a lateral center line of the fourth zone ($Z_1$) of the paper reaches the location just below the xenon lamp 26a, the routine proceeds to step 1127, at which the trigger signal TS is output from the control circuit 40 to the choke coil 42c, so that a high voltage pulse is output from the choke coil 42c to the xenon lamp 26a, to thereby emit flash-radiation from the xenon lamp 26a. Namely, the fourth zone ($Z_1$) of the paper is exposed to flash-radiation derived from the voltage of 1,500 volts.

Figure 11A:
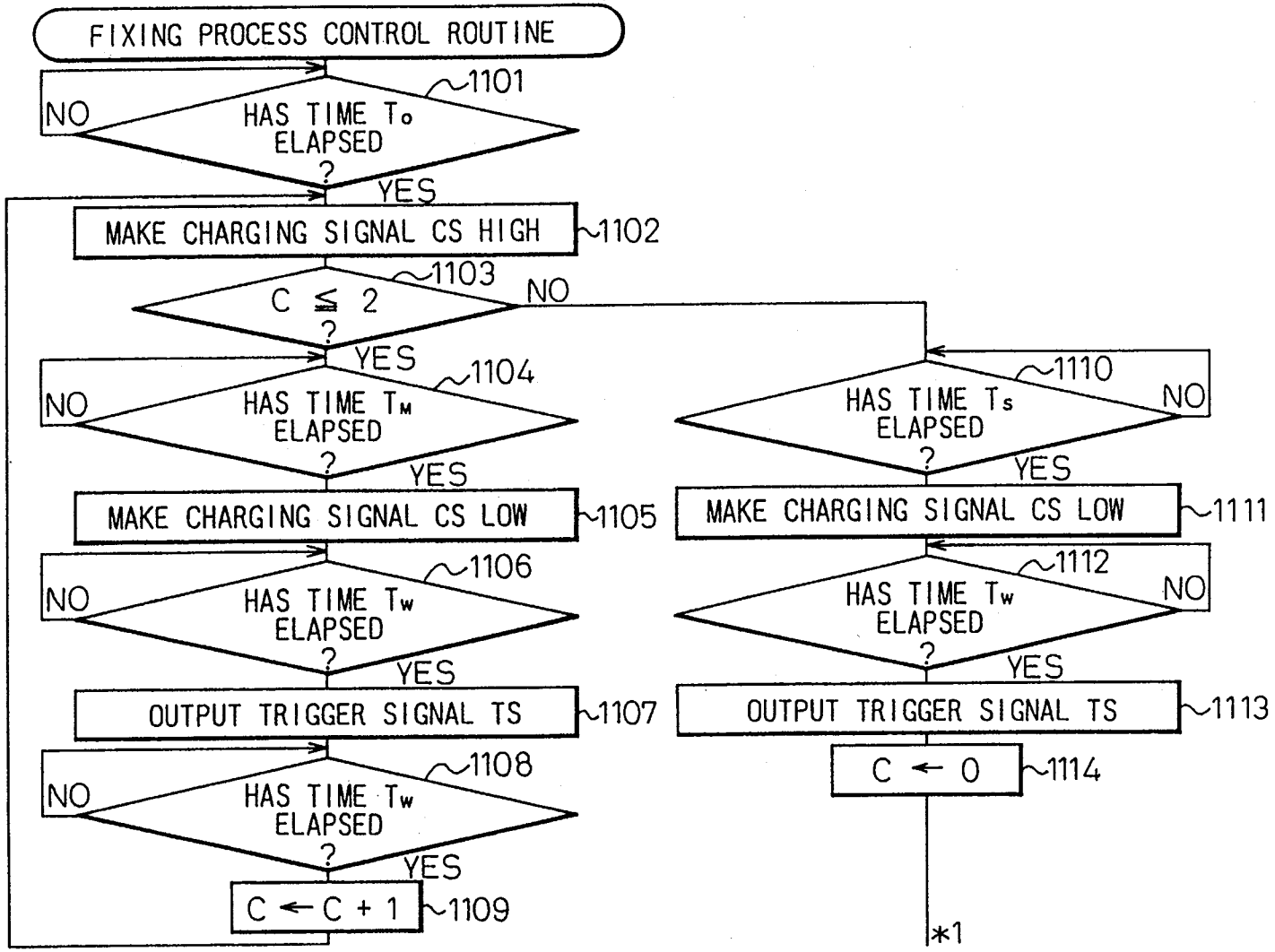
FIGS. 11(A) and 11(B) show a flow chart for explaining yet another operational mode of the toner image fixing device shown in FIGS. 3(A) and 3(B)
Figure 11B:
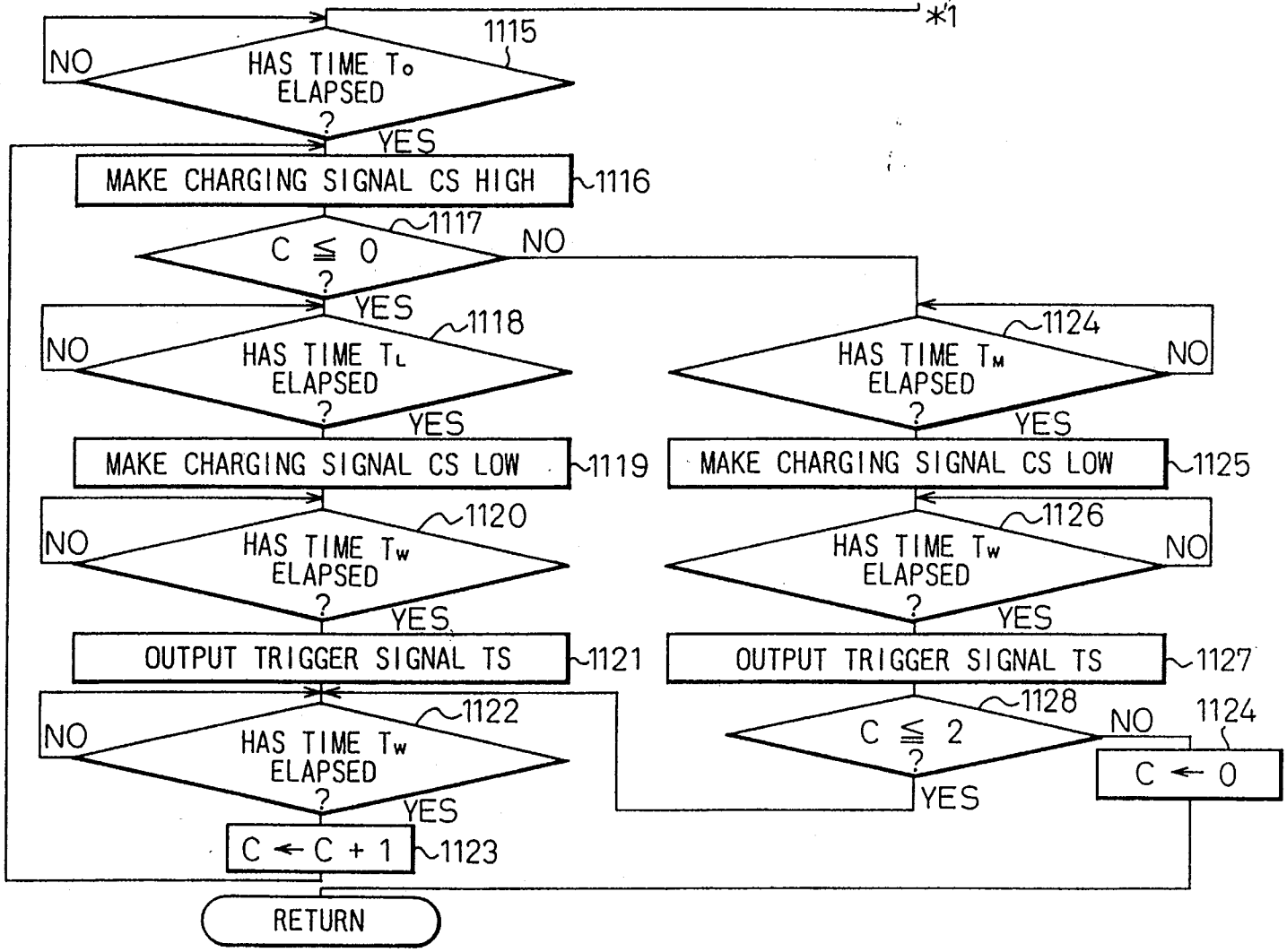

According to the operational mode as shown in FIGS. 11(A) and 11(B), although the paper is partially undulated, a proper two-sided recording can be carried out.

Figure 13:
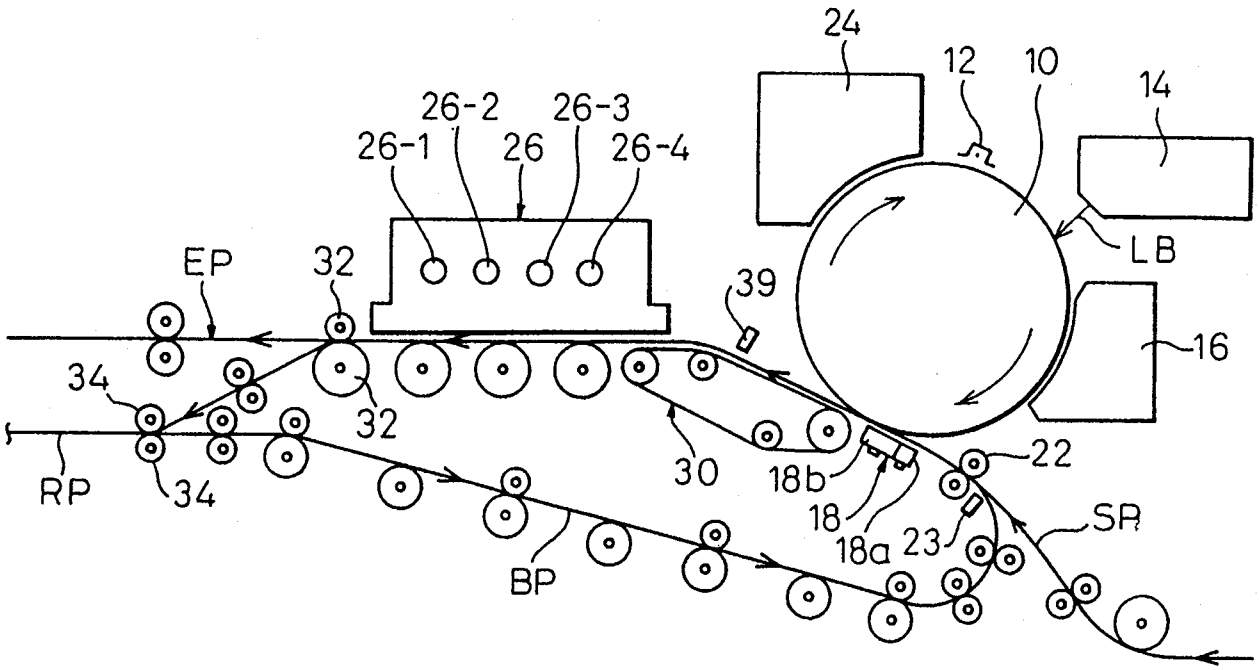
FIG. 13 is a schematic view similar to FIG. 2, showing an electrophotographic recording apparatus using another flash-radiation type toner image fixing device constituted according to the present invention.

FIG. 13 shows a part of the recording apparatus in which a second embodiment of the flash type toner image fixing device according to the present invention is incorporated. Note, the elements except for the fixing device are the same elements as shown in FIG. 2, and are indicated by the same references.

Figure 14:
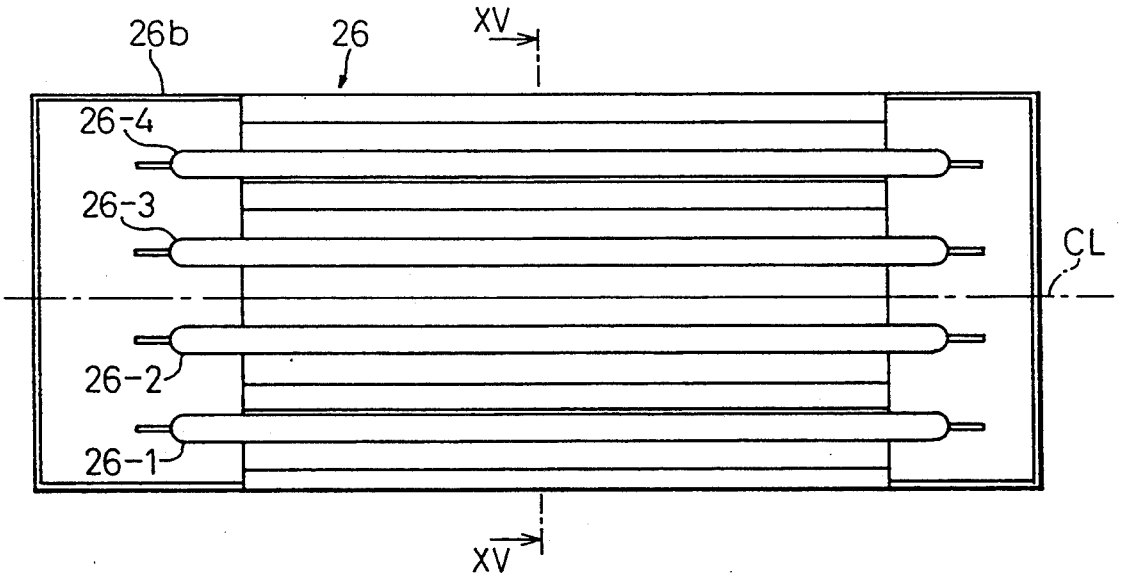
FIG. 14 is a bottom view of the toner image fixing device shown in FIG. 13.
Figure 15:
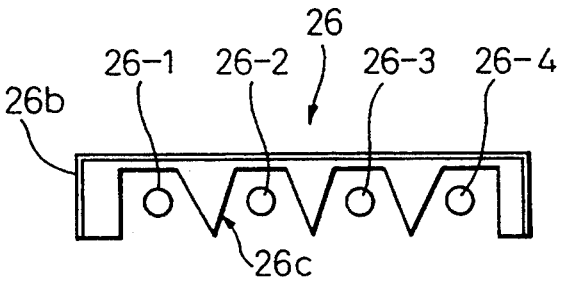
FIG. 15 is a cross-sectional view taken along line XI—XI of FIG. 14.

In this embodiment, the fixing device 26 includes four xenon lamps 26-1, 26-2, 26-3, and 26-4 transversely arranged with respect to the paper supply passageway SP. As shown in FIGS. 14 and 15, the fixing device 26 has a box-like housing 26b, and a reflector 26c provided therein. The reflector 26c is provided with four elongated grooves formed therein, and the xenon lamps 26-1, 26-2, 26-3, and 26-4 are accommodated in the grooves, respectively. The xenon lamps 26-1, 262, 26-3, and 26-4 are arranged at regular intervals, and are symmetrical with respect to a lateral center line CL (FIG. 14) such that the respective xenon lamps 26-1, 26-2, 26-3, and 26-4 are just above the lateral center lines of the quarter-zones $Z_1$, $Z_2$, $Z_3$, and $Z_4$ of the paper (FIG. 6) when the lateral center of the paper reaches a location just below the center line CL of the fixing device 26.

Figure 16A:
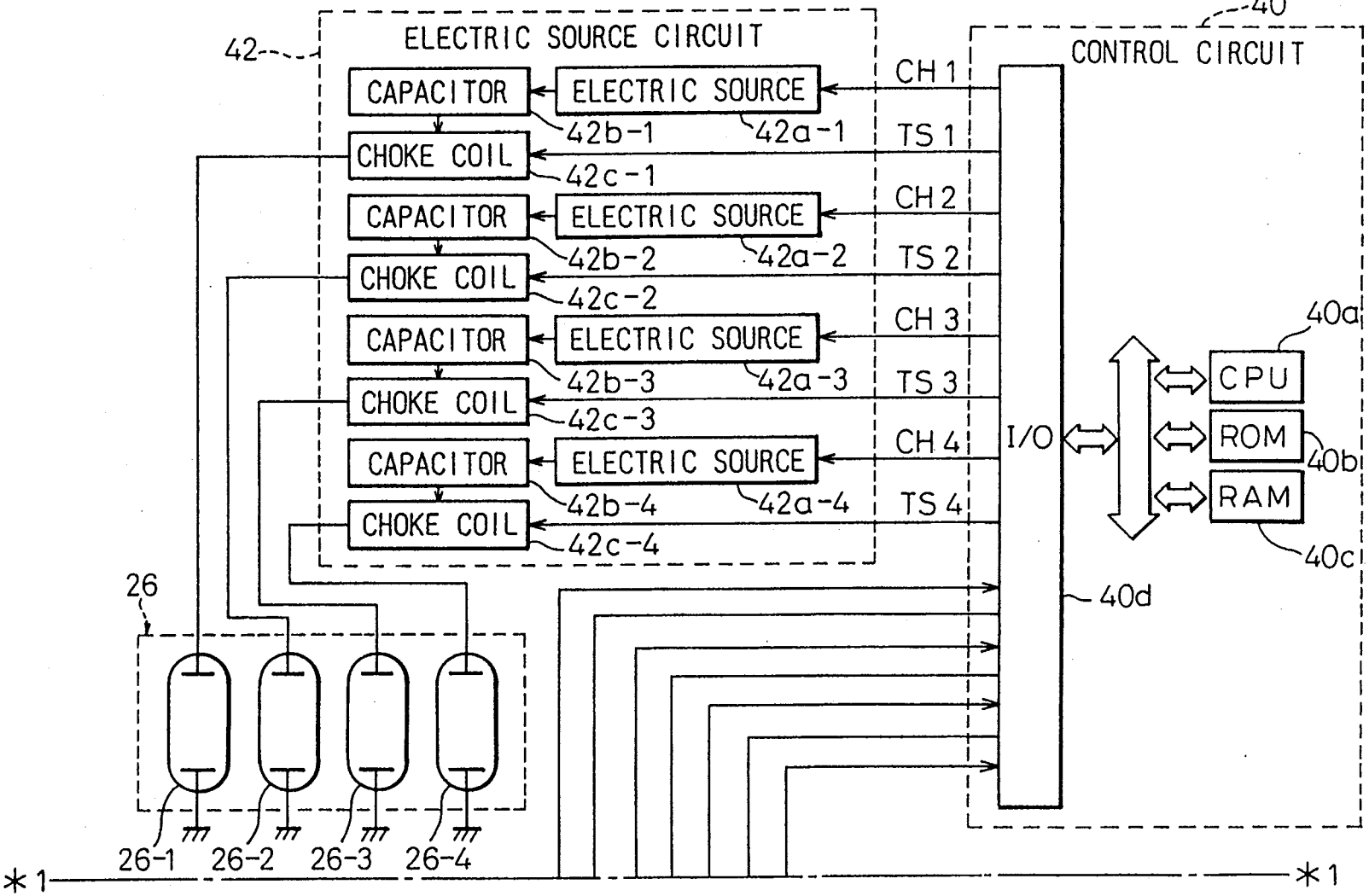
FIGS. 16(A) and 16(B) is a block diagram of the recording apparatus shown in FIG. 13.
Figure 16B:
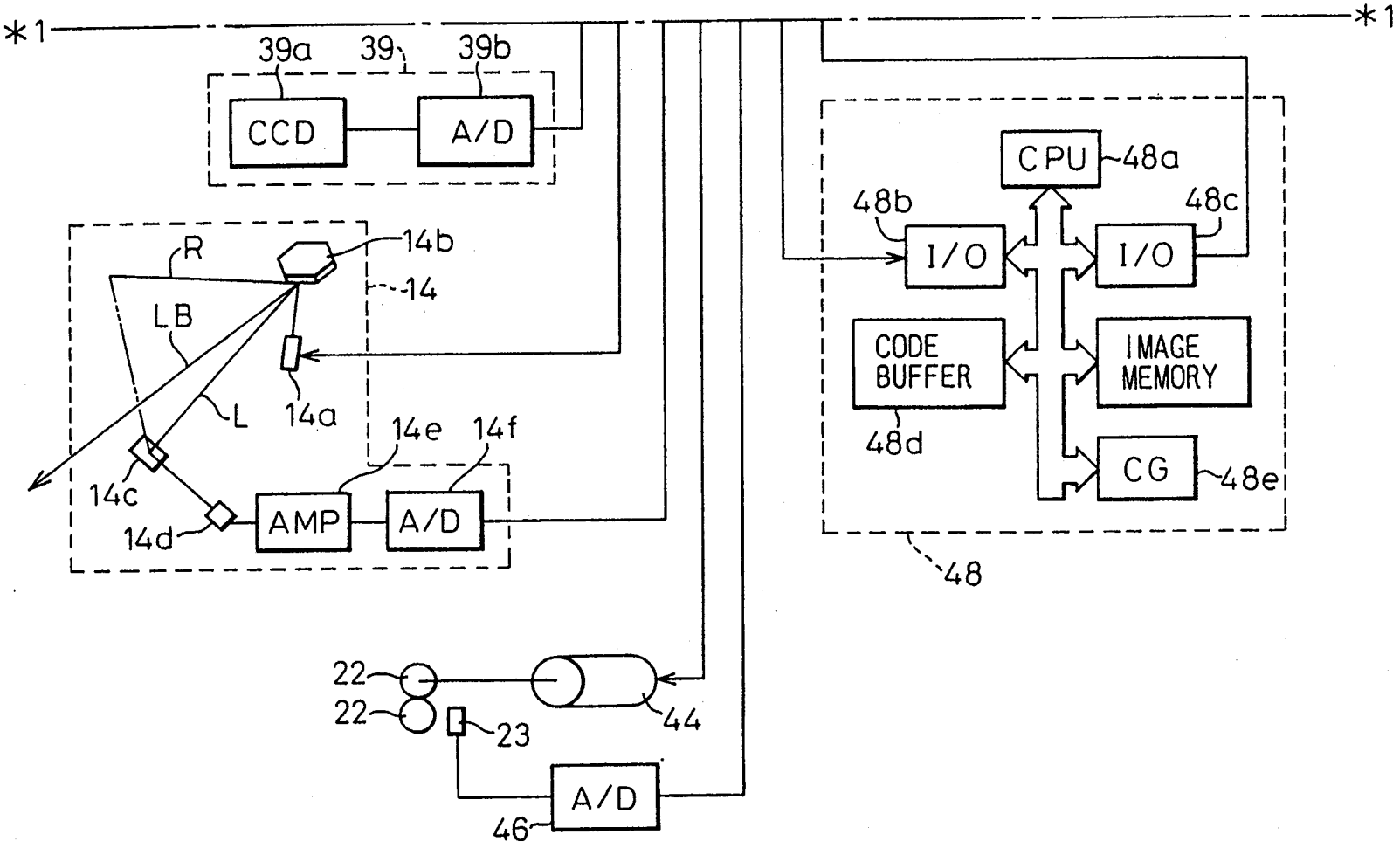

FIGS. 16(A) and 16(B) show a block diagram showing a part of the recording apparatus of FIGS. 16(A) and 16(B). In this block diagram, the electric source circuit 42 includes four high voltage electric sources 42*a*-1, 42*a*-2, 42*a*-3, and 42*a*-4; four capacitors 42*b*-1, 42*b*-2, 42*b*-3, and 42*b*-4; and four choke coils 42*c*-1, 42*c*-2, 42*c*-3, and 42*c*-4. The respective capacitors 42*b*-1, 42*b*-2, 42*b*-3, and 42*b*-4 are electrically charged by the electric sources 42*a*-1, 42*a*-2, 42*a*-3, and 42*a*-4, and are connected to the xenon lamps 26-1, 26-2, 26-3, and 26-4 through choke coils 42*c*-1, 42*c*-2, 42*c*-3, and 42*c*-4. The control circuit 40 outputs charging signals to the electric sources 42*a*-1, 42*a*-2, 42*a*-3, and 42*a*-4.

Figure 17A:
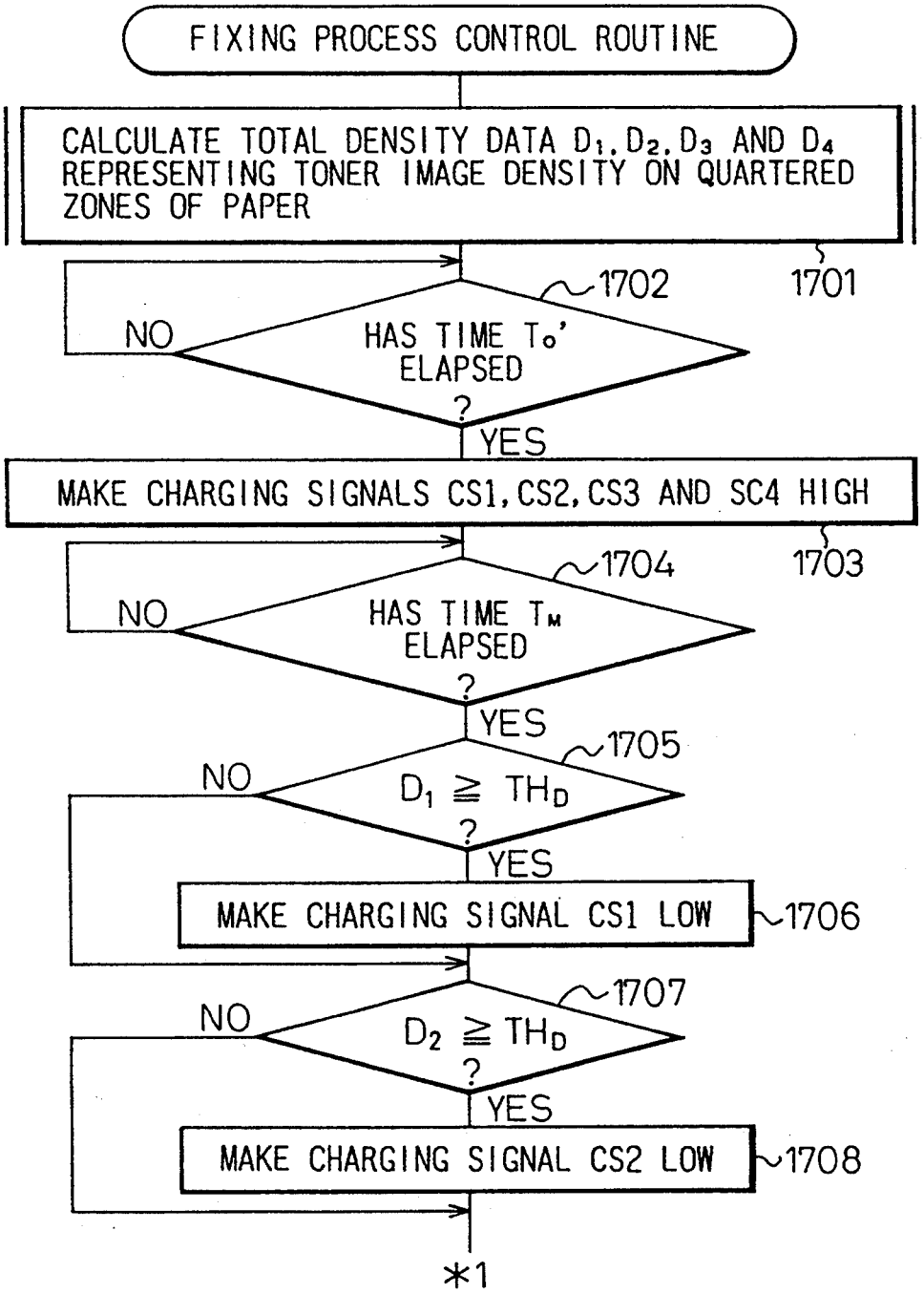
FIGS. 17(A) and 17(B) show a flow chart for explaining an operational mode of the toner image fixing device shown in FIGS. 16(A) and 16(B)
Figure 17B:
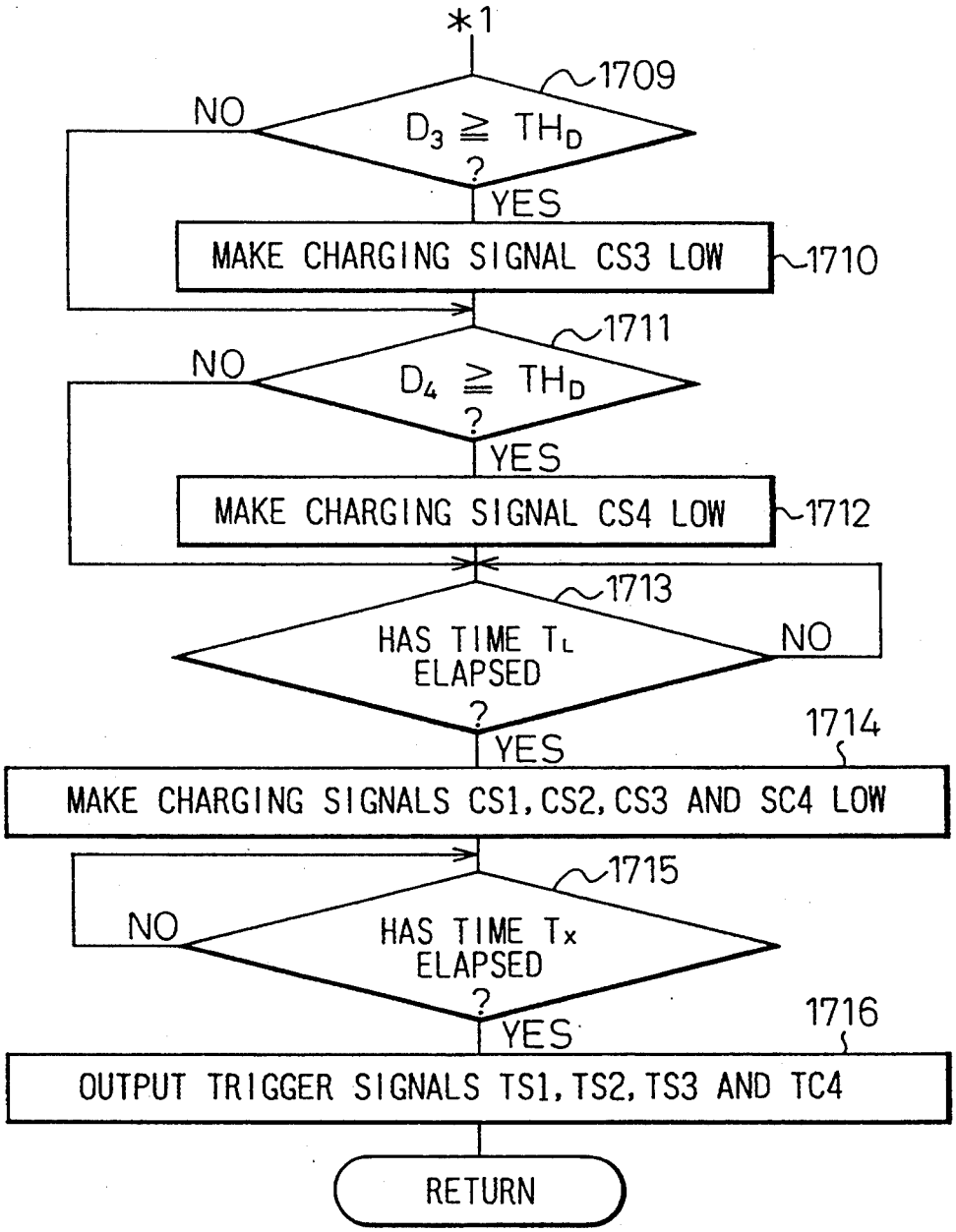
Figure 18:
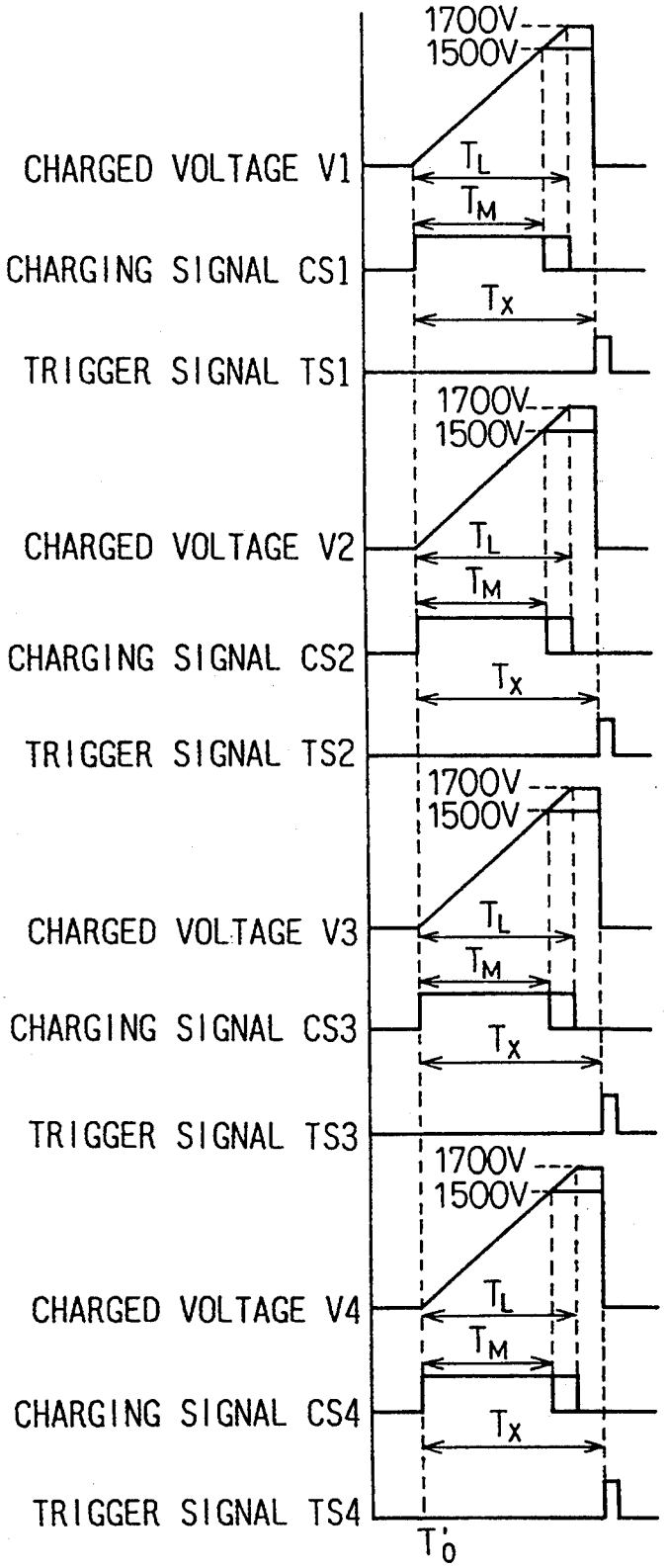
FIG. 18 is a time chart in relation to the flow chart shown in FIGS. 17(A) and 17(B)
Figure 19A:
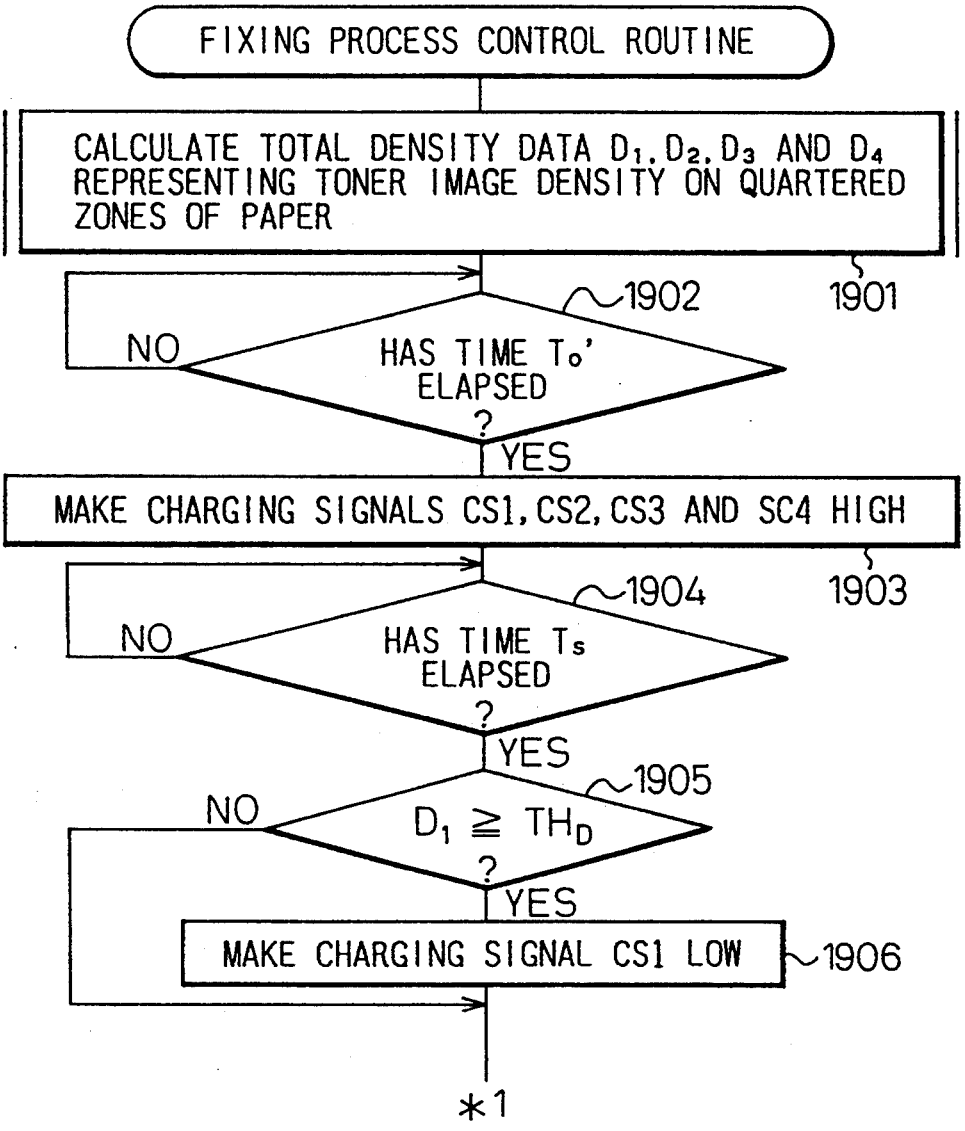
FIGS. 19(A), 19(B), and 19(C) show a flow chart for explaining another operational mode of the toner image fixing device shown in FIGS. 16(A) and 16(B)
Figure 19B:
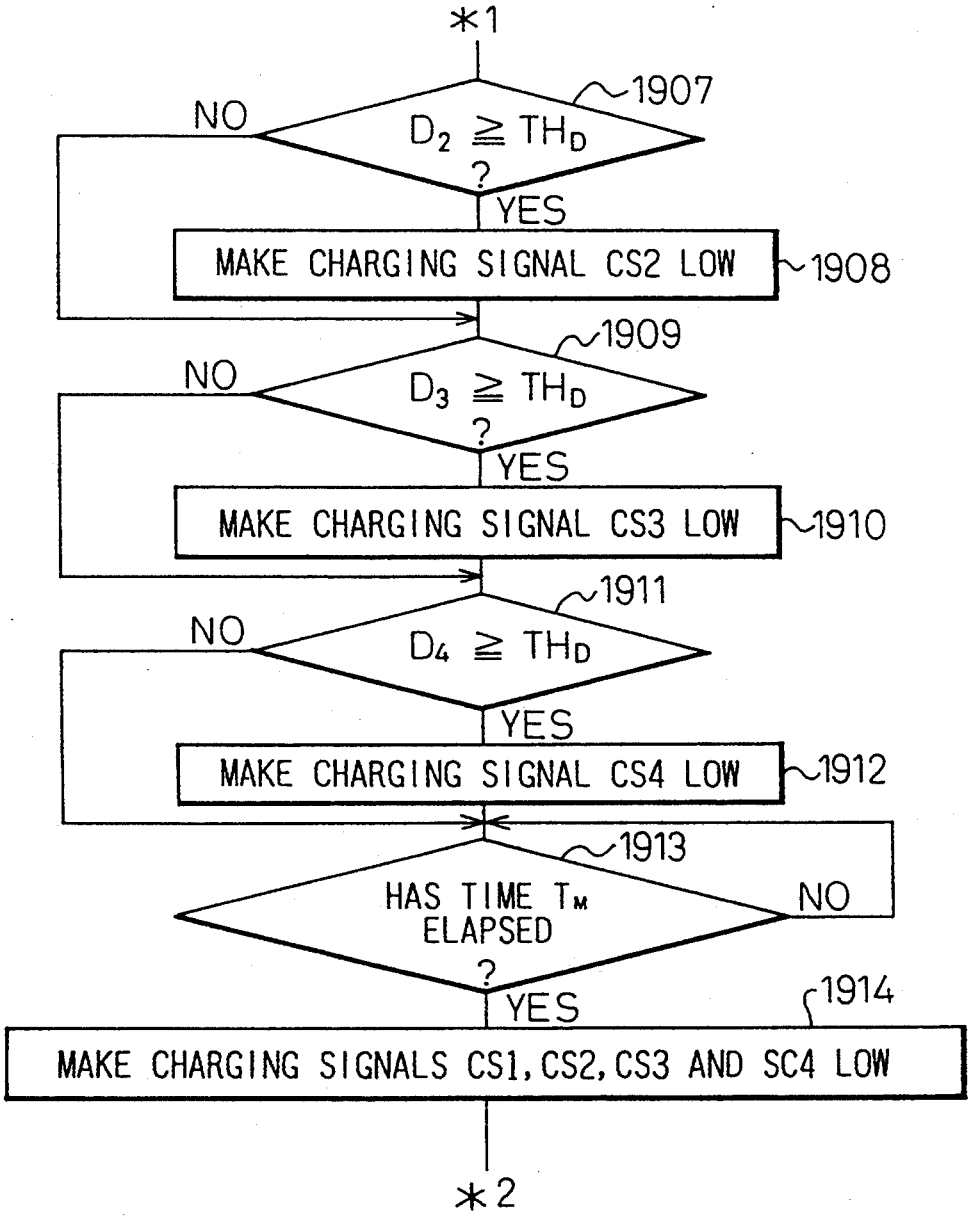
Figure 19C:
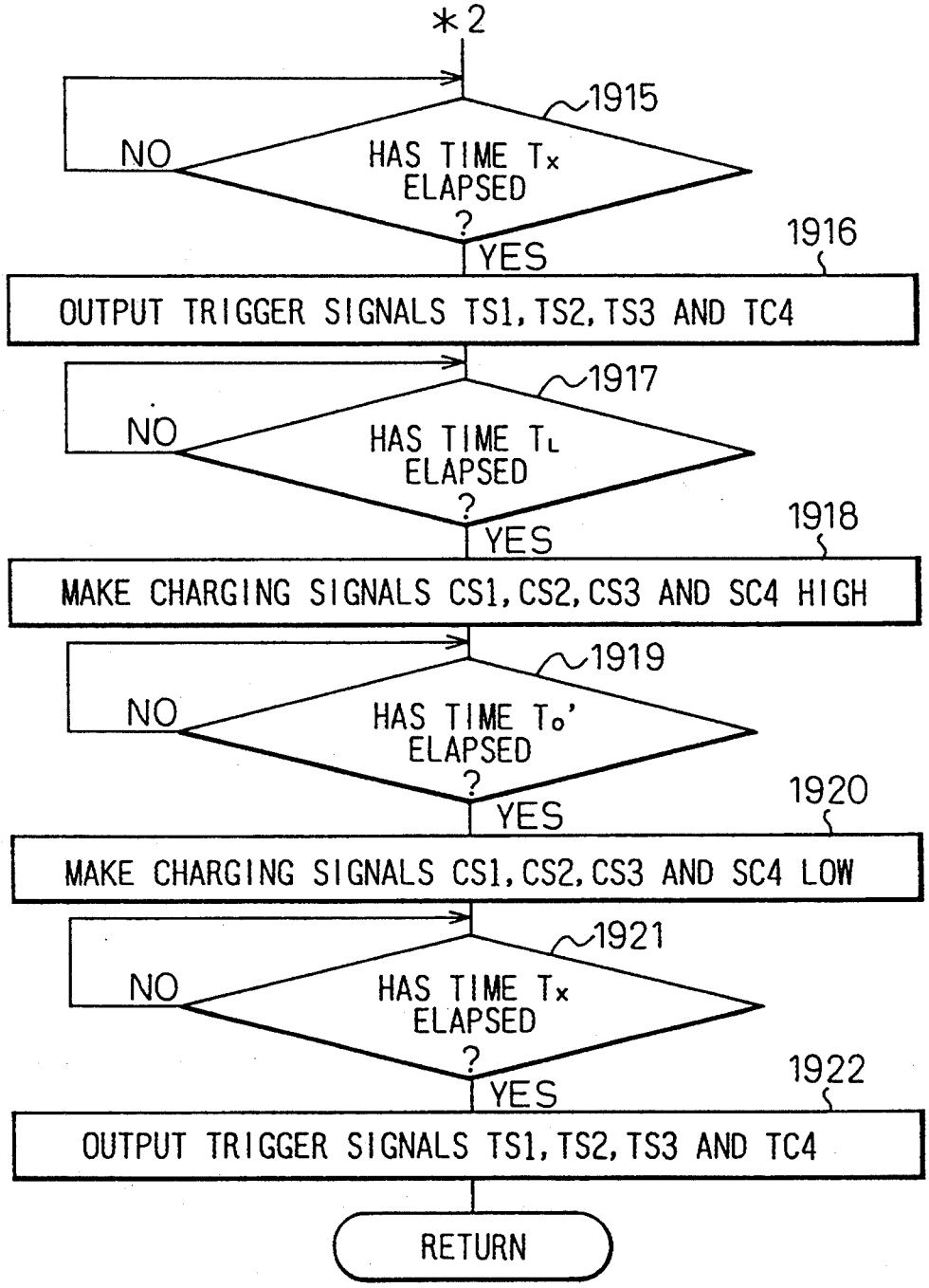

FIGS. 17(A) and 17(B) and FIG. 18 show an operational mode of the toner image transferring device as shown in FIGS. 13 to 16, which is substantially identical with the operational mode explained with reference to FIGS. 4 and 5, except that the zones $Z_1$, $Z_2$, $Z_3$, and $Z_4$ of the paper are simultaneously subjected to flash-radiation emitted from the four xenon lamps 26*a*-1, 42*a*-2, 42*a*-3, and 42*a*-4.

At step 1701, four total density data $D_1$, $D_2$, $D_3$, and $D_4$, which represent densities of toner images recorded on laterally-quartered zones $Z_1$, $Z_2$, $Z_3$ and $Z_4$ of a sheet of paper, are calculated on the basis of toner image density data detected by the optical density sensor 39, and are stored in RAM 40*c*. The total density data $D_1$, $D_2$, $D_3$ and $D_4$ may be calculated in the manner explained with reference to the routine of FIGS. 7(A) and 7(B), and also may be calculated by counting a number of pulses of image writing signal, as explained with reference to the routine of FIGS. 8(A) and 8(B).

At step 1702, it is determined whether or not the time $T_O'$ (FIG. 18) has elapsed. The time $T_O'$ is defined as the time from when the timing signal is output by the control circuit 40 to drive the electric motor 44 to release the paper from the standby-condition until the leading edge of the paper reaches the location just below the lateral center line CL of the fixing device 26. When the time $T_O'$ has elapsed, the routine proceeds to step 1703, at which the charging signals CS1, CS2, CS3, and CS4 are made high, as shown in FIG. 18, and thus the electric charging of the capacitors 42*b*-1, 42*b*-2, 42*b*-3, and 42*b*-4 is initiated by the electric sources 42*a*-1, 42*a*-2, 42*a*-3, and 42*a*-44.

At step 1704, it is determined whether or not the time $T_M$ (FIG. 18) has elapsed. The time $T_M$ is defined as the time from when the charging signals CS1, CS2, CS3, and CS4 are made high until the capacitors 42*b*-1, 42*b*-2, 42*b*-3, and 42*b*-4 are charged to 1,500 volts (FIG. 18).

When the time $T_M$ (FIG. 18) has elapsed, the routine proceeds to step 1705, at which it is determined whether or not the density data $D_1$ exceeds a given threshold value $TH_D$. If $D_1 \geqq TH_D$, at step 1706, the charging signal CS1 is made low, and then the routine proceeds to step 1707. Also, at step 1705, if $D_1 < TH_D$, the routine proceeds to step 1707.

At step 1707, it is determined whether or not the density data $D_2$ exceeds the threshold value $TH_D$. At step 1707, if $D_2 \geqq TH_D$, the charging signal CS2 is made low, and then the routine proceeds to step 1709. Also, at step 1707, if $D_2 < TH_D$, the routine proceeds to step 1709.

At step 1709, it is determined whether or not the density data $D_3$ exceeds the threshold value $TH_D$. At step 1709, if $D_3 \geqq TH_D$, the charging signal CS3 is made low, and then the routine proceeds to step 1711. Also, at step 1709, if $D_3 < TH_D$, the routine proceeds to step 1711.

At step 1711, it is determined whether or not the density data $D_4$ exceeds the threshold value $TH_D$. At step 1711, if $D_4 \geqq TH_D$, the charging signal CS4 is made low, and then the routine proceeds to step 1713. Also, at step 1711, if $D_4 < TH_D$, the routine proceeds to step 1713.

At step 1713, it is determined whether or not the time $T_L$ (FIG. 18) has elapsed. The time $T_L$ is defined as the time from when the charging signals CS1, CS2, CS3, and CS4 are made high until the capacitors 42*b*-1, 42*b*-2, 42*b*-3, and 42*b*-4 are charged to 1,700 volts (FIG. 18). When the time $T_L$ has elapsed, the routine proceeds to step 1714, at which all of the charging signals CS1, CS2, CS3, and CS4 are made low.

At step 1715, it is determined whether or not the time $T_X$ (FIG. 18) has elapsed. The time $T_X$ is defined as the time from when the leading edge of the paper reaches the location just below the lateral center line CL of the fixing device 26 until the lateral center line of the paper is moved to that location. When the time $T_X$ has elapsed, the routine proceeds to step 1716, at which the trigger signals TS1, TS2, TS3, and TS4 are output from the control circuit 40 to the choke coils 42*c*-1, 42*c*-2, 42*c*-3, and 42*c*-4, respectively, so that high voltage pulses are output from the choke coils 42*c*-1, 42*c*-2, 42*c*-3, and 42*c*-4 to the xenon lamps 26-1, 26-2, 26-3, and 26-4, to thereby emit flash-radiation from the xenon lamp 26-1, 26-2, 26-3, and 26-4. Namely, the respective zones $Z_1$, $Z_2$, $Z_3$, and $Z_4$ of the paper are exposed to the flash-radiation emitted from the xenon lamps 26-1, 26-2, 26-3, and 26-4.

FIGS. 19(A), 19(B) and 19(C) and FIG. 20 show another operational mode of the toner image transferring device as shown in FIGS. 13 to 16, which corresponds to the operational mode shown in FIGS. 9 and 10.

At step 1901, four total density data $D_1$, $D_2$, $D_3$ and $D_4$, which represent densities of toner images recorded on laterally-quartered zones $Z_1$, $Z_2$, $Z_3$ and $Z_4$ of a sheet of paper, are calculated on the basis of toner image density data detected by the optical density sensor 39, and are stored in RAM 40*c*. The total density data $D_1$, $D_2$, $D_3$ and $D_4$ may be calculated in the manner explained with reference to the routine of FIGS. 7(A) and 7(B), and also may be calculated by counting a number of pulses of image writing signal, as explained with reference to the routine of FIGS. 8(A) and 8(B).

Figure 20:
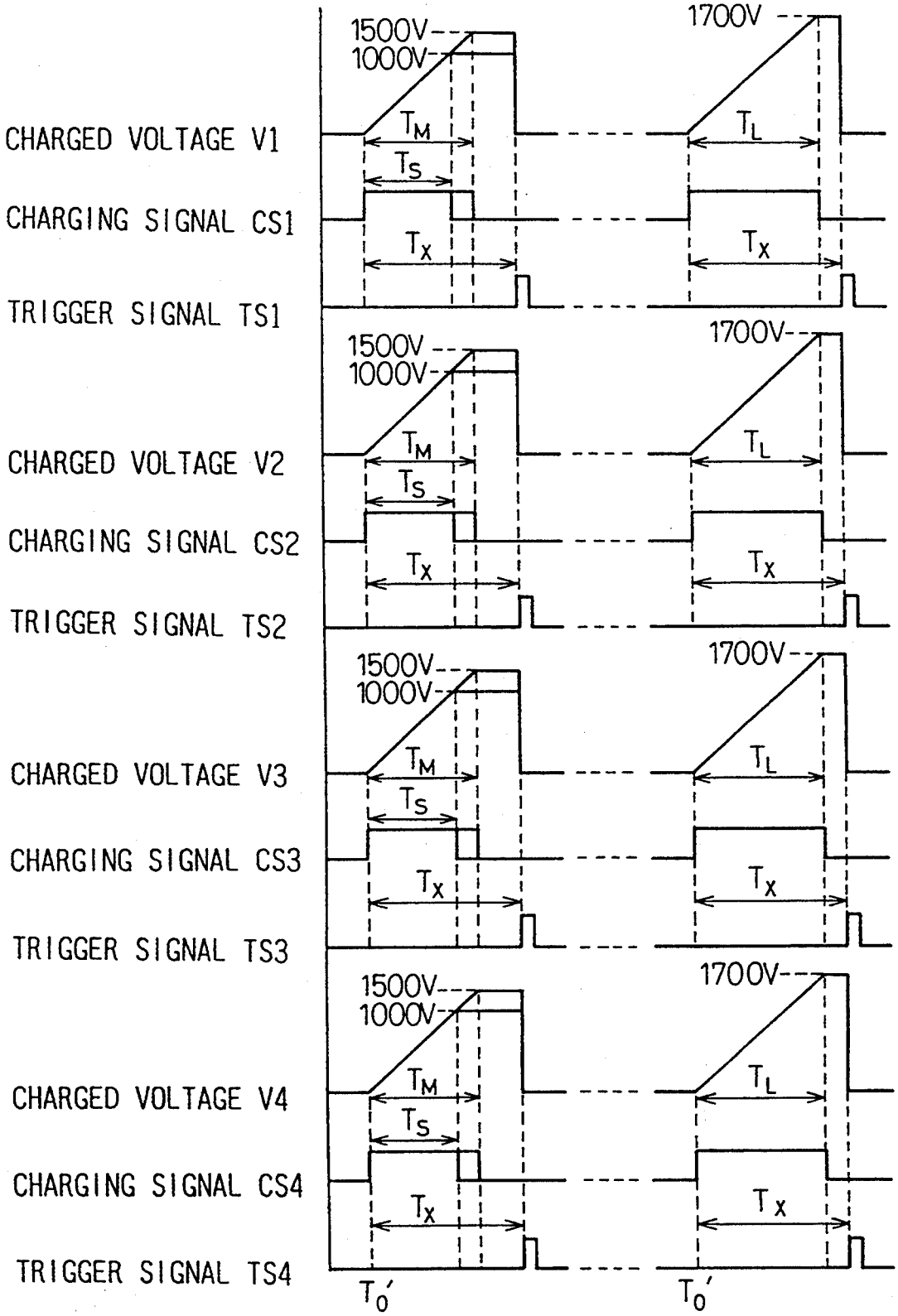
FIG. 20 is a time chart in relation to the flow chart shown in FIGS. 19(A), 19(B), and 19(C)

At step 1902, it is determined whether or not the time $T_O'$ (FIG. 20) has elapsed. The time $T_O'$ is defined as the time from when the timing signal is output by the control circuit 40 to drive the electric motor 44 to release the paper from the standby-condition until the leading edge of the paper reaches the location just below the lateral center line CL of the fixing device 26. When the time $T_O'$ has elapsed, the routine proceeds to step 1903, at which the charging signals CS1, CS2, CS3, and CS4 are made high, as shown in FIG. 20, and thus the electric charging of the capacitors 42*b*-1, 42*b*-2, 42*b*-3, and 42b-4 is initiated by the electric sources 42a-1, 42a-2, 42a-3, and 42a-44.

At step 1904, it is determined whether or not the time $T_S$ (FIG. 20) has elapsed. The time $T_S$ is defined as the time from when the charging signals CS1, CS2, CS3, and CS4 are made high until the capacitors 42b-1, 42b-2, 42b-3, and 42b-4 are charged to 1,000 volts (FIG. 20).

When the time $T_S$ (FIG. 20) has elapsed, the routine proceeds to step 1905, at which it is determined whether or not the density data $D_1$ exceeds the threshold value $TH_D$. If $D_1 \geqq TH_D$, at step 1906, the charging signal CS1 is made low, and then the routine proceeds to step 1907. Also, at step 1905, if $D_1 < TH_D$, the routine proceeds to step 1907.

At step 1907, it is determined whether or not the density data $D_2$ exceeds the threshold value $TH_D$. At step 1907, if $D_2 \geqq TH_D$, the charging signal CS2 is made low, and then the routine proceeds to step 1909. Also, at step 1907, if $D_2 < TH_D$, the routine proceeds to step 1909.

At step 1909, it is determined whether or not the density data $D_3$ exceeds the threshold value $TH_D$. At step 1909, if $D_3 \geqq TH_D$, the charging signal CS3 is made low, and then the routine proceeds to step 1911. Also, at step 1909, if $D_3 < TH_D$, the routine proceeds to step 1911.

At step 1911, it is determined whether or not the density data $D_4$ exceeds the threshold value $TH_D$. At step 1911, if $D_4 \geqq TH_D$, the charging signal CS4 is made low, and then the routine proceeds to step 1913. Also, at step 1911, if $D_4 < TH_D$, the routine proceeds to step 1913.

At step 1913, it is determined whether or not the time $T_M$ (FIG. 20) has elapsed. The time $T_M$ is defined as the time from when the charging signals CS1, CS2, CS3, and CS4 are made high until the capacitors 42b-1, 42b-2, 42b-3, and 42b-4 are charged to 1,500 volts (FIG. 20). When the time $T_M$ has elapsed, the routine proceeds to step 1914, at which all of the charging signals CS1, CS2, CS3, and CS4 are made low.

At step 1915, it is determined whether or not the time $T_X$ (FIG. 20) has elapsed. The time $T_X$ is defined as the time from when the leading edge of the paper reaches the location just below the lateral center line CL of the fixing device 26 until the lateral center line of the paper is moved to that location. When the time $T_X$ has elapsed, the routine proceeds to step 1916, at which the trigger signals TS1, TS2, TS3, and TS4 are output from the control circuit 40 to the choke coils 42c-1, 42c-2, 42c-3, and 42c-4, respectively, so that high voltage pulses are output from the choke coils 42c-1, 42c-2, 42c-3, and 42c-4 to the xenon, lamps 26-1, 26-2, 26-3, and 26-4, to thereby emit flash-radiation from the xenon lamp 26-1, 26-2, 26-3, and 26-4. Namely, the respective zones $Z_1$, $Z_2$, $Z_3$, and $Z_4$ of the paper are exposed to the flash-radiation emitted from the xenon lamp 26-1, 26-2, 26-3, and 26-4.

In this operational mode, the paper is reversed and returned to the register rollers through the paper bypass passageway BP for the two-sided recording.

At step 1917, it is determined whether or not the time $T_O'$ (FIG. 20) has elapsed. When the time $T_O'$ has elapsed, i.e., when the leading edge of the reversed paper reaches the location just below the lateral center line CL of the fixing device 26, the routine proceeds to step 1918, at which the charging signals CS1, CS2, CS3, and CS4 are made high, as shown in FIG. 20, and thus the electric charging of the capacitor 42b-1, 42b-2, 42b-3, and 42b-4 is initiated by the electric source 42a-1, 42a-2, 42a-3, and 42a-44.

At step 1919, it is determined whether or not the time $T_L$ (FIG. 20) has elapsed. The time $T_L$ is defined as the time from when the charging signals CS1, CS2, CS3, and CS4 are made high until the capacitors 42b-1, 42b-2, 42b-3, and 42b-4 are charged to 1,700 volts (FIG. 20). When the time $T_L$ has elapsed, the routine proceeds to step 1714, at which all of the charging signals CS1, CS2, CS3, and CS4 are made low.

At step 1921, it is determined whether or not the time $T_X$ (FIG. 18) has elapsed. When the time $T_X$ has elapsed, i.e., when the lateral center line of the reversed paper reaches the location just below the lateral center line CL of the fixing device 26, the routine proceeds to step 1922, at which the trigger signals TS1, TS2, TS3, and TS4 are output from the control circuit 40 to the choke coils 42c-1, 42c-2, 42c-3, and 42c-4, respectively, so that high voltage pulses are output from the choke coils 42c-1, 42c-2, 42c-3, and 42c-4 to the xenon lamps 26-1, 26-2, 26-3, and 26-4, to thereby emit flash-radiation from the xenon lamps 26-1, 26-2, 26-3, and 26-4. Namely, the respective zones $Z_1$, $Z_2$, $Z_3$, and $Z_4$ of the paper are exposed to the flash-radiation emitted from the xenon lamps 26-1, 26-2, 26-3, and 26-4 which are charged to the high level voltage (1,700 volts).

Figure 21A:
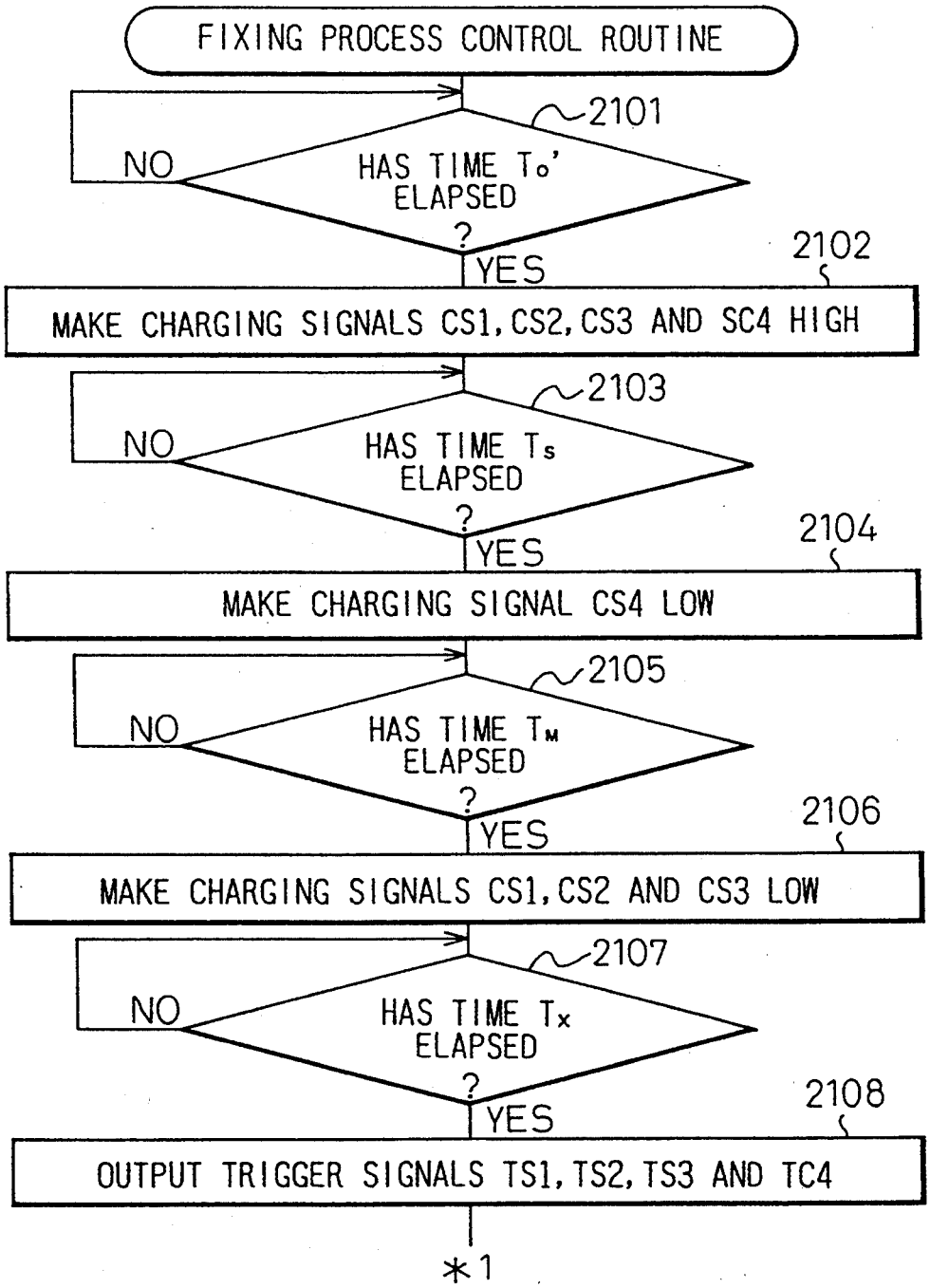
FIGS. 21(A) and 21(B) show a flow chart for explaining yet another operational mode of the toner image fixing device shown in FIGS. 16(A) and 16(B)
Figure 21B:
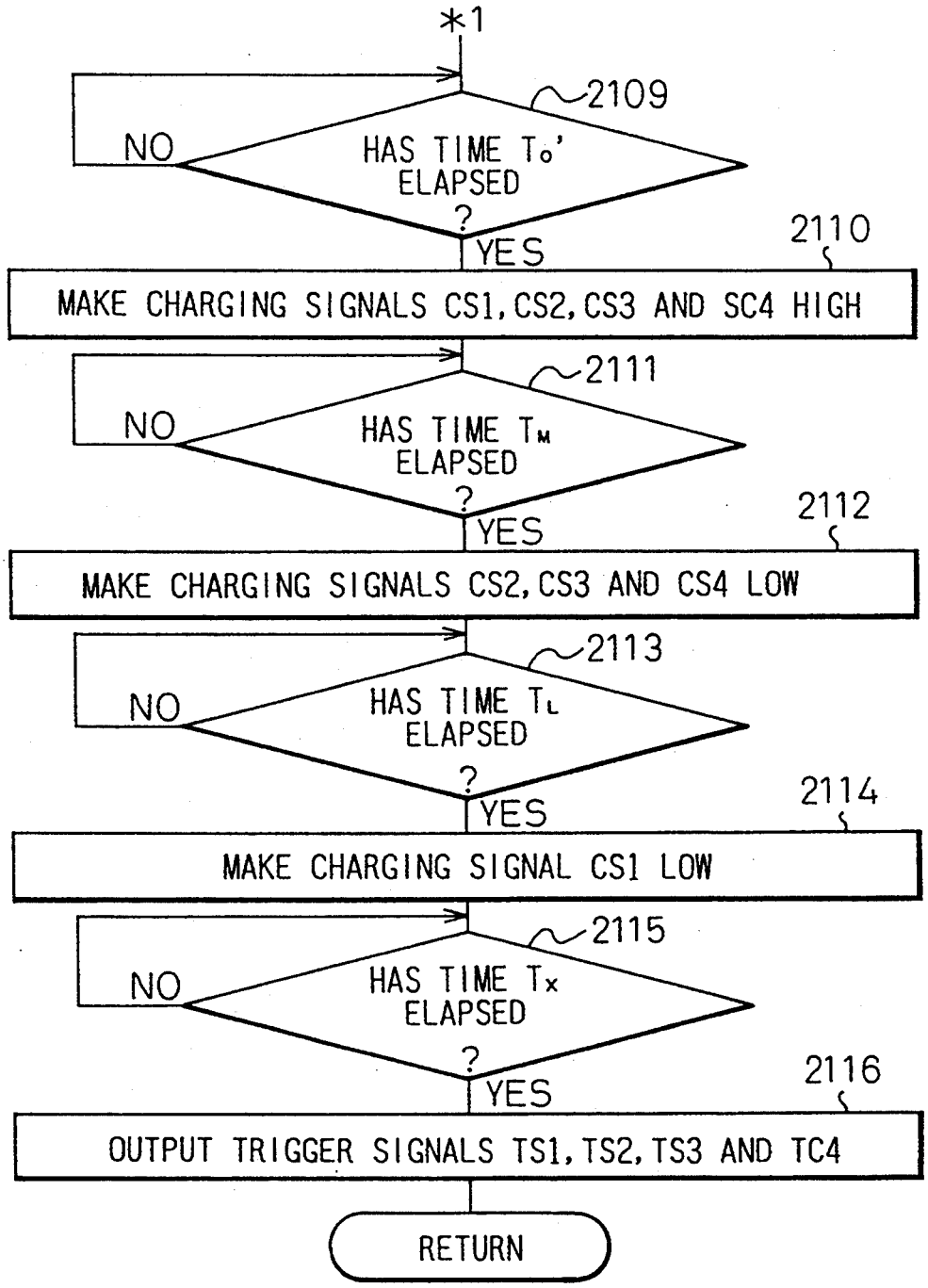
Figure 22:
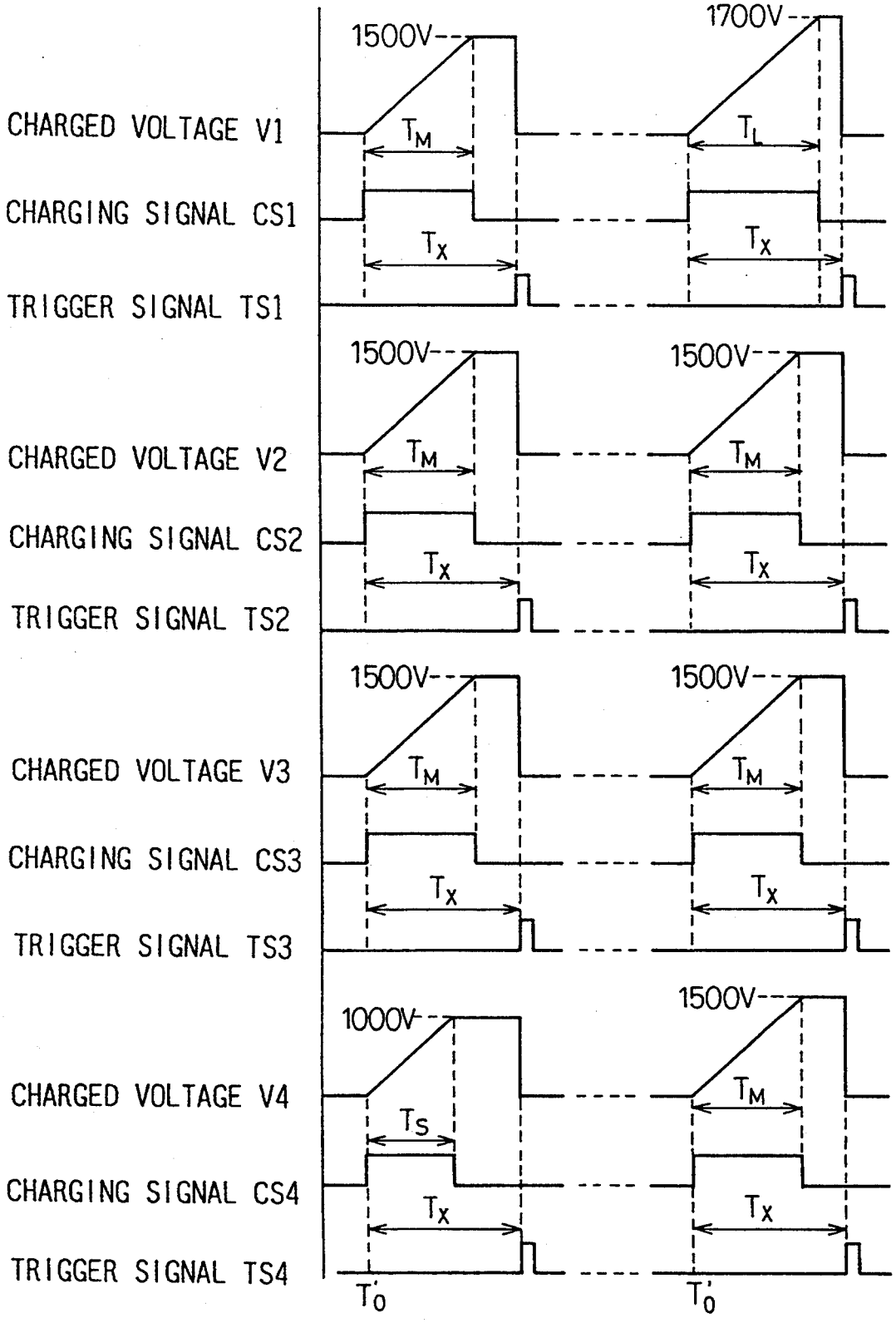
FIG. 22 is a time chart in relation to the flow chart shown in FIGS. 21(A) and 21(B).

FIGS. 21(A) and 21(B) and FIG. 22 show yet another operational mode of the toner image transferring device as shown in FIGS. 13 to 16, which corresponds to the operational mode shown in FIGS. 11 and 12.

At step 2101, it is determined whether or not the time $T_O'$ (FIG. 22) has elapsed. The time $T_O'$ is defined as the time from when the timing signal is output by the control circuit 40 to drive the electric motor 44 to release the paper from the standby-condition until the leading edge of the paper reaches the location just below the lateral center line CL of the fixing device 26. When the time $T_O'$ has elapsed, the routine proceeds to step 2102, at which the charging signals CS1, CS2, CS3, and CS4 are made high, as shown in FIG. 22, and thus the electric charging of the capacitor 42b-1, 42b-2, 42b-3, and 42b-4 is initiated by the electric source 42a-1, 42a-2, 42a-3, and 42a-44.

At step 2103, it is determined whether or not the time $T_S$ (FIG. 22) has elapsed. The time $T_S$ is defined as the time from when the charging signals CS1, CS2, CS3, and CS4 are made high until the capacitors 42b-1, 42b-2, 42b-3, and 42b-4 are charged to 1,000 volts (FIG. 22).

When the time $T_S$ (FIG. 22) has elapsed, the routine proceeds to step 2104, at which the charging signal CS4 is made low. Namely, the capacitor 42c-4 is charged to the low level voltage (1,000 volts).

At step 2105, it is determined whether or not the time $T_M$ (FIG. 22) has elapsed. The time $T_M$ is defined as the time from when the charging signals CS1, CS2, and CS3 are made high until the capacitors 42b-1, 42b-2, and 42b-3 are to 1,500 volts (FIG. 22). When the time $T_M$ has elapsed, the routine proceeds to step 2106, at which all of the charging signals CS1, CS2, and CS3 are made low. Namely, the capacitors 42b-1, 42b-2, and 42b-3, but not the capacitor 42c-4, are charged to the voltage of 1,000 volts.

At step 2107, it is determined whether or not the time $T_X$ (FIG. 22) has elapsed. The time $T_X$ is defined as the time from when the leading edge of the paper reaches the location just below the lateral center line CL of the fixing device 26 until the lateral center line of the paper is moved to that location. When the time $T_X$ has elapsed, the routine proceeds to step 2108, at which the trigger signals TS1, TS2, TS3, and TS4 are output from the control circuit 40 to the choke coils 42c-1, 42c-2, 42c-3, and 42c-4, respectively, so that high voltage pulses are output from the choke coils 42c-1, 42c-2, 42c-3, and 42c-4 to the xenon lamp 26-1, 26-2, 26-3, and 26-4, to thereby emit flash-radiation from the xenon lamp 26-1, 26-2, 26-3, and 26-4. Namely, the respective zones $Z_1$, $Z_2$, and $Z_3$ of the paper are exposed to the flash-radiation derived from the voltage of 1,500 volts, whereas the zone $Z_4$ of the paper is exposed to the flash-radiation derived from the low level voltage of 1,000 volts.

In this operational mode, the paper is reversed and returned to the register rollers 22 and 22 through the paper bypass passageway BP for the two-sided recording.

At step 2109, it is determined whether or not the time $T_O'$ (FIG. 22) has elapsed. When the time $T_O'$ has elapsed, i.e., when the leading edge of the reversed paper reaches the location just below the lateral center line CL of the fixing device 26, the routine proceeds to step 2110, at which the charging signals CS1, CS2, CS3, and CS4 are made high, as shown in FIG. 22, and thus the electric charging of the capacitor 42b-1, 42b-2, 42b-3, and 42b-4 is initiated by the electric source 42a-1, 42a-2, 42a-3, and 42a-44.

At step 2111, it is determined whether or not the time $T_M$ (FIG. 22) has elapsed. When the time $T_M$ has elapsed, i.e., when the capacitors 42b-1, 42b-2, 42b-3, and 42b-4 are charged to 1,500 volts, the routine proceeds to step 2112, at which the charging signals CS2, CS3, and CS4 for the charging signal CS1 are made low.

At step 2113, it is determined whether or not the time $T_L$ (FIG. 22) has elapsed. When the time $T_L$ has elapsed, i.e., when the capacitor 42b-1 is charged to 1,700 volts, the routine proceeds to step 2114, at which the charging signal CS1 is made low.

At step 2115, it is determined whether or not the time $T_X$(FIG. 22) has elapsed. When the time $T_X$has elapsed, i.e., when the lateral center line of the reversed paper reaches the location just below the lateral center line CL of the fixing device 26, the routine proceeds to step 2116, at which the trigger signals TS1, TS2, TS3, and TS4 are output from the control circuit 40 to the choke coils 42c-1, 42c-2, 42c-3, and 42c-4, respectively, so that high voltage pulses are output from the choke coils 42c-1, 42c-2, 42c-3, and 42c-4 to the xenon lamp 26-1, 26-2, 26-3, and 26-4, to thereby emit flash-radiation from the xenon lamp 26-1, 26-2, 26-3, and 26-4. Namely, the first zone ($Z_4$) of the paper is exposed to the flash-radiation derived from the high level voltage of 1,700 volts, and the remaining zones ($Z_3$, $Z_2$, and $Z_1$) of the paper are exposed to the flash-radiation derived from the voltage of 1,500 volts.

In the embodiments as mentioned above, it should be understood that, although the toner image fixing device is referred to as including the xenon lamp or xenon lamps, other types of lamps may be used therein.

Also, it should be understood that the paper is divided into the four zones by way of example. Namely, the paper may be divided into more than or less than four zones. Further, the paper may be divided in a matrix-like manner. Of course, in these cases, the lamps are arranged to be adapted to a pattern of the divided zones of the paper.

Finally, it will be understood by those skilled in the art that the foregoing description is of preferred embodiments of the present invention, and that various changes and modifications can be made without departing from the spirit and scope thereof.

I claim:

1. A toner image fixing device disposed above a passageway along which a sheet of paper carrying toner images recorded thereon is moved, said device comprising:

emission means for emitting heat-radiation toward the passageway for thermally fusing and fixing the toner image on the sheet of paper; and control means for controlling the emission of heat-radiation from said emission means such that the energy of the heat-radiation, to which a high density toner image zone of the sheet of paper is subjected, is smaller than that of the heat-radiation to which a low density toner image zone of the sheet of paper is subjected, to thereby prevent undulation of the sheet of paper.

2. A toner image fixing device as set forth in claim 1, further comprising:

calculation means for calculating total density data representing densities of toner images recorded on at least two zones of the sheet of paper; and determination means for determining the high density toner image zone and the low density toner image zone of the sheet of paper on the basis of the total density data calculated by said calculation means.

3. A toner image fixing device as set forth in claim 2, wherein said calculation means calculates the total density data on the basis of density information obtained from real toner images to be recorded on the sheet of paper.

4. A toner image fixing device as set forth in claim 2, wherein said calculation means calculates the total density data on the basis of image information for forming real toner images to be recorded on the sheet of paper.

5. A toner image fixing device as set forth in claim 1, wherein said emission means includes lamp means for emitting the heat-radiation, and source means for supplying electric energy to said lamp means, and wherein said control means controls supply of the electric energy from said source means to said lamp means for controlling the emission of heat-radiation.

6. A toner image fixing device as set forth in claim 5, further comprising:

calculation means for calculating total density data representing densities of toner images recorded on at least two zones of the sheet of paper; and determination means for determining the high density toner image zone and the low density toner image zone of the sheet of paper on the basis of the total density data calculated by said calculation means.

7. A toner image fixing device as set forth in claim 6, wherein said calculation means calculates the total density data on the basis of density information obtained from real toner images to be recorded on the sheet of paper.

8. A toner image fixing device as set forth in claim 6, wherein said calculation means calculates the total density data on the basis of image information for forming real toner images to be recorded on the sheet of paper.

9. A toner image fixing device used for two-sided recording and disposed above a passageway along which a sheet of paper carrying toner images recorded thereon is moved, said device comprising:

emission means for emitting heat-radiation toward the passageway for thermally fusing and fixing the toner image on the sheet of paper; and control means for controlling the emission of heat-radiation from said emission means such that the energy of the heat-radiation, to which a high-density toner image zone of the sheet of paper is subjected, is smaller than that of the heat-radiation to which a low-density toner image zone of the sheet of paper is subjected, during an initial fixing process for the two-sided recording, to thereby prevent undulation of the sheet of paper.

10. A toner image fixing device as set forth in claim 9, further comprising:

calculation means for calculating total density data representing densities of toner images recorded on at least two zones of the sheet of paper, during the initial fixing process for the two-sided recording; and determination means for determining the high-density toner image zone and the low-density toner image zone of the sheet of paper on the basis of the total density data calculated by said calculation means.

11. A toner image fixing device as set forth in claim 10, wherein said calculation means calculates the total density data on the basis of density information obtained from real toner images to be recorded on the sheet of paper.

12. A toner image fixing device as set forth in claim 10, wherein said calculation means calculates the total density data on the basis of image information for forming real toner images to be recorded on the sheet of paper.

13. A toner image fixing device as set forth in claim 9, wherein said emission means includes lamp means for emitting heat-radiation, and source means for supplying electric energy to said lamp means, and wherein said control means controls supply of the electric energy from said source means to said lamp means for controlling the emission of heat-radiation.

14. A toner image fixing device as set forth in claim 13, further comprising:

calculation means for calculating total density data representing densities of toner images recorded on at least two zones of the sheet of paper, during the initial fixing process for the two-sided recording; and determination means for determining the high-density toner image zone and the low-density toner image zone of the sheet of paper on the basis of the total density data calculated by said calculation means.

15. A toner image fixing device as set forth in claim 14, wherein said calculation means calculates the total density data on the basis of density information obtained from real toner images to be recorded on the sheet of paper.

16. A toner image fixing device as set forth in claim 14, wherein said calculation means calculates the total density data on the basis of image information for forming real toner images to be recorded on the sheet of paper.

17. A toner image fixing device used for two-sided recording and disposed above a passageway along which a sheet of paper carrying with toner images recorded thereon is moved, said device comprising:

emission means for emitting heat-radiation toward the passageway for thermally fusing and fixing the toner image on the sheet of paper; and control means for controlling the emission of heat-radiation from said emission means such that a high-density toner image zone and a toner low-density image zone of the sheet of paper are subjected to low-level energy heat-radiation and middle-level energy heat-radiation, respectively, during an initial fixing process for the two-sided recording, to thereby prevent an undulation of the sheet of paper, and such that the sheet of paper is subjected to high-level energy heat-radiation during a second fixing process for the two-sided recording.

18. A toner image fixing device as set forth in claim 17, further comprising:

calculation means for calculating total density data representing densities of toner images recorded on at least two zones of the sheet of paper, during the initial fixing process for the two-sided recording; and determination means for determining the high-density toner image zone and the low-density toner image zone of the sheet of paper on the basis of the total density data calculated by said calculation means.

19. A toner image fixing device as set forth in claim 18, wherein said calculation means calculates the total density data on the basis of density information obtained from real toner images to be recorded on the sheet of paper.

20. A toner image fixing device as set forth in claim 18, wherein said calculation means calculates the total density data on the basis of image information for forming real toner images to be recorded on the sheet of paper.

21. A toner image fixing device as set forth in claim 17, wherein said emission means includes lamp means for emitting heat-radiation and source means for supplying electric energy to said lamp means, wherein said control means controls supply of the electric energy from said source means to said lamp means for controlling the emission of heat-radiation.

22. A toner image fixing device as set forth in claim 21, further comprising:

calculation means for calculating total density data representing densities of toner images recorded on at least two zones of the sheet of paper, during the initial fixing process for the two-sided recording; and determination means for determining the high-density toner image zone and the low-density toner image zone of the sheet of paper on the basis of the total density data calculated by said calculation means.

23. A toner image fixing device as set forth in claim 21, wherein said calculation means calculates the total density data on the basis of density information obtained from real toner images to be recorded on the sheet of paper.

24. A toner image fixing device as set forth in claim 21, wherein said calculation means calculates the total density data on the basis of image information for forming real toner images to be recorded on the sheet of paper.

25. A toner image fixing device used for two-sided recording and disposed above a passageway along which a sheet of paper carrying toner images recorded thereon is moved, said device comprising:

emission means for emitting heat-radiation toward the passageway for thermally fusing and fixing the toner image on the sheet of paper; and control means for controlling the emission of heat-radiation from said emission means such that a trailing zone of the sheet of paper is subjected to low-level energy heat-radiation during an initial fixing process for the two-sided recording, to thereby prevent an undulation of the trailing zone of the sheet of paper, but to thereby cause an incomplete fixing of toner images held thereon, and such that the trailing zone of the sheet of paper, which is defined as a leading zone thereof during a second fixing process for the two-sided recording, is then subjected to a high-level energy heat-radiation, to thereby resolve said incomplete fixing.

* * * * *